US011898812B2

(12) United States Patent
Song et al.

(10) Patent No.: US 11,898,812 B2
(45) Date of Patent: Feb. 13, 2024

(54) SAFETY CONTROL SYSTEM FOR PORTABLE WEAPONS, INCLUDING CROSSBOW AND FIREARMS, SUCH AS HANDGUNS, RIFLES AND ALIKE

(71) Applicant: Jiuhong Song, Vancouver (CA)

(72) Inventors: Jiuhong Song, Vancouver (CA); Xinting Liu, HuBei (CN)

( * ) Notice: Subject to any disclaimer, the term of this patent is extended or adjusted under 35 U.S.C. 154(b) by 112 days.

(21) Appl. No.: 17/442,825

(22) PCT Filed: Mar. 29, 2019

(86) PCT No.: PCT/IB2019/000325

§ 371 (c)(1),
(2) Date: Sep. 24, 2021

(87) PCT Pub. No.: WO2020/201787

PCT Pub. Date: Oct. 8, 2020

(65) Prior Publication Data

US 2022/0221240 A1 Jul. 14, 2022

(51) Int. Cl.
*F41A 17/06* (2006.01)
*F41A 17/08* (2006.01)

(52) U.S. Cl.
CPC ..... *F41A 17/066* (2013.01); *F41A 17/063* (2013.01); *F41A 17/08* (2013.01)

(58) Field of Classification Search
CPC ..... F41A 17/066; F41A 17/063; F41A 17/08
See application file for complete search history.

(56) References Cited

U.S. PATENT DOCUMENTS

| | | | | |
|---|---|---|---|---|
| 4,488,370 | A | 12/1984 | Lemelson | |
| 4,682,435 | A | 7/1987 | Heltzel | |
| 6,219,113 | B1 * | 4/2001 | Takahara | G02F 1/133526 345/98 |
| 6,415,542 | B1 | 7/2002 | Bates et al. | |
| 6,550,175 | B2 | 4/2003 | Parker | |
| 6,563,940 | B2 | 5/2003 | Recce | |
| 6,871,439 | B1 * | 3/2005 | Edwards | F42B 5/035 42/84 |
| 7,389,604 | B2 | 6/2008 | Newkirk et al. | |
| 9,222,743 | B1 * | 12/2015 | Shah | F41A 17/08 |

(Continued)

FOREIGN PATENT DOCUMENTS

| | | |
|---|---|---|
| CN | 202974046 | 6/2013 |
| CN | 103358989 | 10/2013 |

(Continued)

OTHER PUBLICATIONS

Russian Office Action issued in copending Russian Patent Application No. 2021119057/11(040111) dated Jun. 20, 2022.

(Continued)

*Primary Examiner* — Joshua E Freeman
(74) *Attorney, Agent, or Firm* — Whiteford, Taylor & Preston, LLP; Gregory M. Stone

(57) ABSTRACT

A safety control system (200*a*, 200*b*, 200*c*, 200*d*, 200*e*) for portable weapons, including, but not limited to, crossbows and firearms, such as guns, rifles and alike, uses various sensors to ensure safe target, environment, location, and situation for operating portable weapons. The safety control system (200*a*, 200*b*, 200*c*, 200*d*, 200*e*) unlocks a firing sequence of the portable weapons only when it is safe to operate.

11 Claims, 37 Drawing Sheets

(56) References Cited

U.S. PATENT DOCUMENTS

| | | | | |
|---|---|---|---|---|
| 9,435,597 | B2 * | 9/2016 | Goren | F41A 17/063 |
| 9,710,630 | B2 | 7/2017 | Kim et al. | |
| 9,813,907 | B2 | 11/2017 | Chen et al. | |
| 9,857,133 | B1 | 1/2018 | Kloepfer et al. | |
| 9,921,017 | B1 * | 3/2018 | Kley | F41A 17/063 |
| 10,048,031 | B1 * | 8/2018 | Milde, Jr. | F41A 17/063 |
| 2003/0136043 | A1 | 7/2003 | Lauster et al. | |
| 2004/0242976 | A1 * | 12/2004 | Abreu | A61B 5/746 600/315 |
| 2007/0271831 | A1 | 11/2007 | Newkirk et al. | |
| 2013/0019510 | A1 * | 1/2013 | Kemmerer | F41A 17/066 42/70.11 |
| 2013/0125441 | A1 * | 5/2013 | Westwood | F41A 17/20 42/70.11 |
| 2014/0259841 | A1 * | 9/2014 | Carlson | F41A 17/08 42/70.11 |
| 2015/0094914 | A1 * | 4/2015 | Abreu | B60H 1/00742 701/1 |
| 2015/0148681 | A1 * | 5/2015 | Abreu | A61B 5/6821 600/474 |
| 2016/0091267 | A1 | 3/2016 | Mascorro | |
| 2017/0010062 | A1 * | 1/2017 | Black | F41J 5/10 |
| 2017/0074611 | A1 * | 3/2017 | Winiecki | G01S 19/14 |
| 2017/0110062 | A1 | 4/2017 | Zhang | |
| 2017/0176123 | A1 * | 6/2017 | Milde, Jr. | F41A 17/08 |
| 2018/0142977 | A1 | 5/2018 | Kloepfer et al. | |
| 2018/0238649 | A1 * | 8/2018 | Winiecki | G01S 19/13 |
| 2019/0011206 | A1 | 1/2019 | Campagna et al. | |
| 2019/0287325 | A1 * | 9/2019 | Paolo | G06K 7/10366 |
| 2019/0376755 | A1 * | 12/2019 | Teetzel | F41A 17/066 |
| 2019/0376756 | A1 * | 12/2019 | Nieh | F41A 17/08 |
| 2020/0003511 | A1 * | 1/2020 | Deng | F41A 17/06 |
| 2020/0355456 | A1 * | 11/2020 | Deng | H04N 23/66 |
| 2022/0065575 | A1 * | 3/2022 | Canty | H04N 5/28 |

FOREIGN PATENT DOCUMENTS

| | | |
|---|---|---|
| CN | 106123675 | 11/2016 |
| CN | 206974276 | 2/2018 |
| CN | 106123675 | 5/2018 |
| DE | 102010008862 | 5/2011 |
| EP | 0838670 | 4/1998 |
| RU | 2588284 | 6/2016 |

OTHER PUBLICATIONS

Extended European Search Report issued in copending European Patent Application No. 19922391.8 dated Mar. 17, 2022.

International Search Report issued in co-pending Application No. PCT/IB2019/000325 dated Dec. 27, 2019.

* cited by examiner

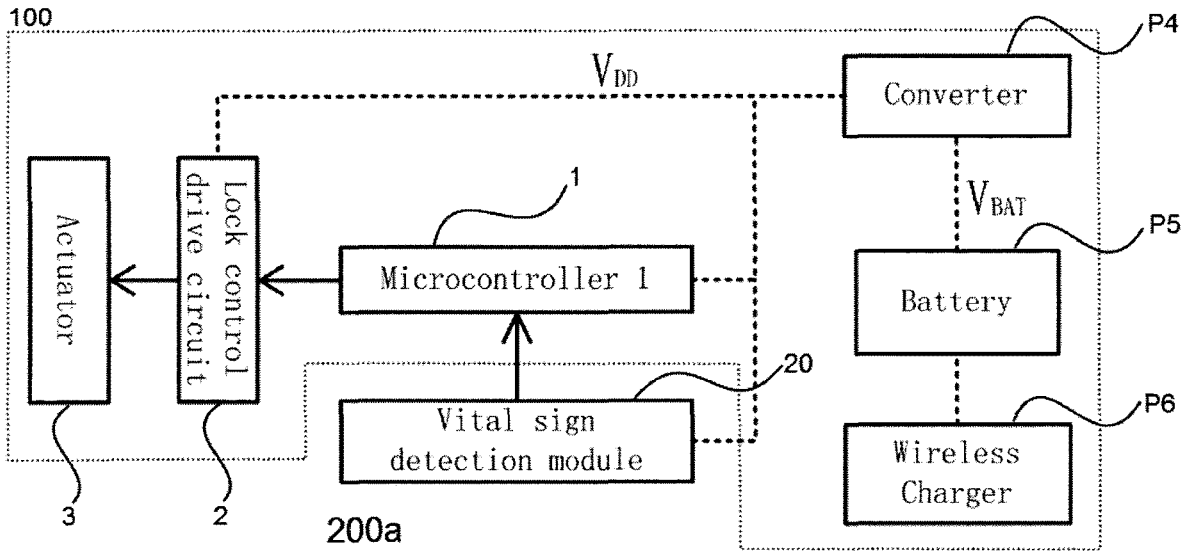
FIG 1.1
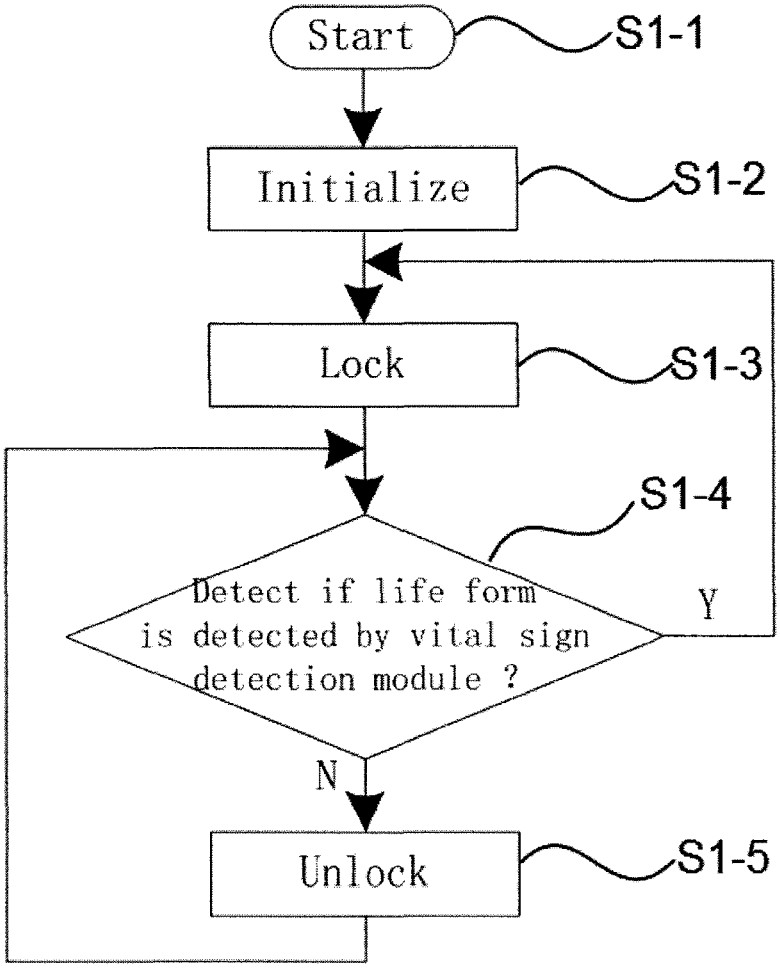
FIG 1.11

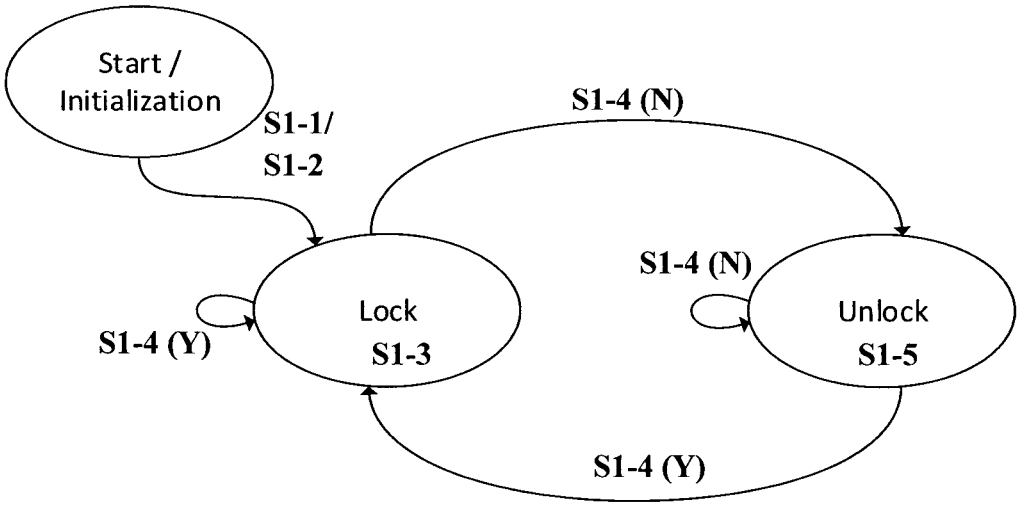
FIG 1.11a
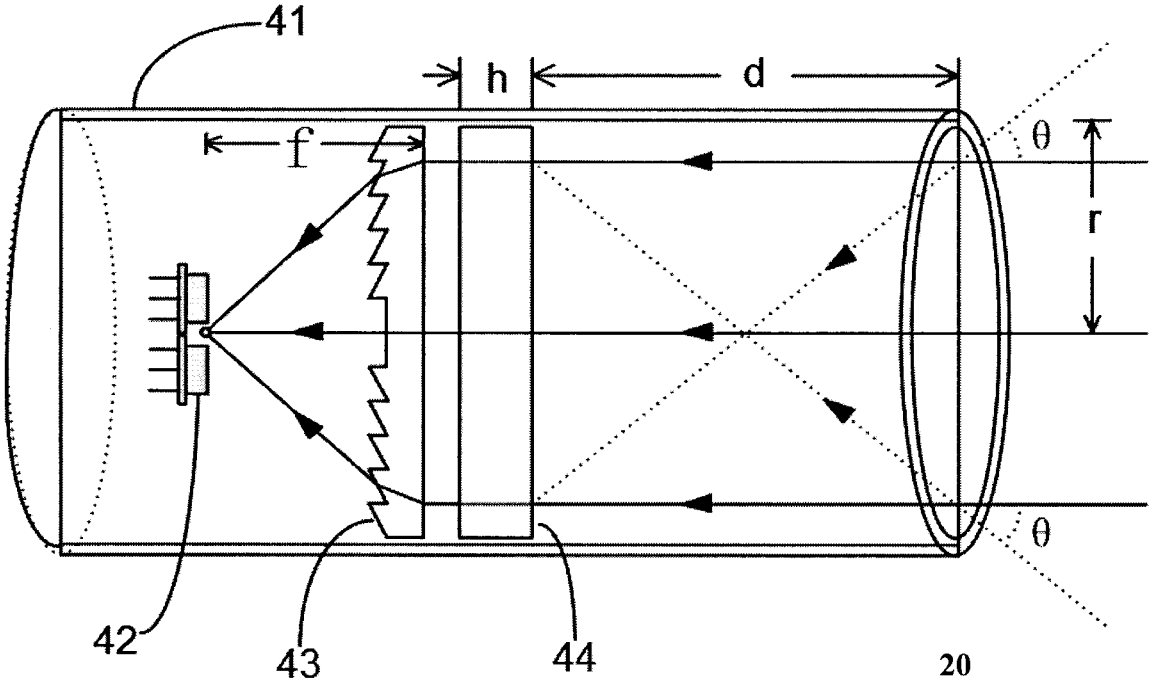
FIG 1.12

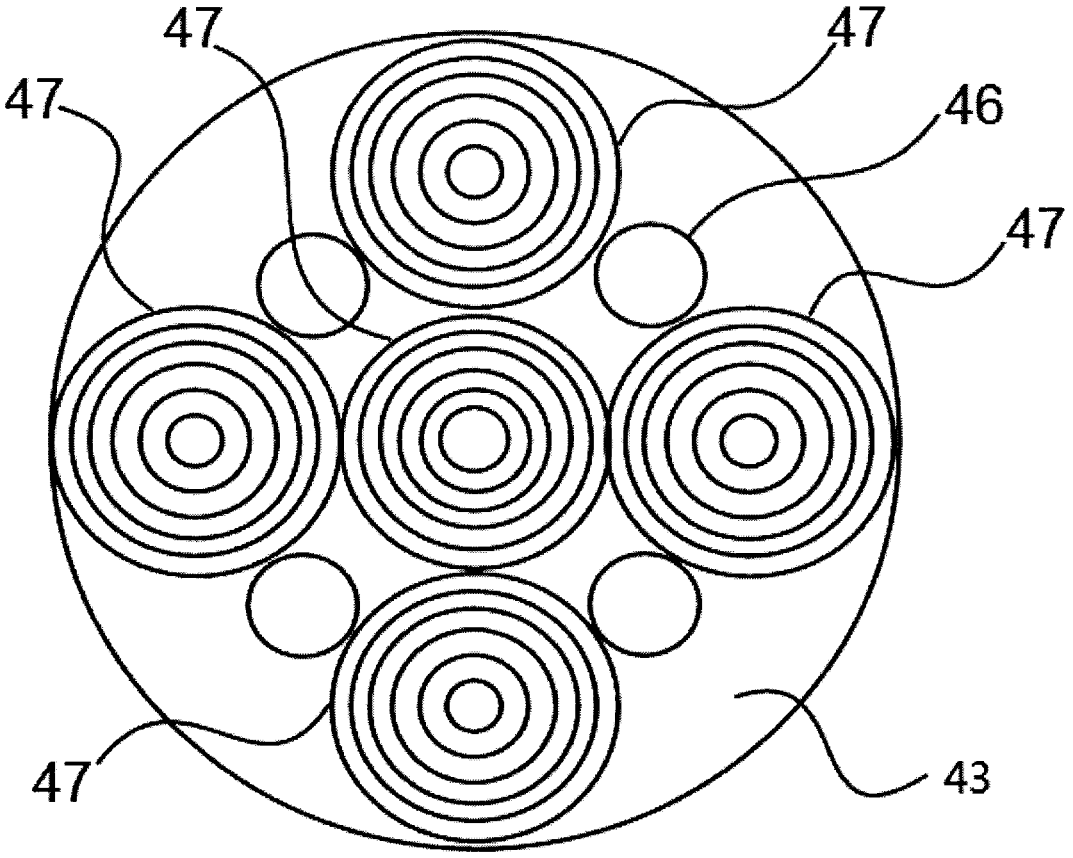
FIG 1.13

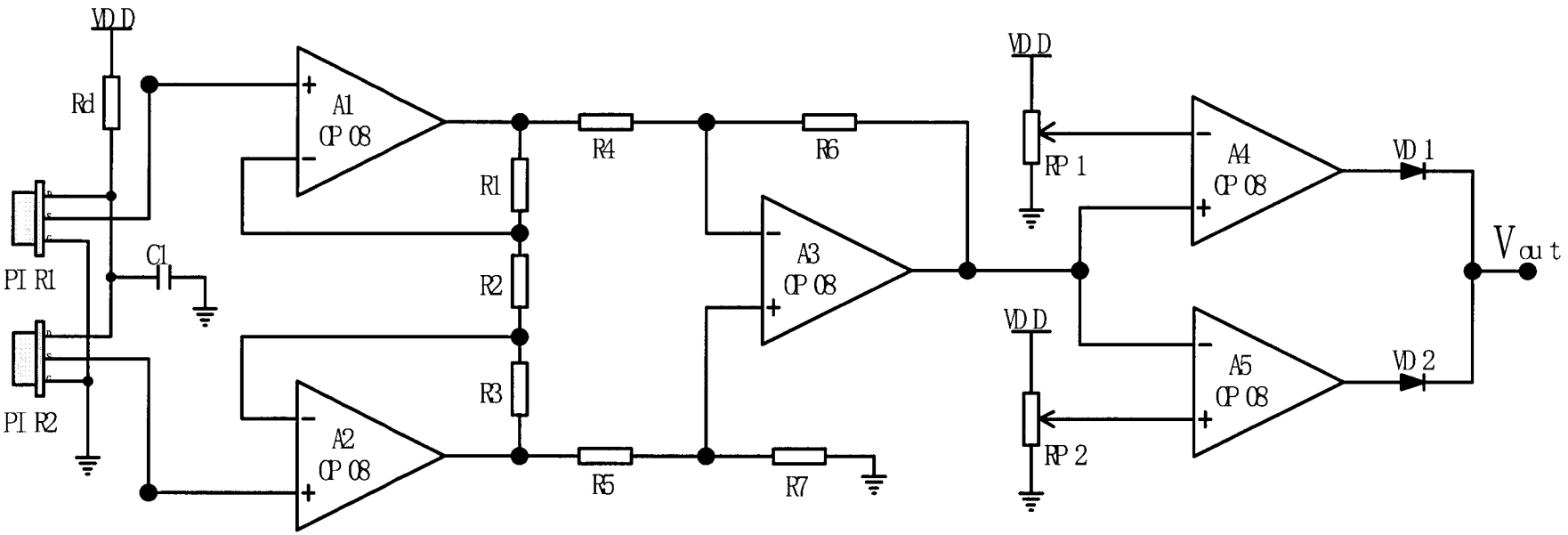
120
FIG 1.14

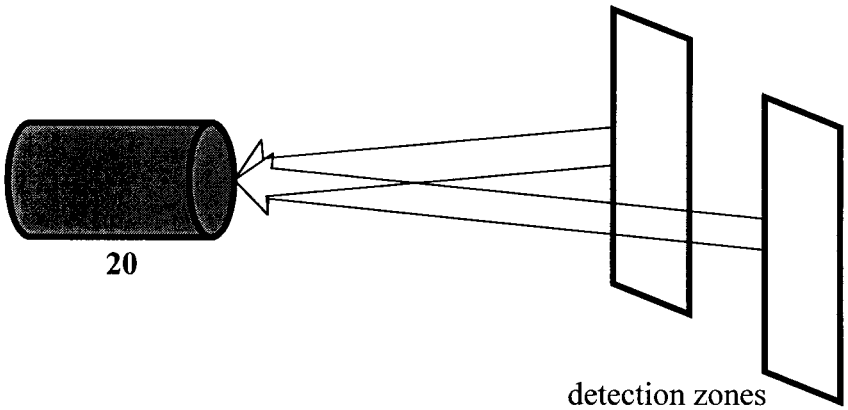
FIG 1.15a
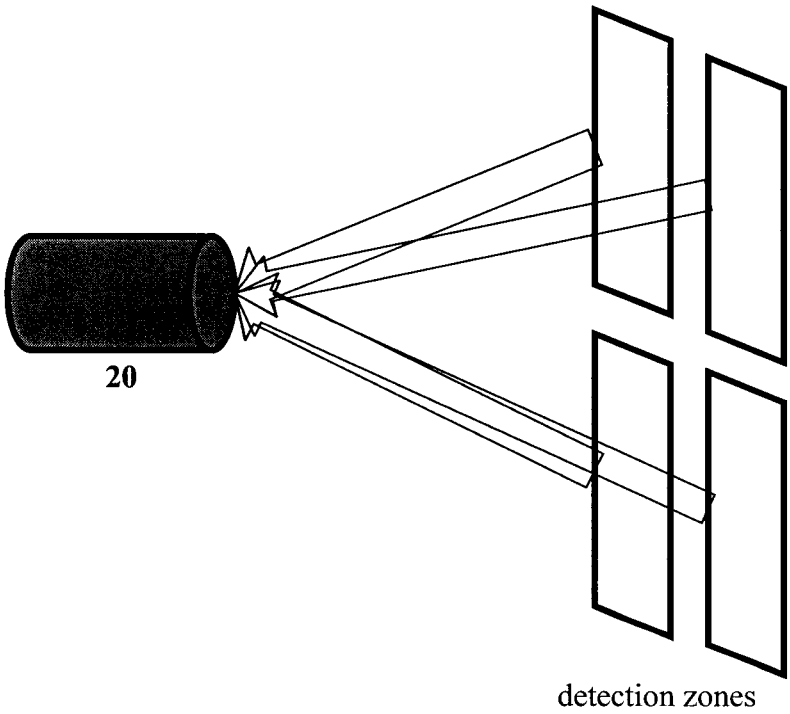
FIG 1.15b

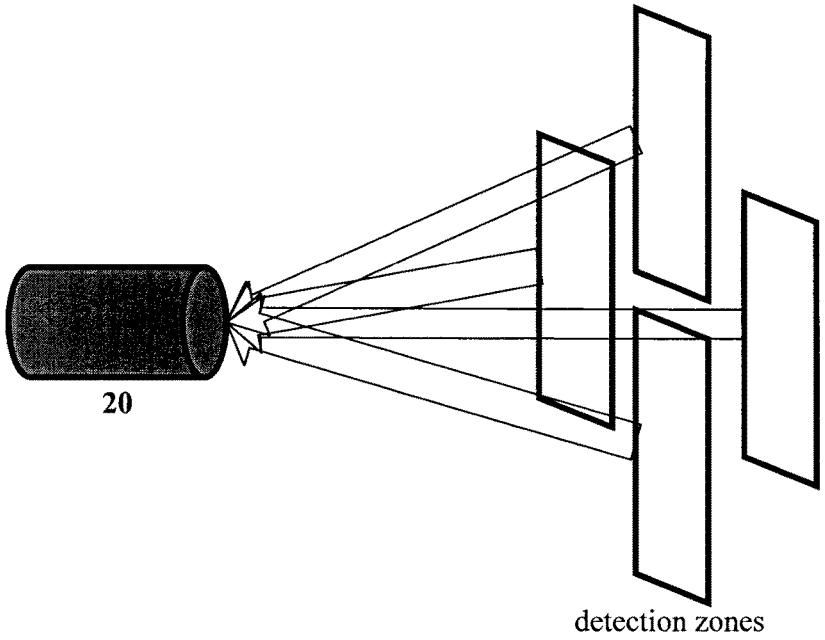
FIG 1.15c
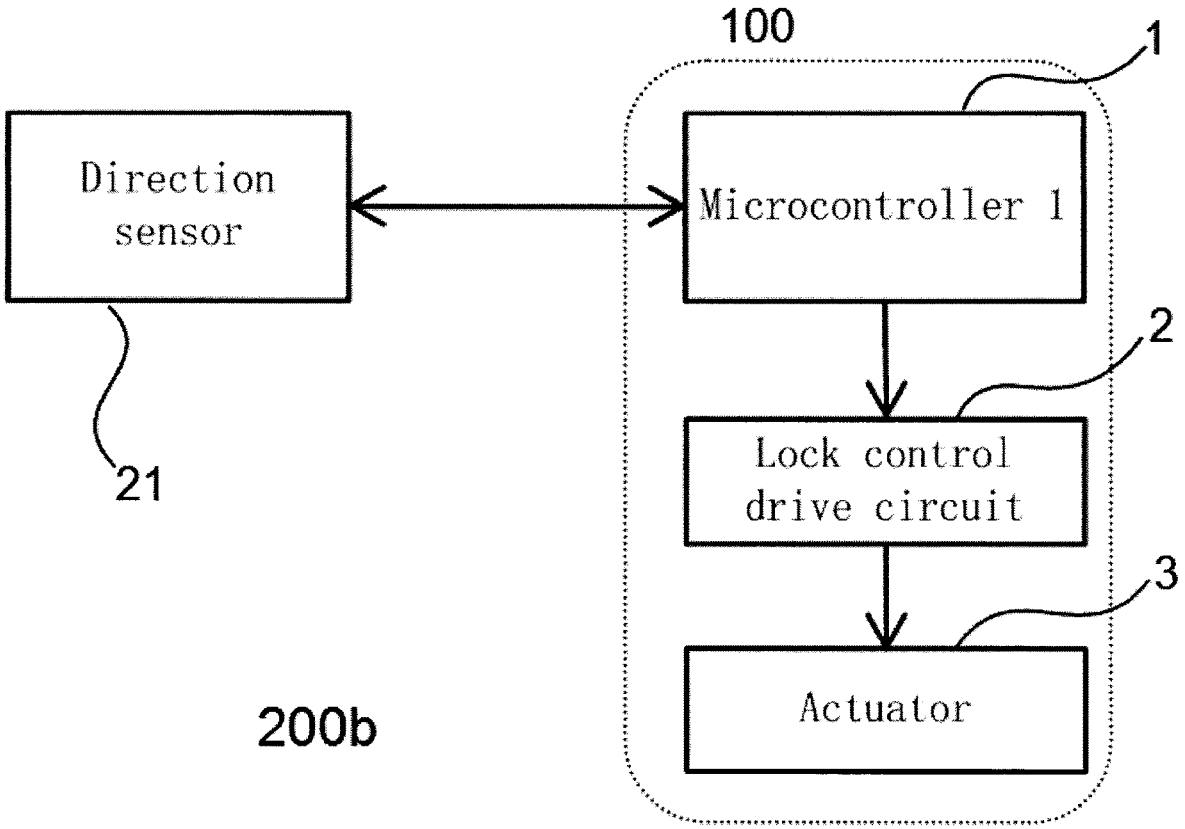
FIG 1.2

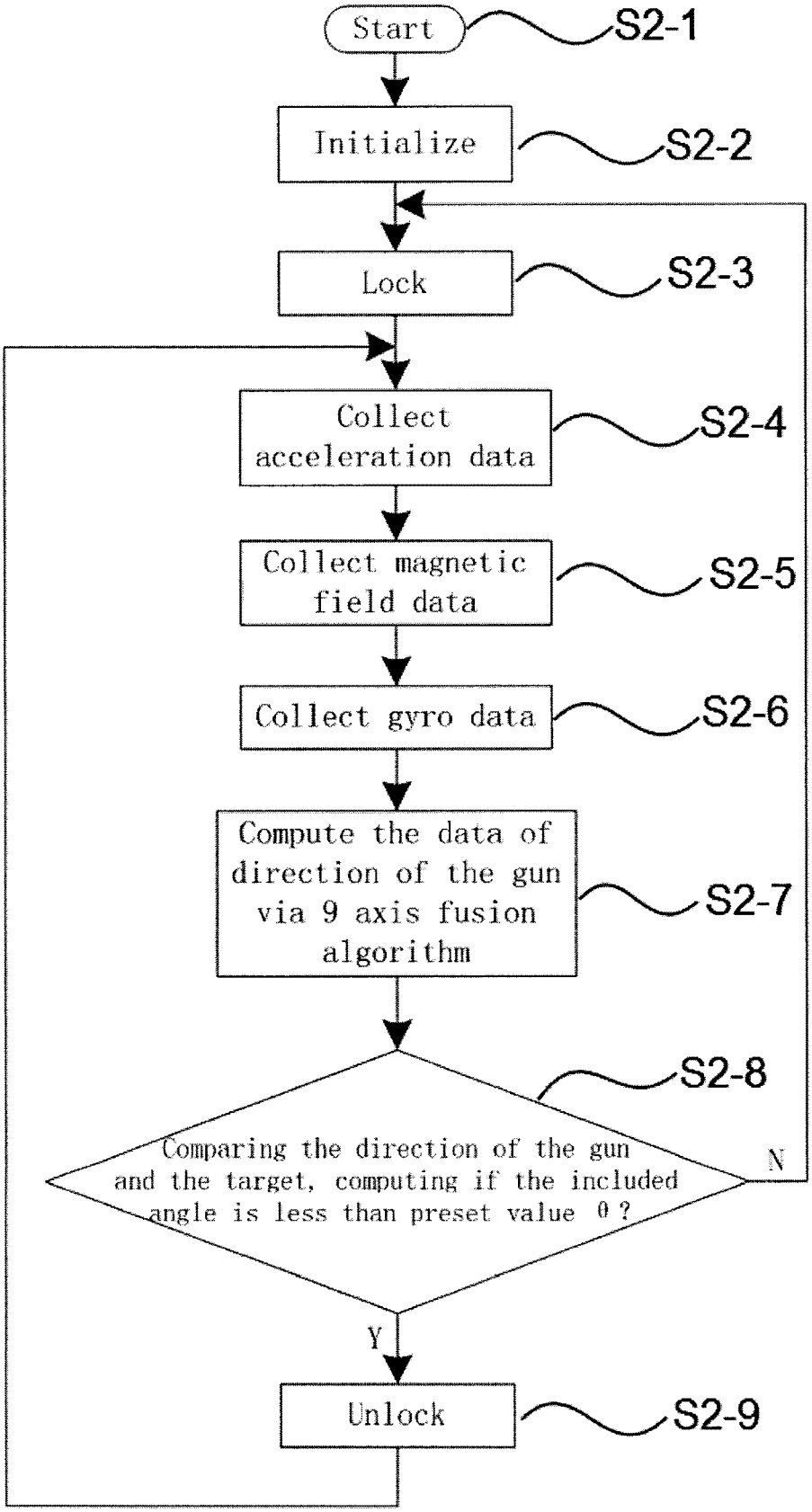
FIG 1.21

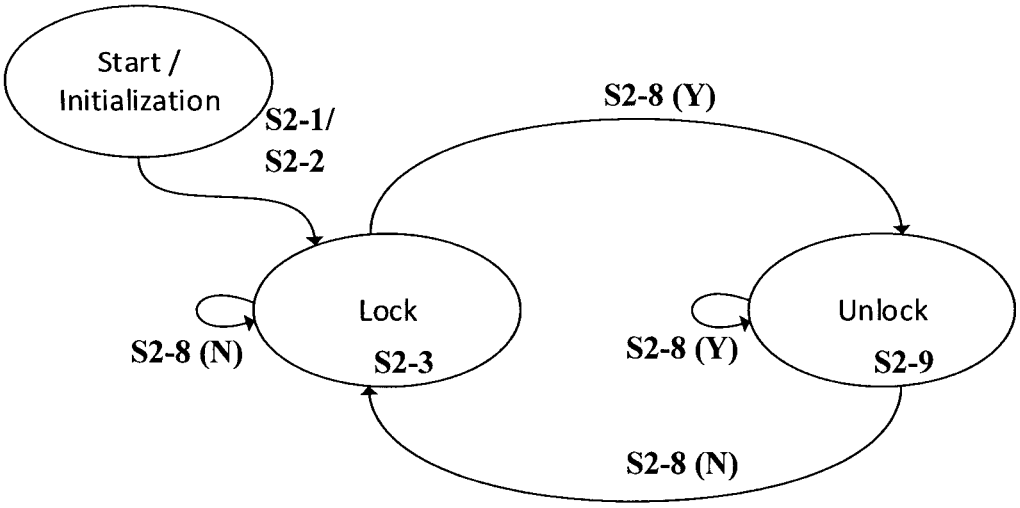
FIG 1.21a

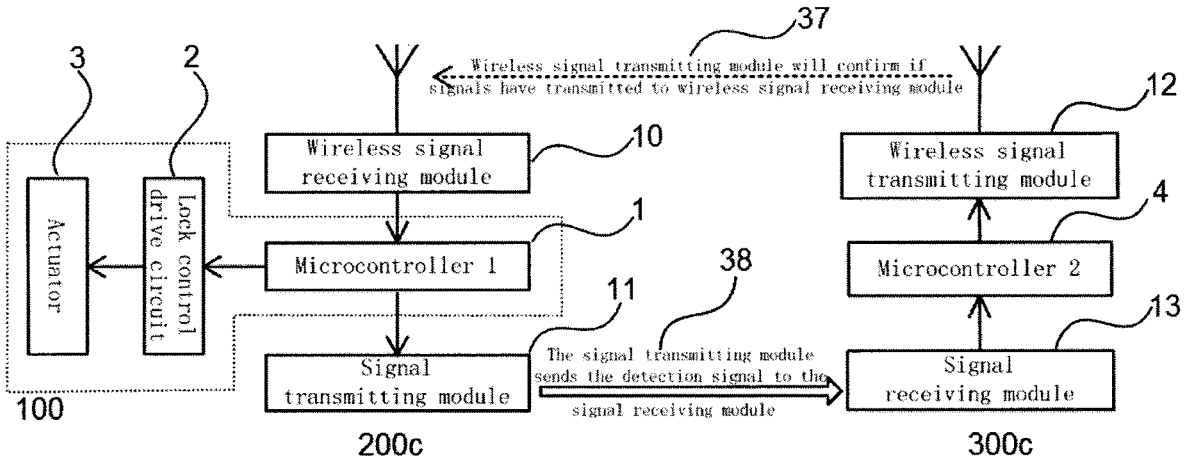
FIG 1.3
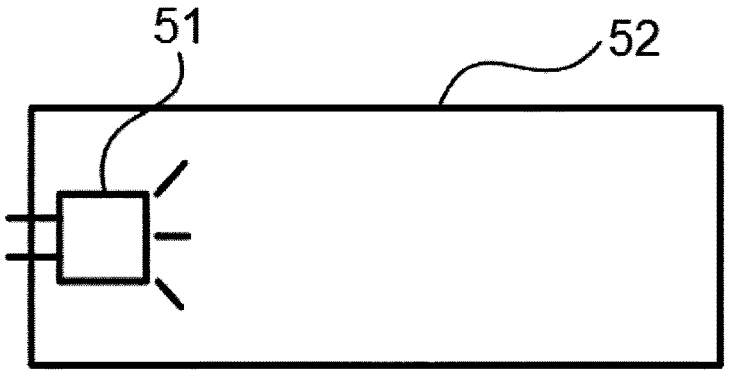
FIG 1.3a

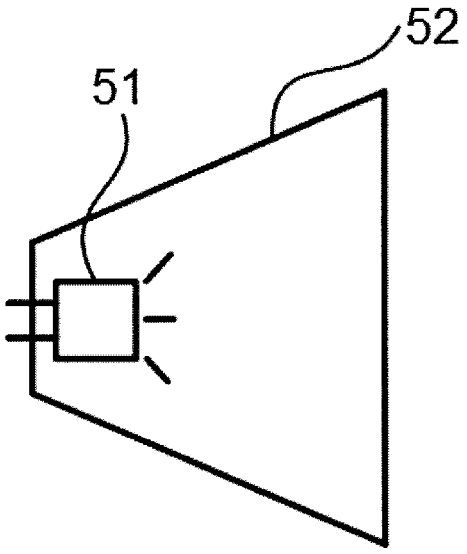
FIG 1.3b
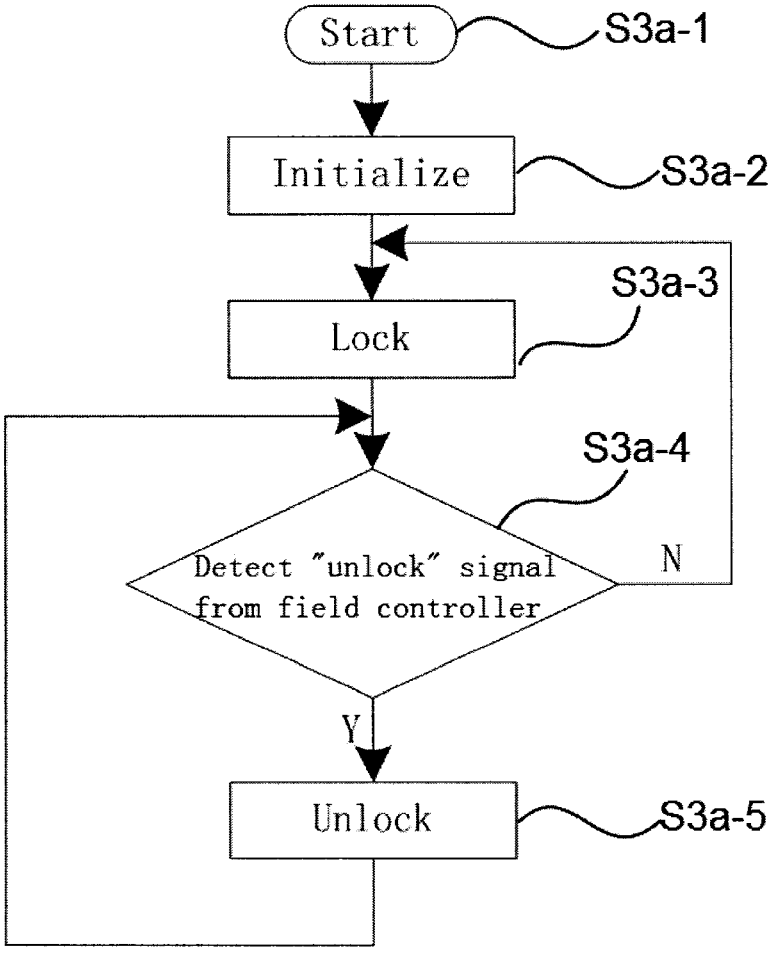
FIG 1.31a

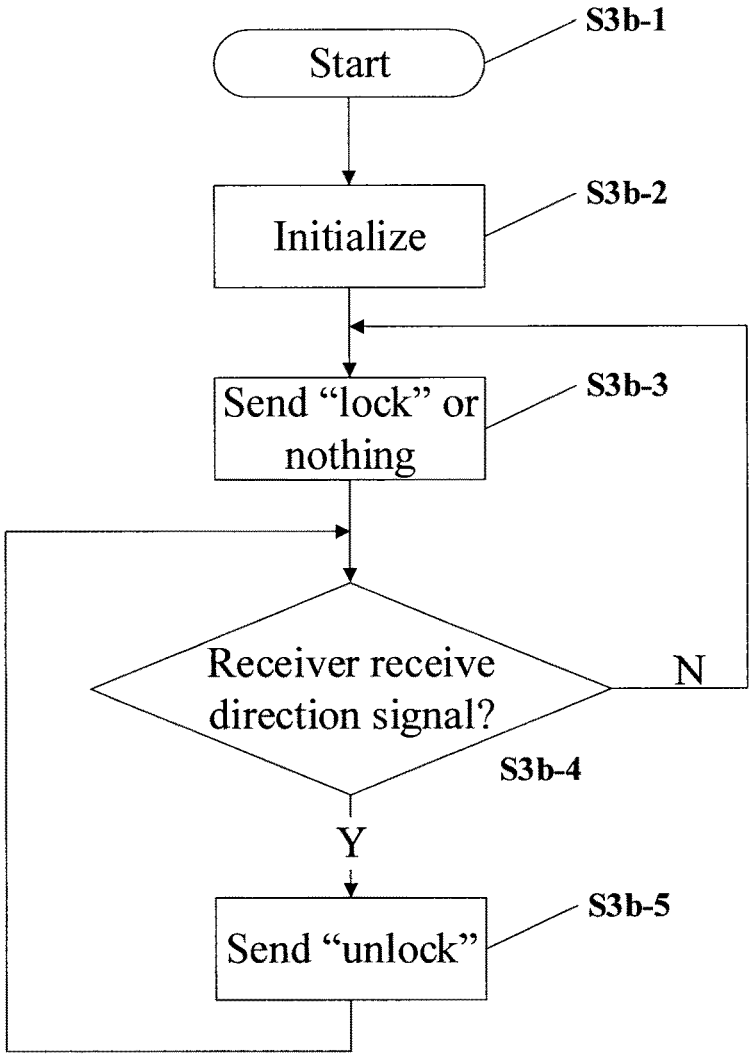
FIG 1.31b
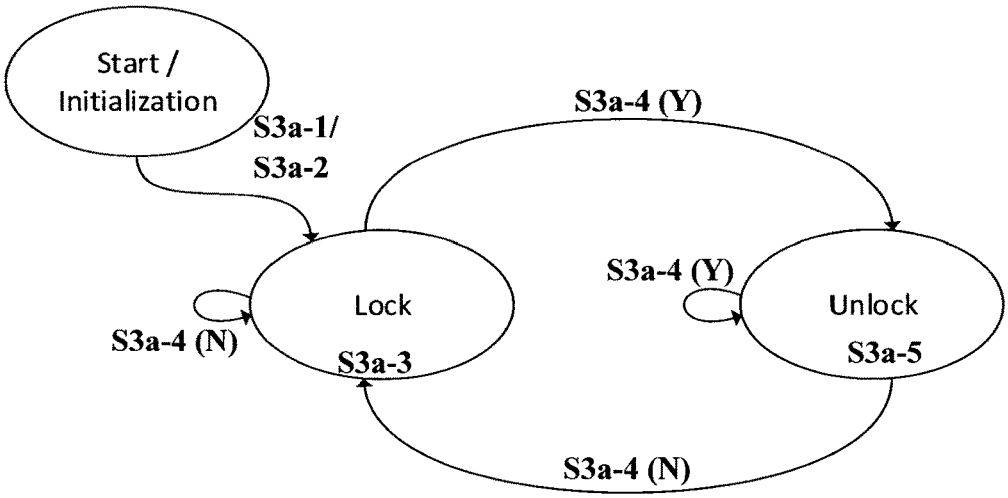
FIG 1.32a

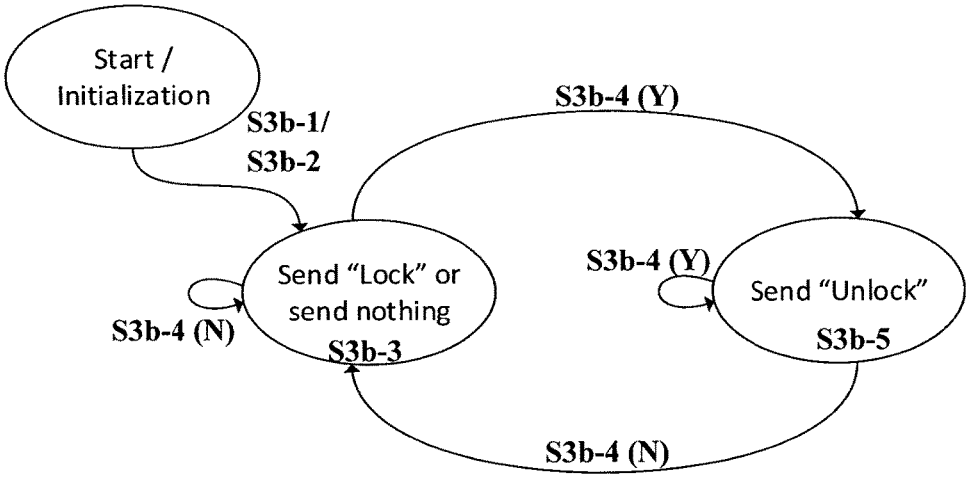
FIG 1.32b
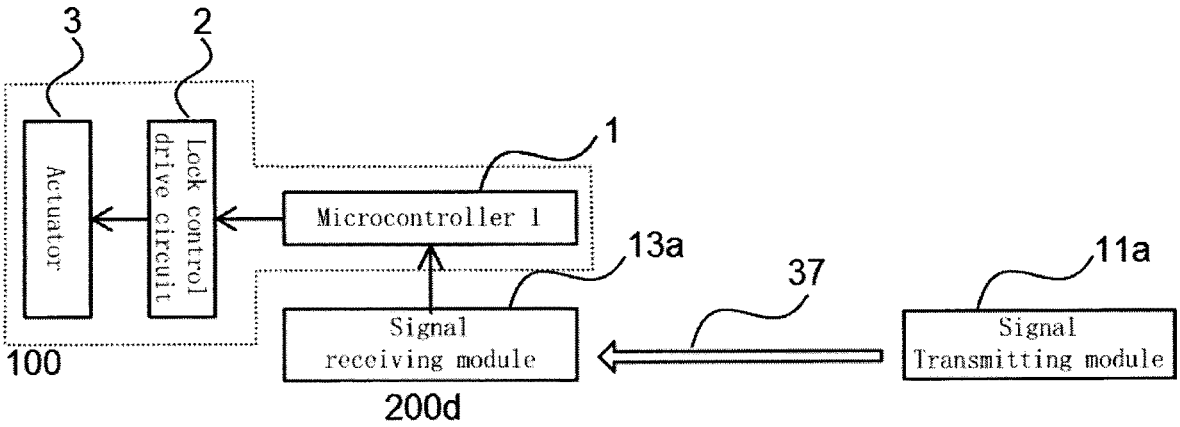
FIG 1.4

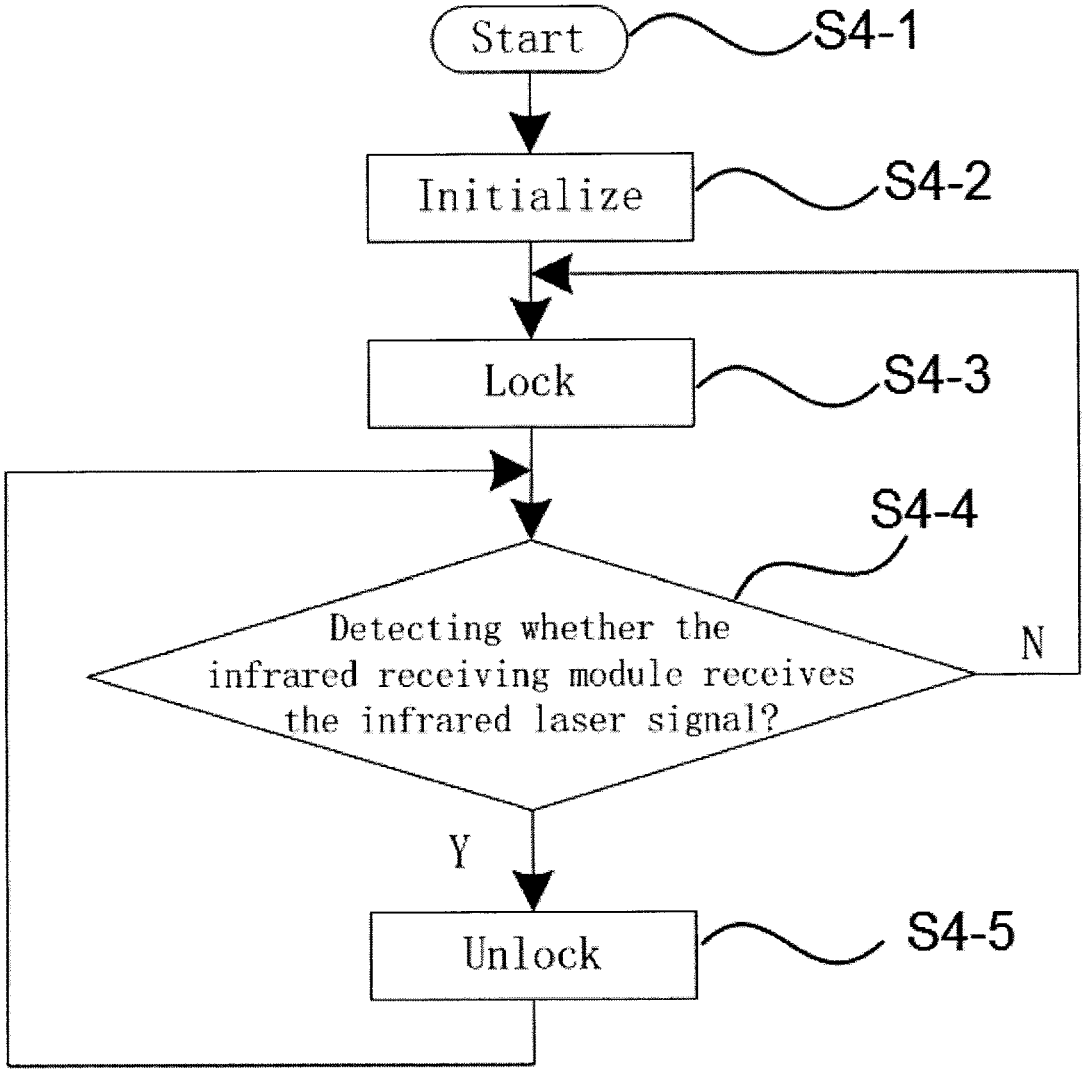
FIG 1.41
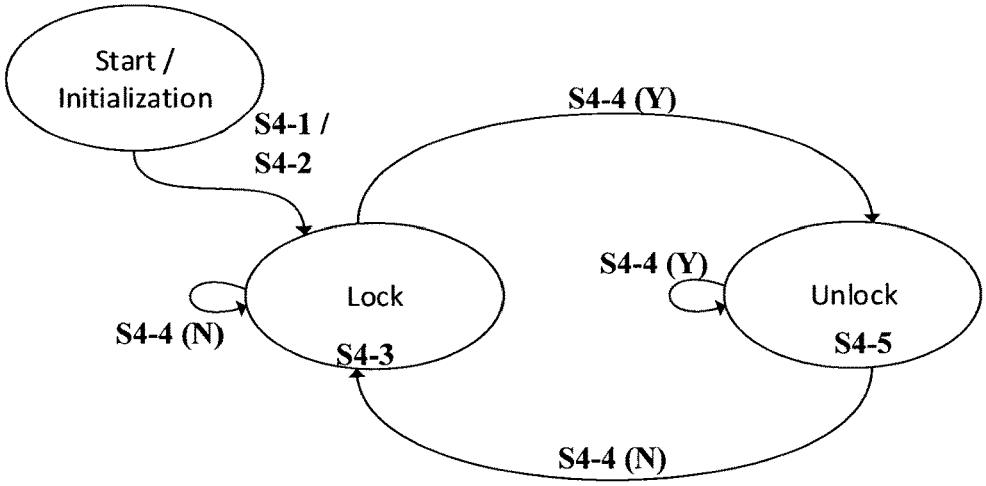
FIG 1.41a

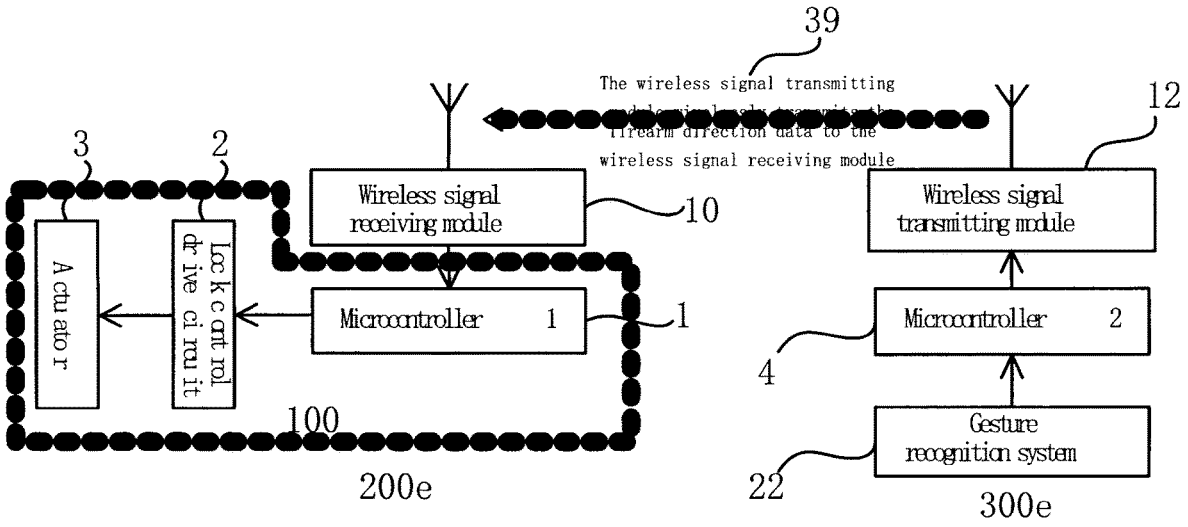
FIG 1.5
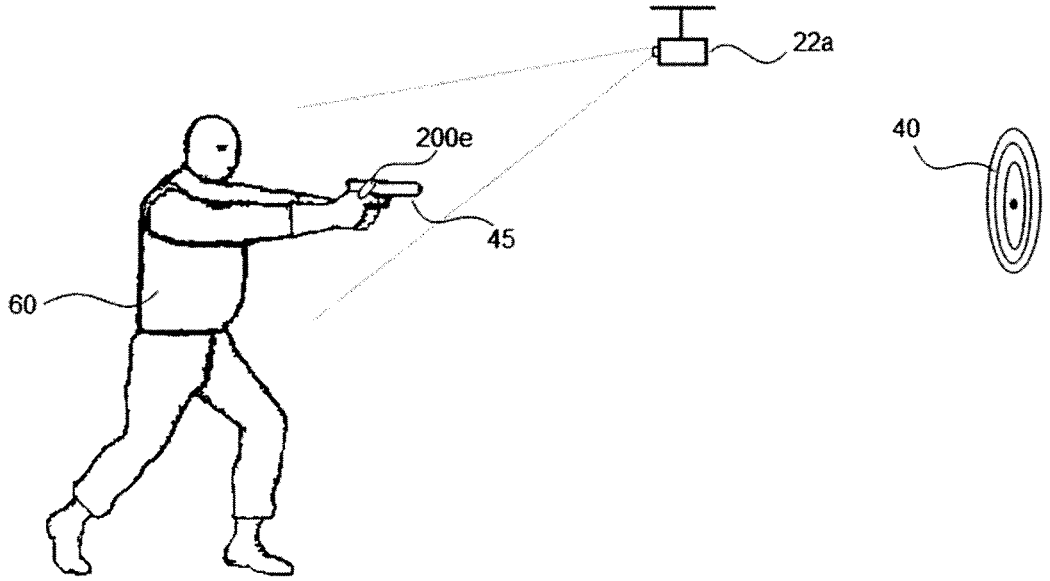
FIG 1.5a

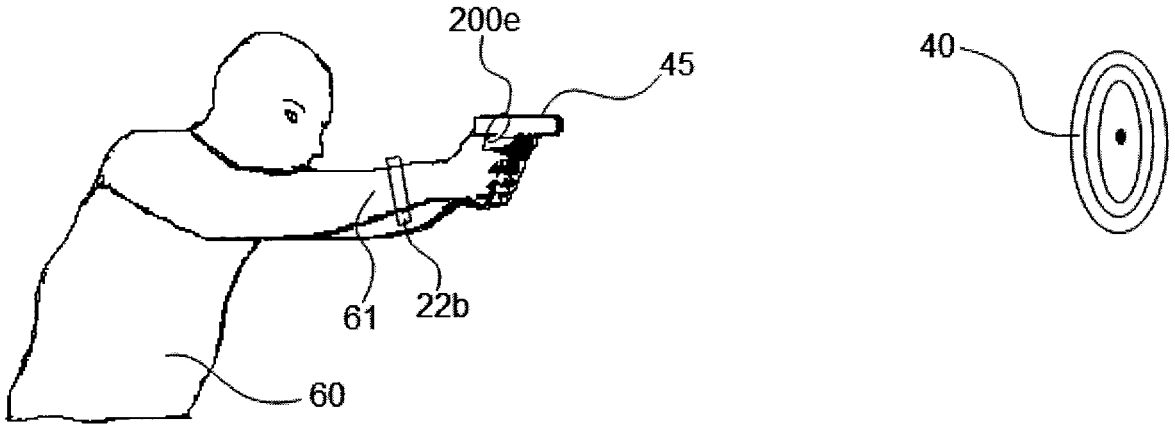
FIG 1.5b
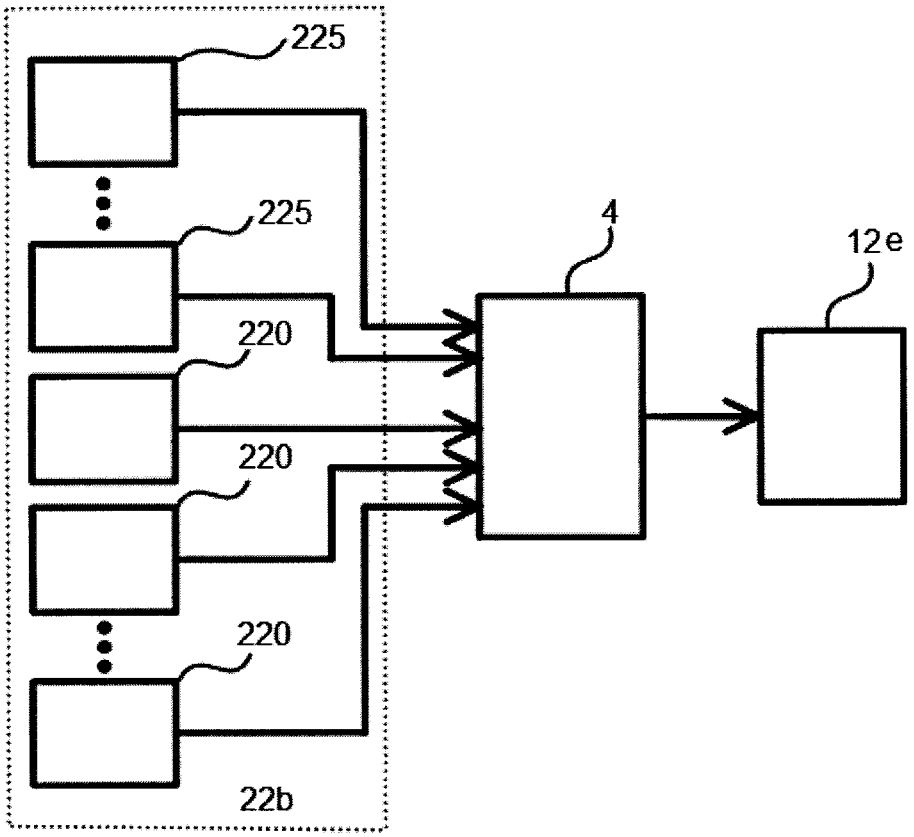
FIG 1.5c

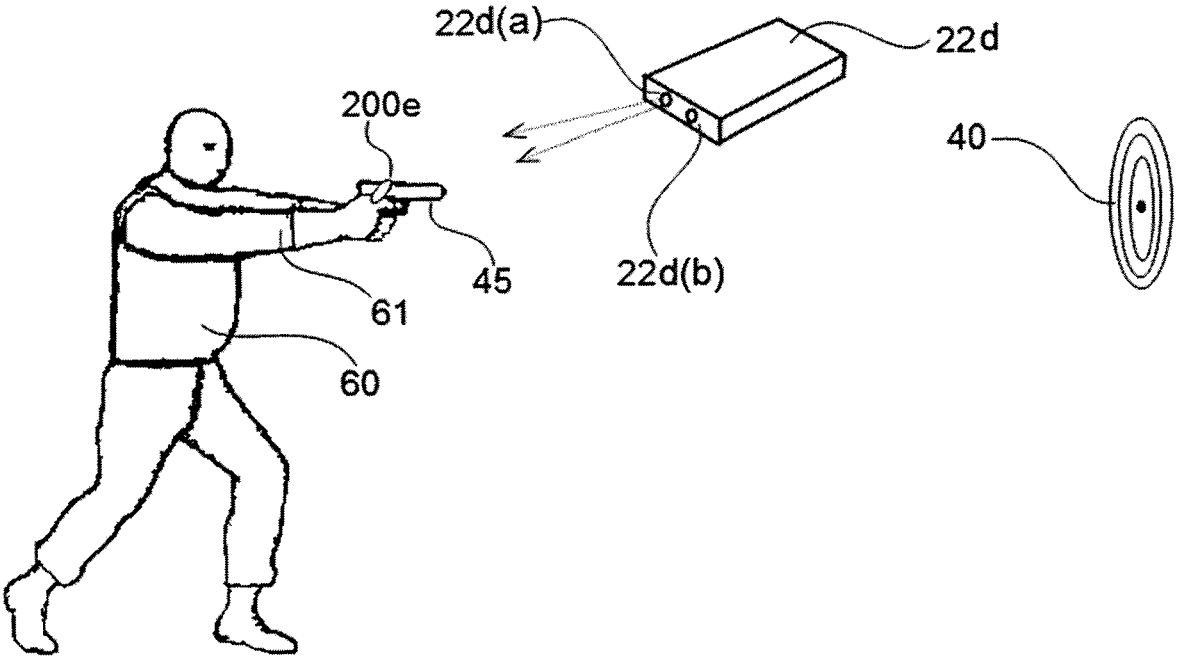
FIG 1.5d
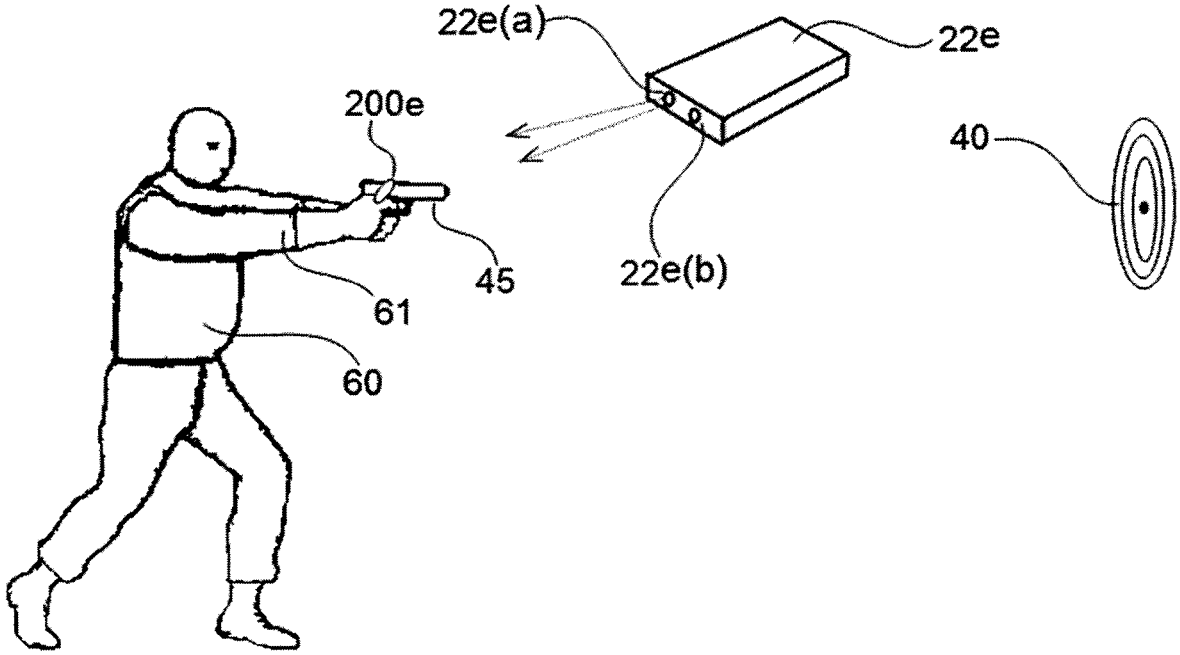
FIG 1.5e

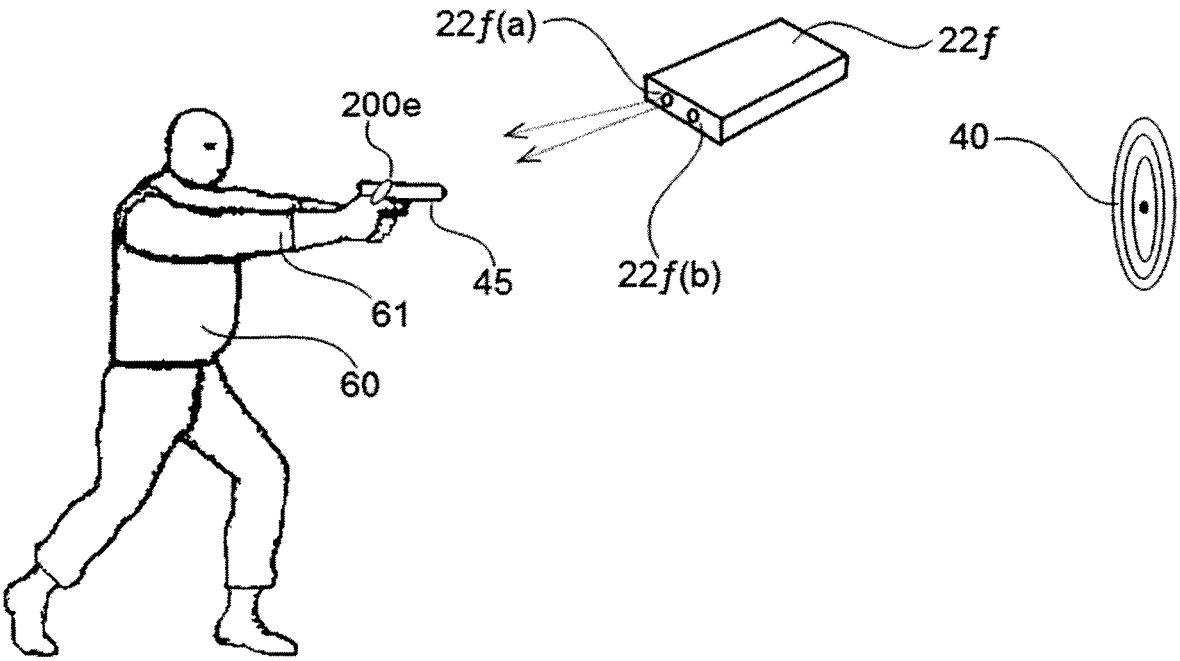
FIG 1.5f

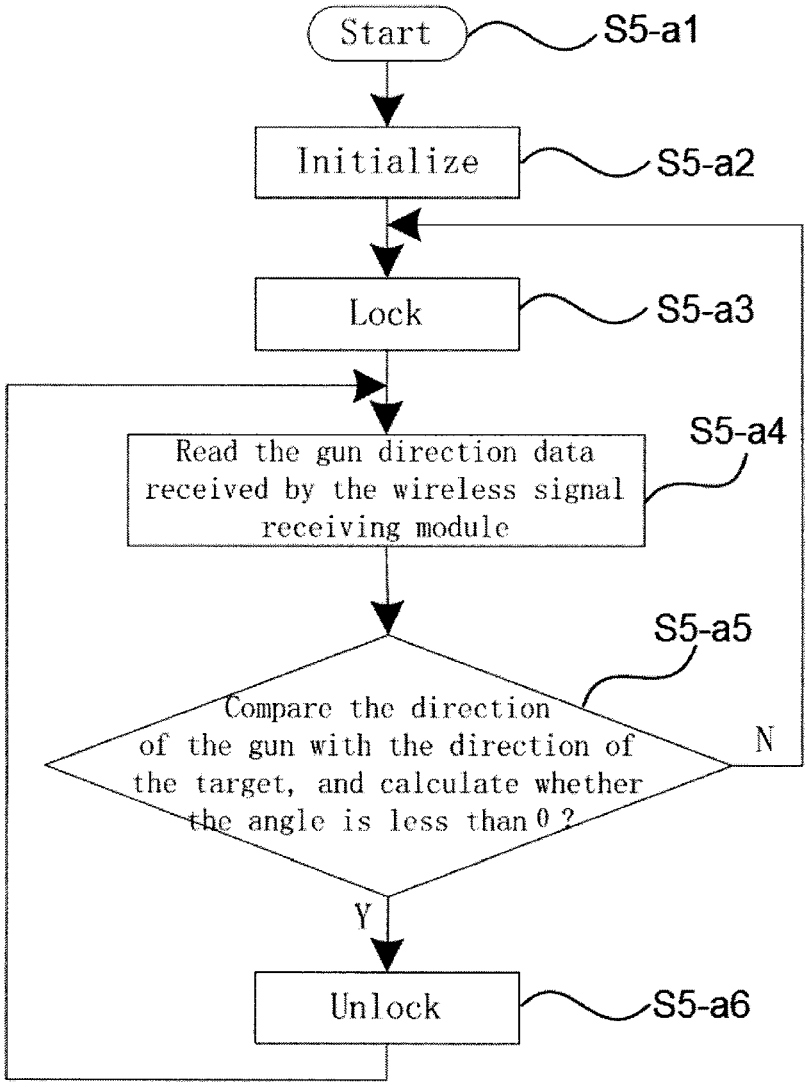
FIG 1.51
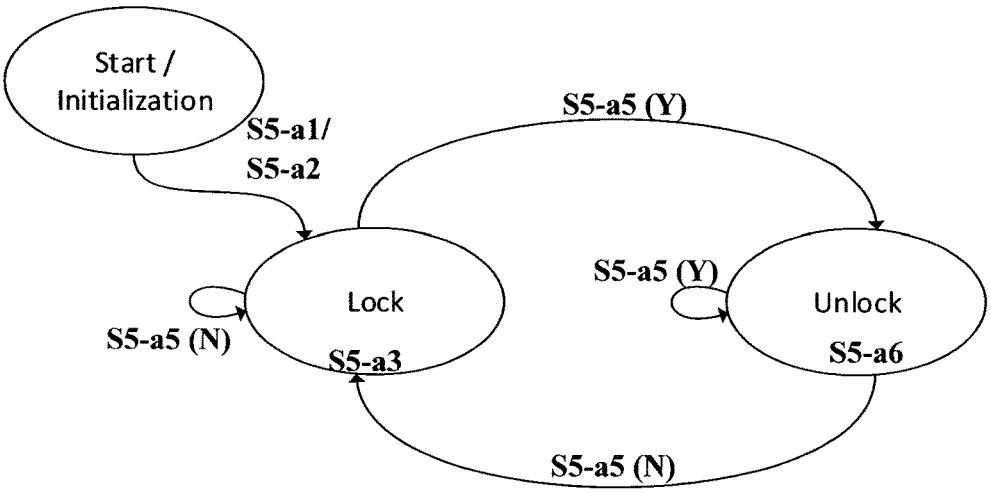
FIG 1.51a

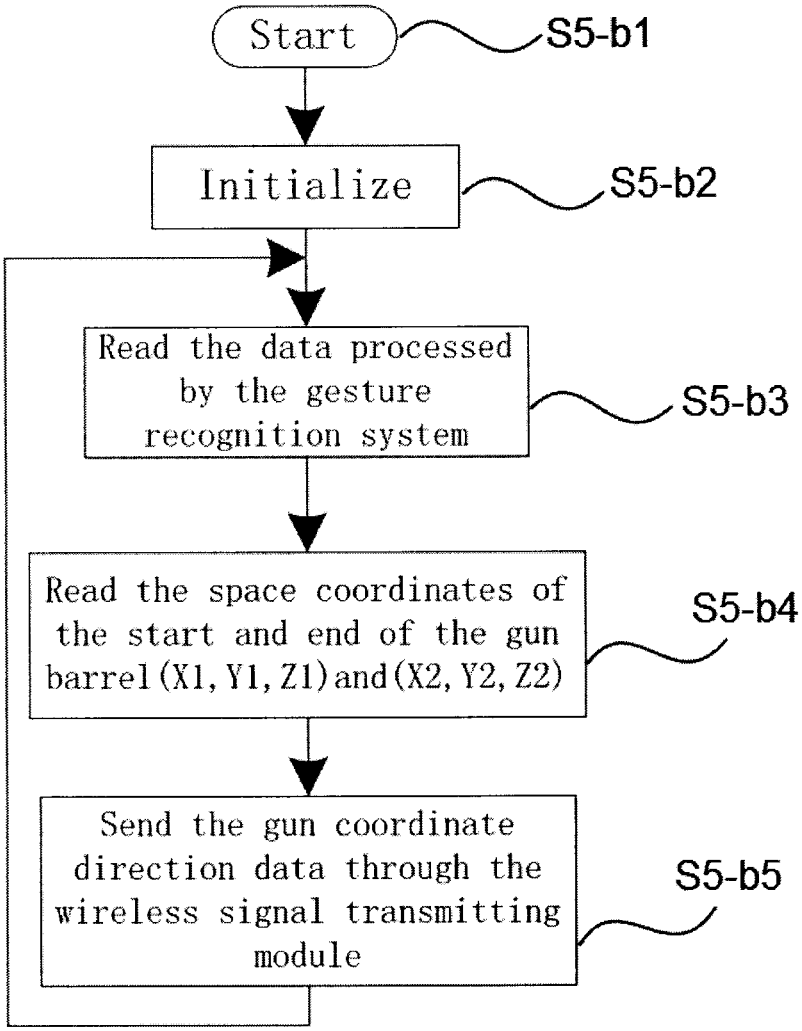
FIG 1.52

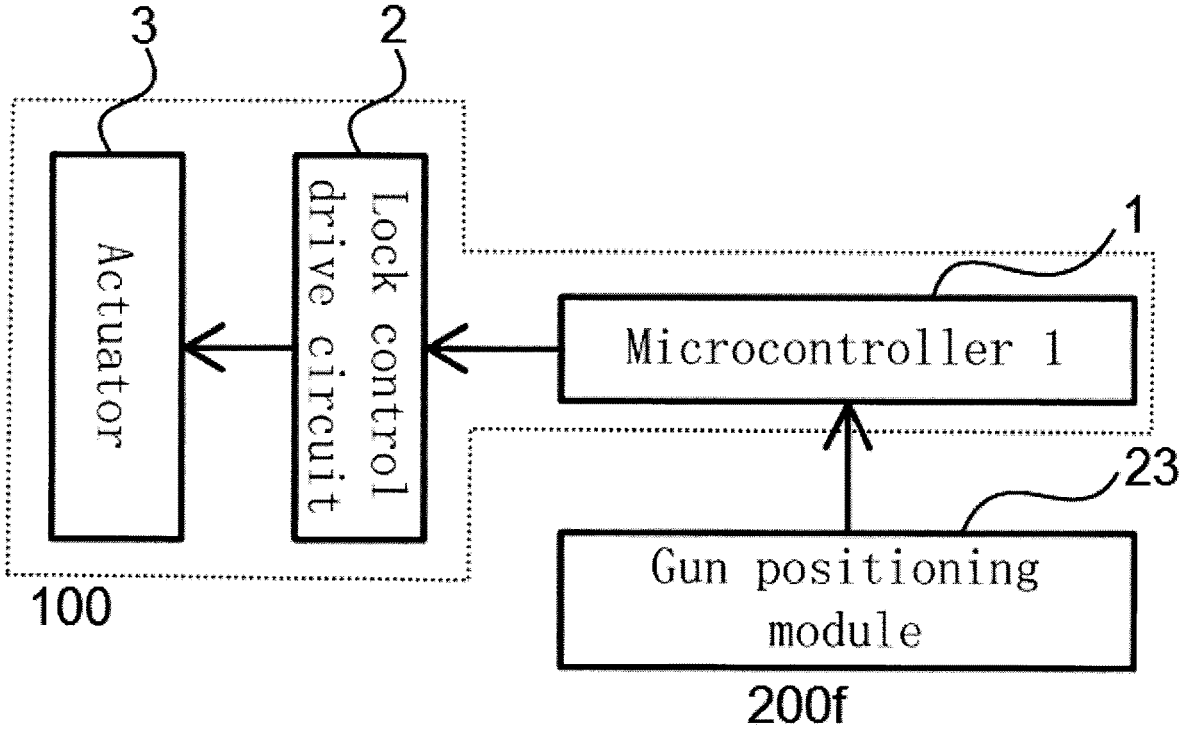
FIG 1.6

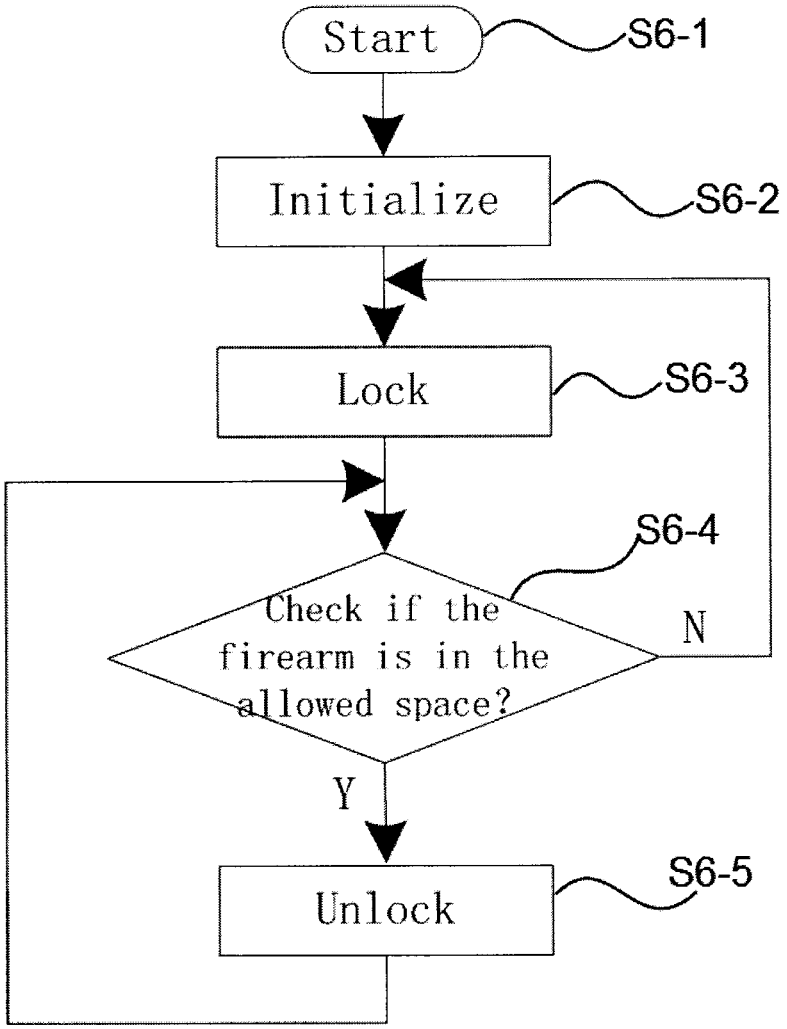
FIG 1.61
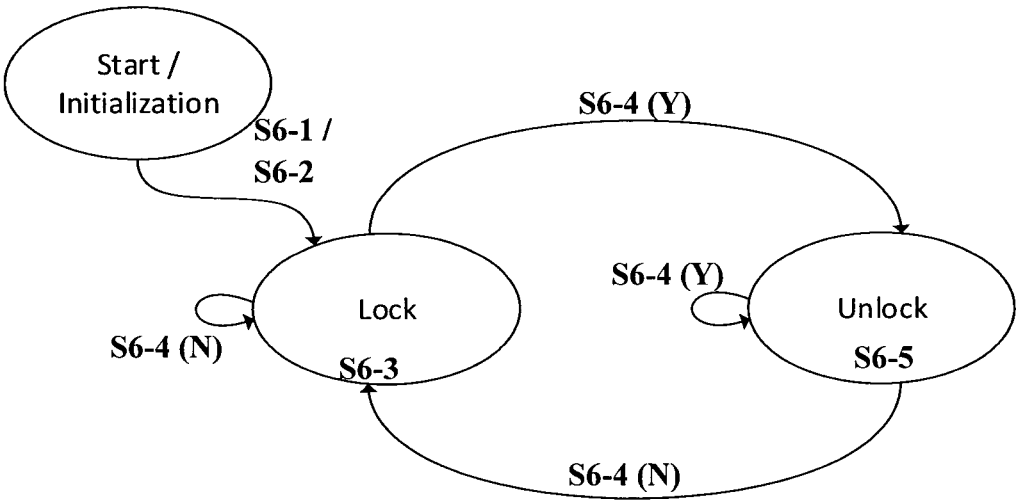
FIG 1.61a

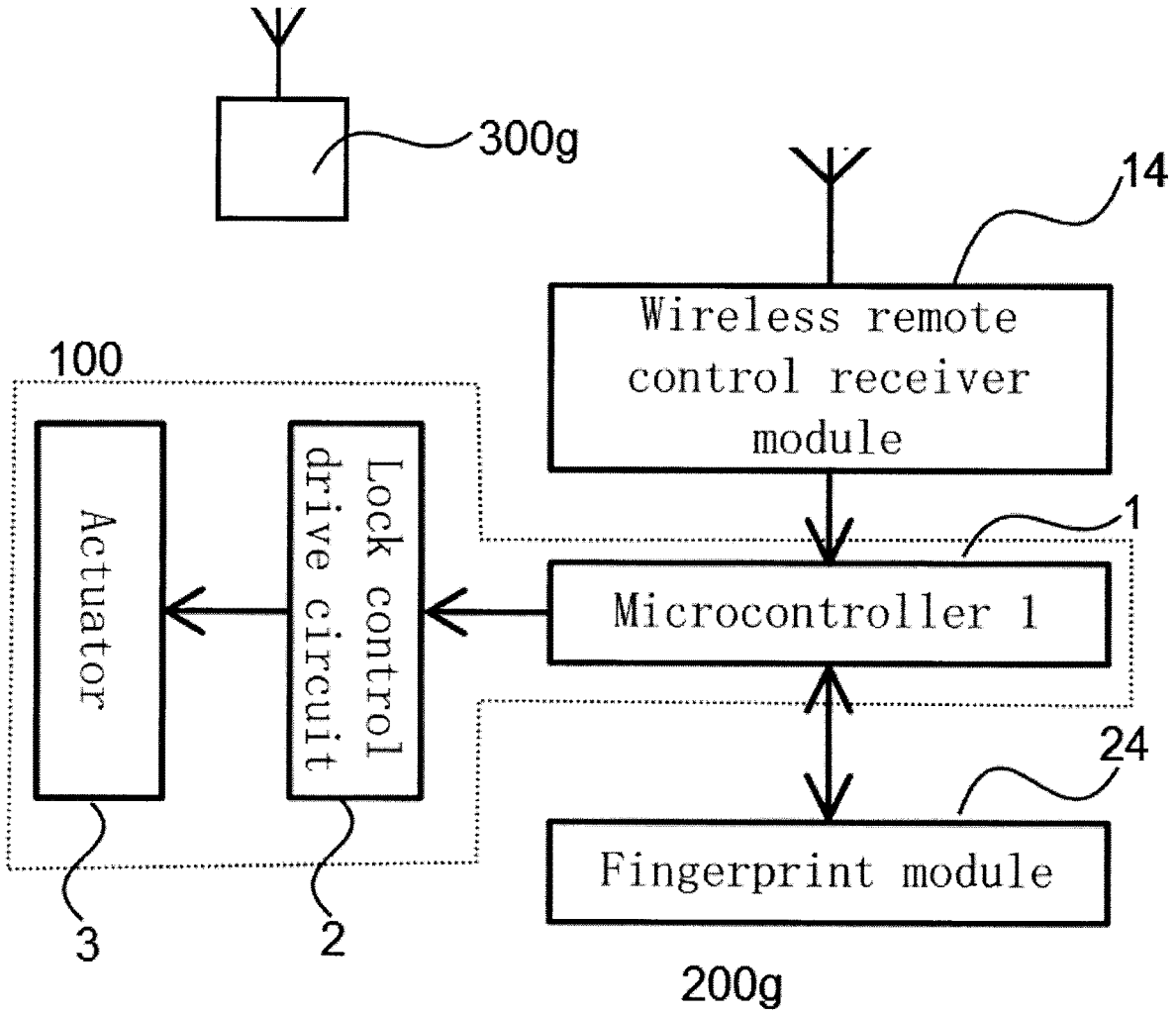
FIG 1.7

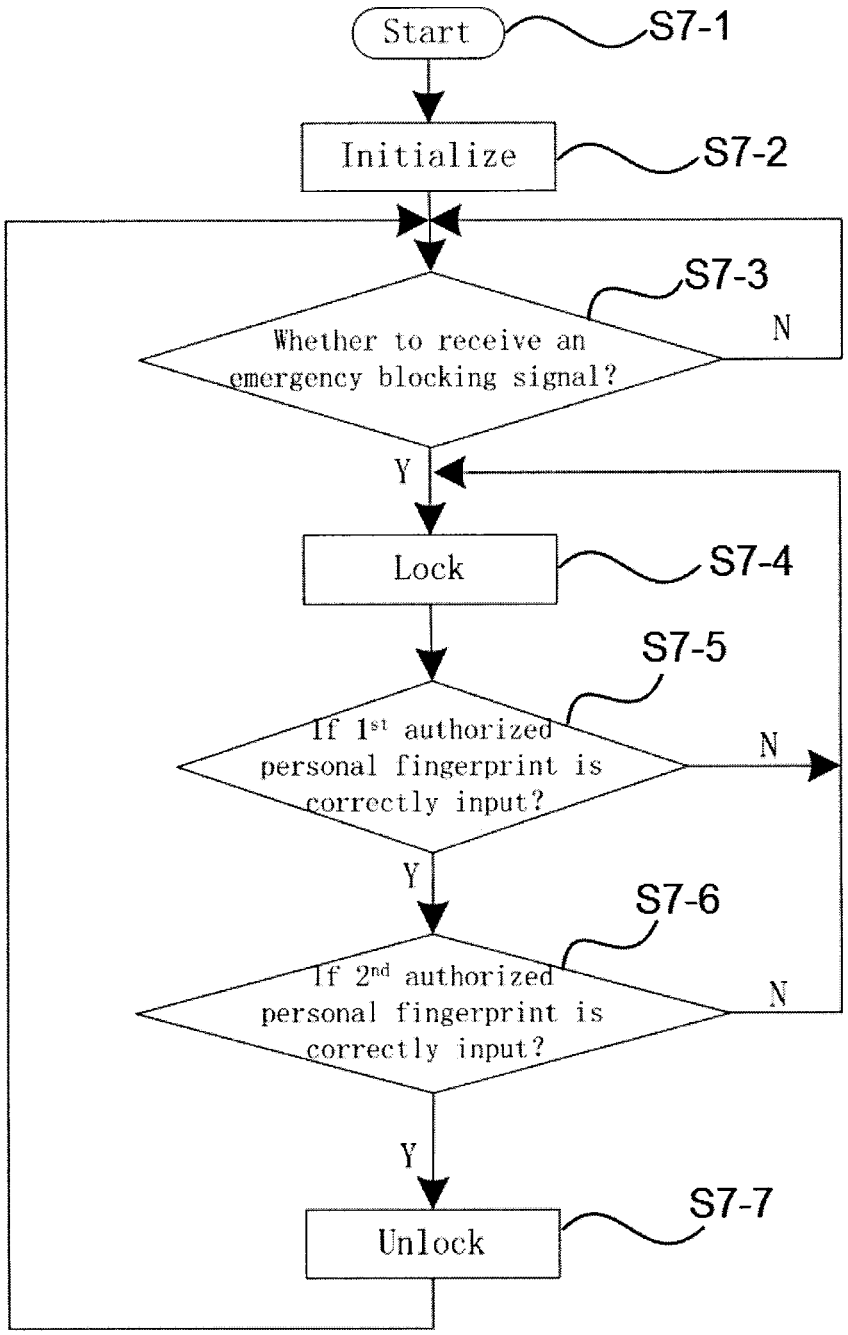
FIG 1.71

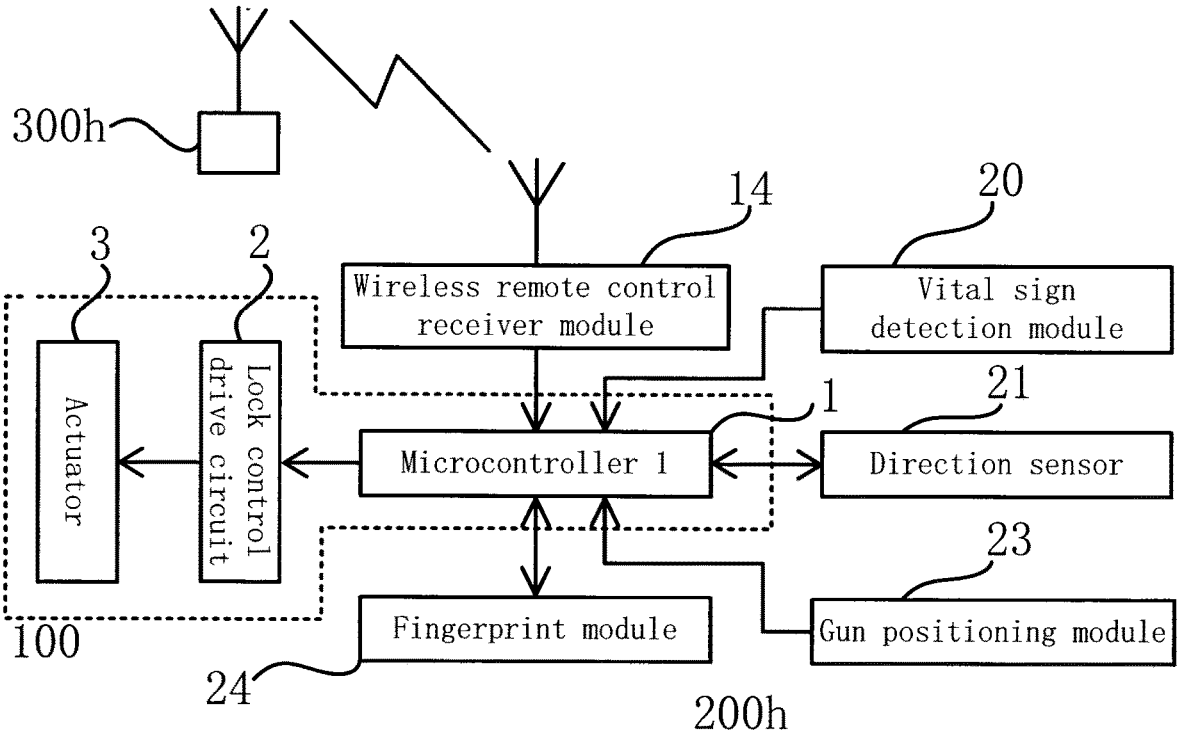
FIG 2.1

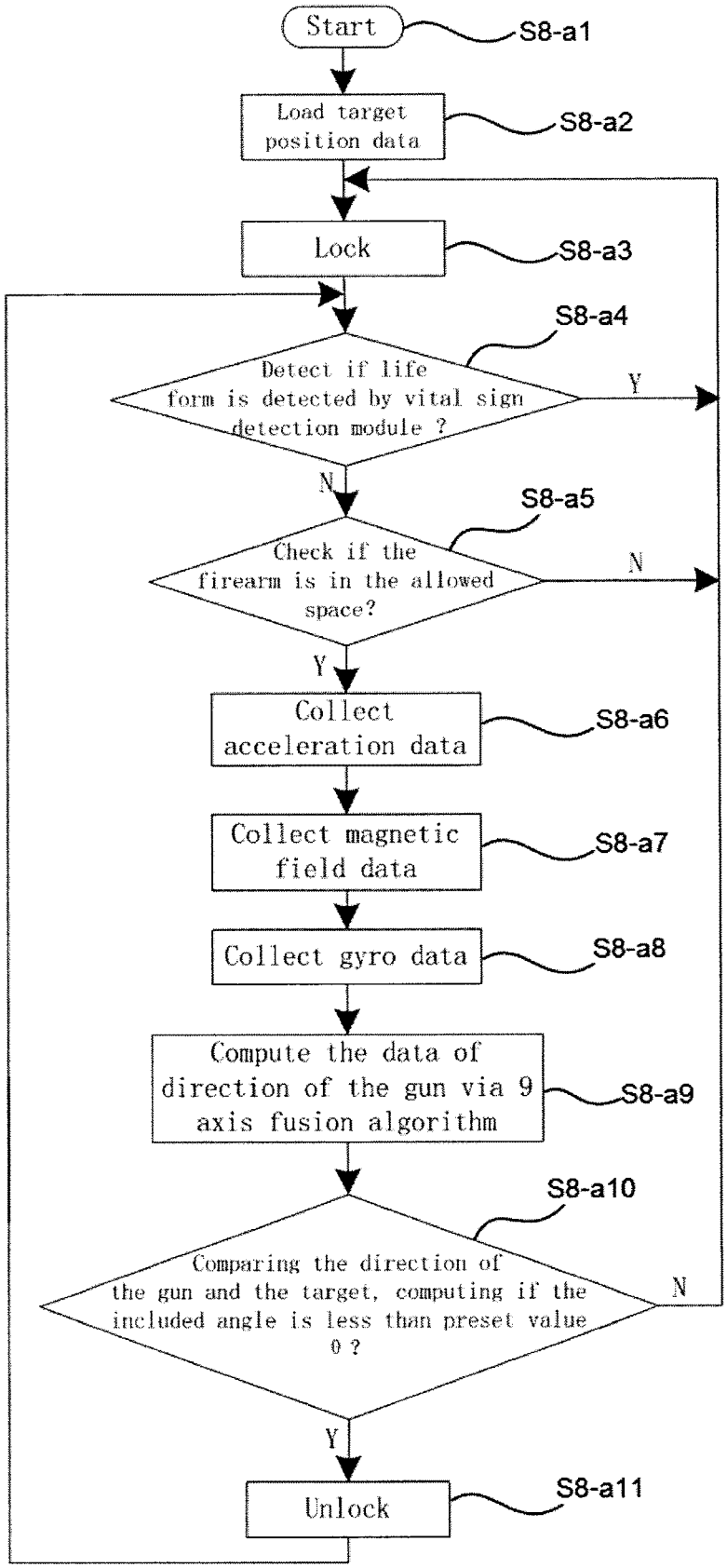
FIG 2.11

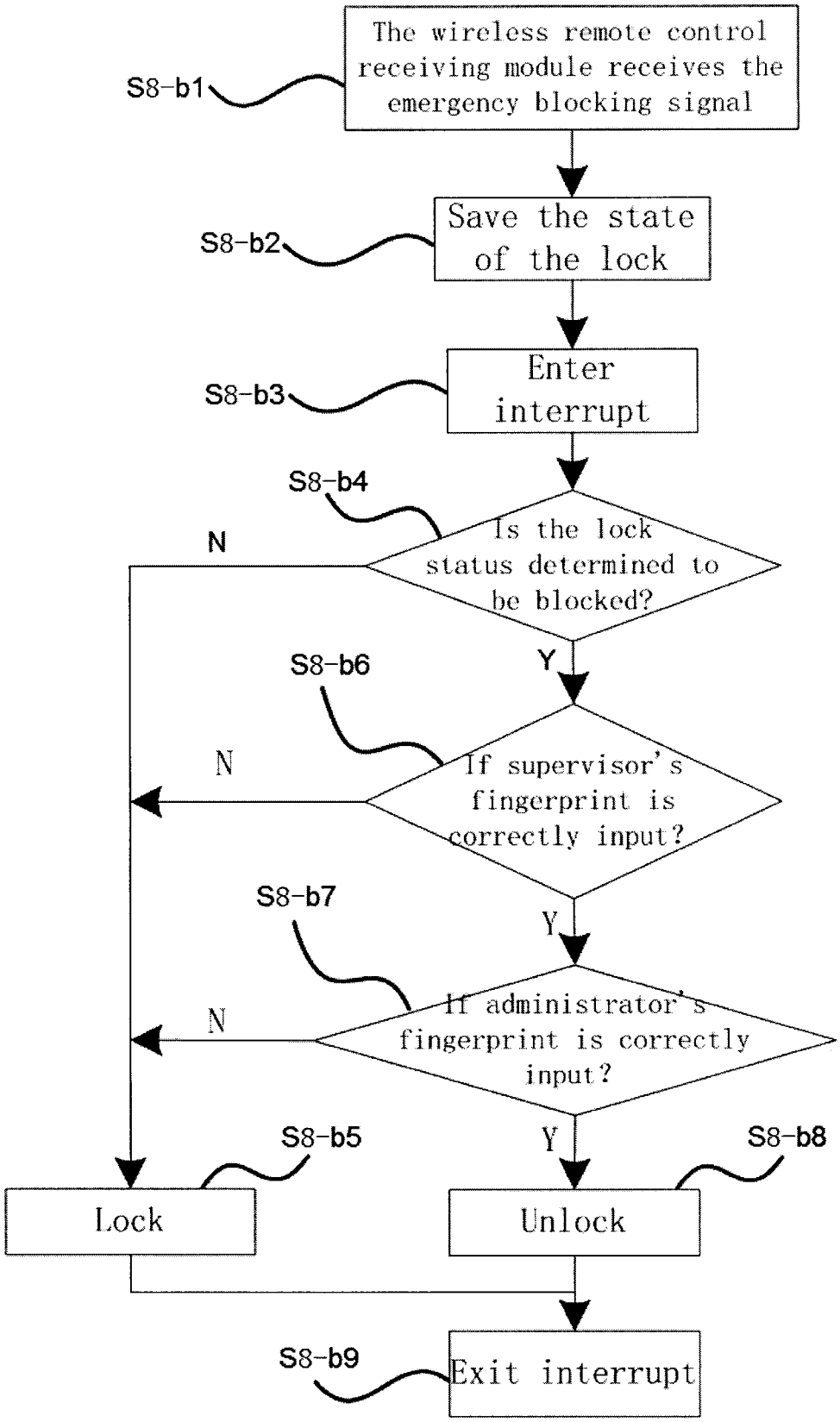
FIG 2.12

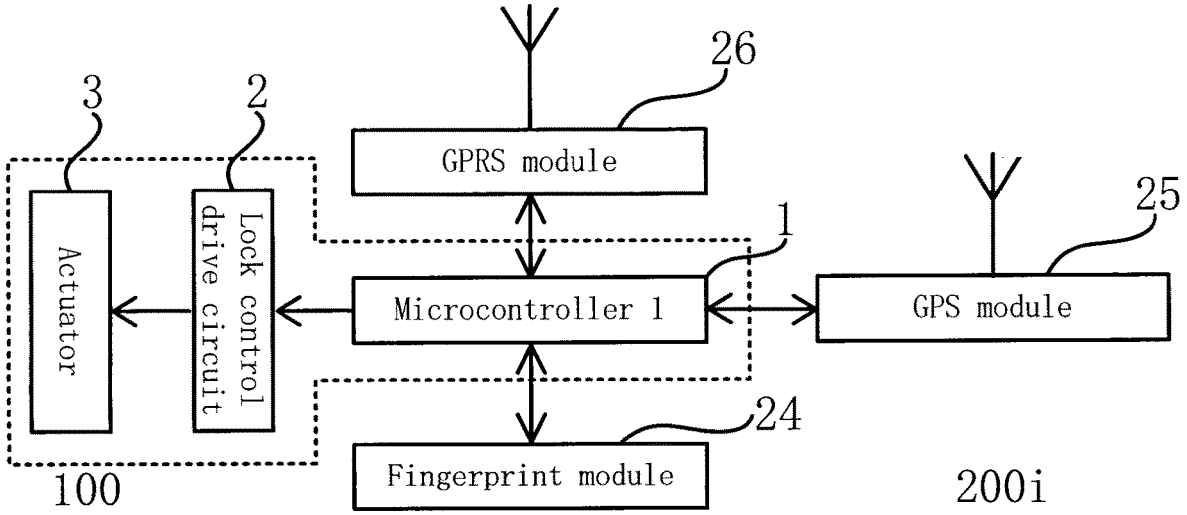
FIG 2.2

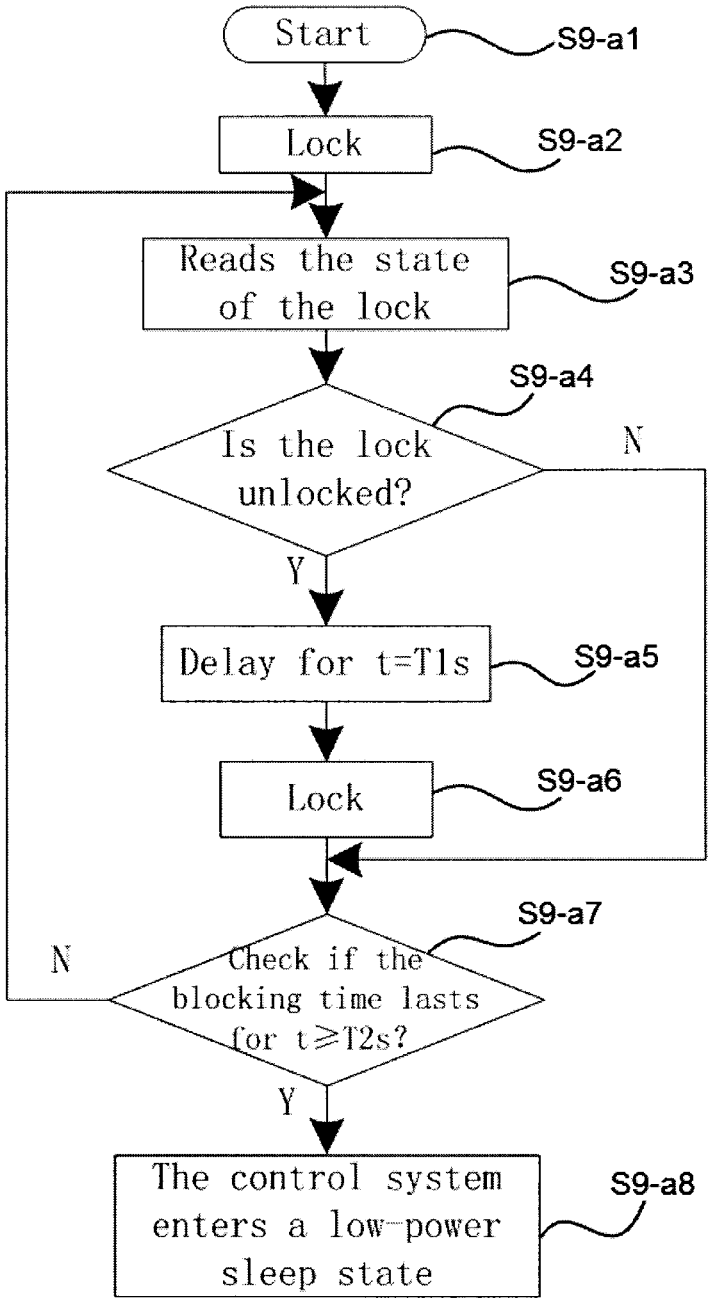
FIG 2.21

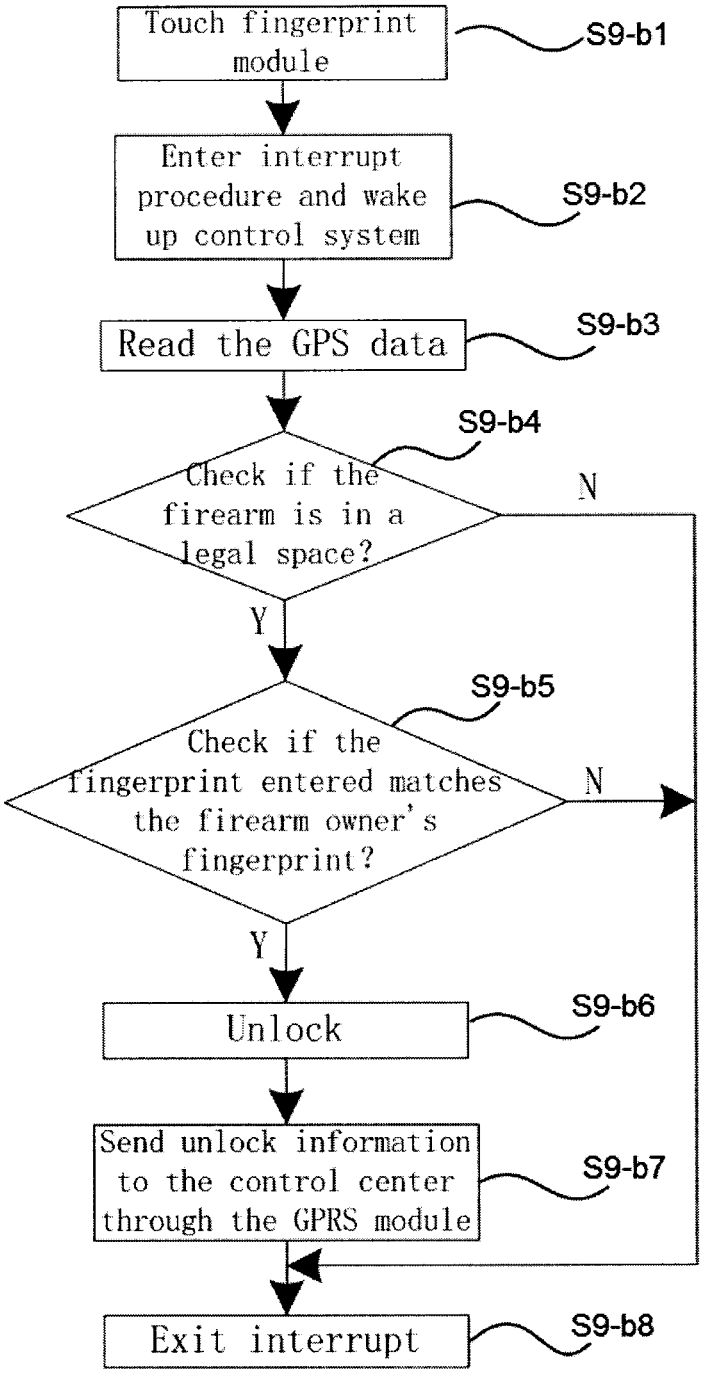
FIG 2.22

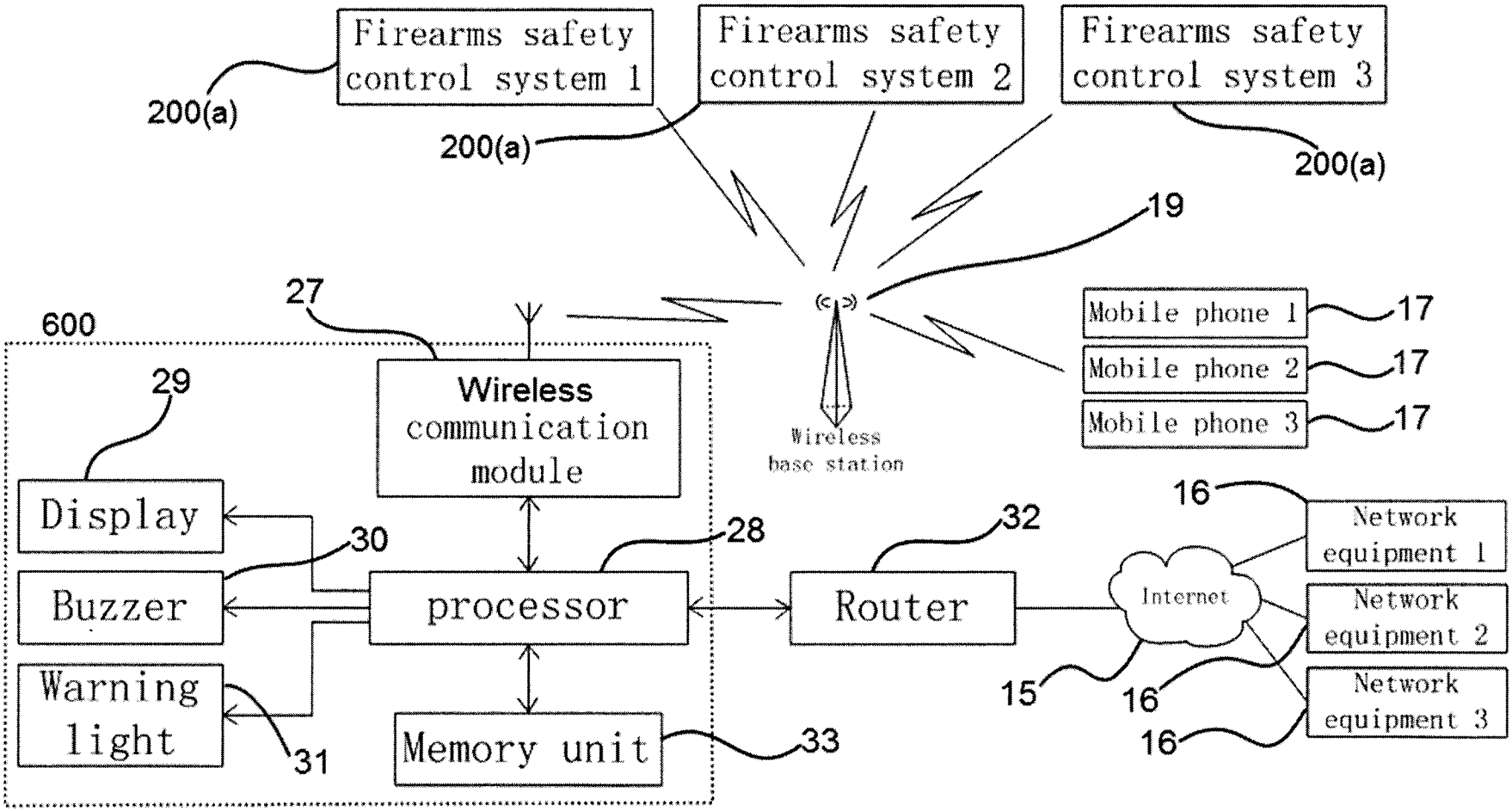
FIG 2.23

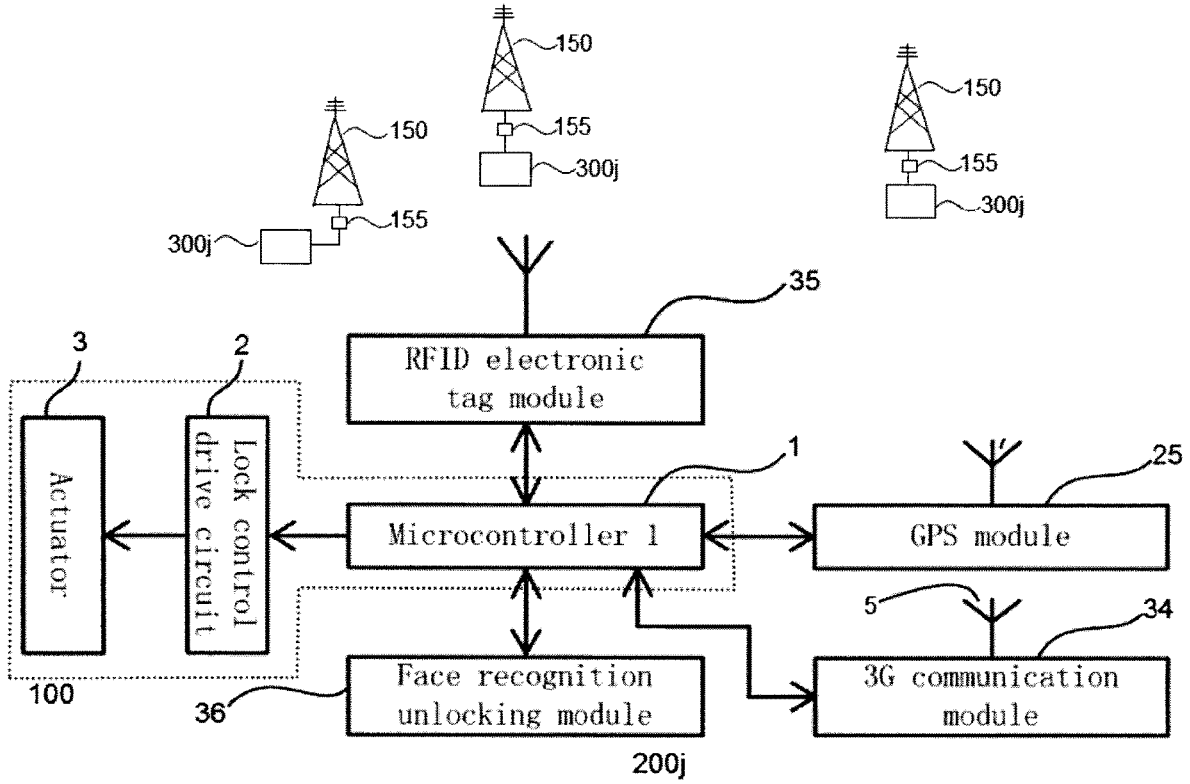
FIG 2.3
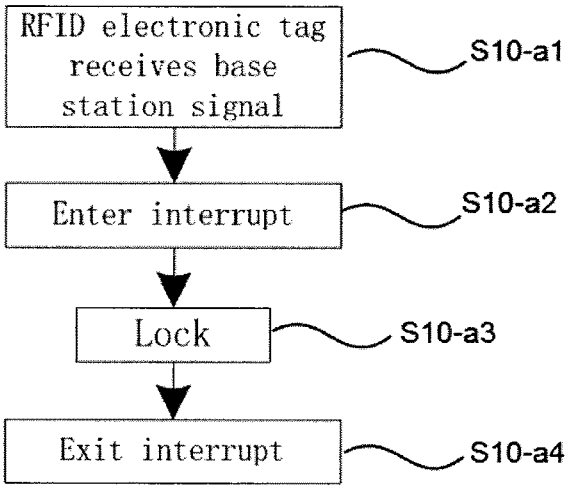
FIG 2.31

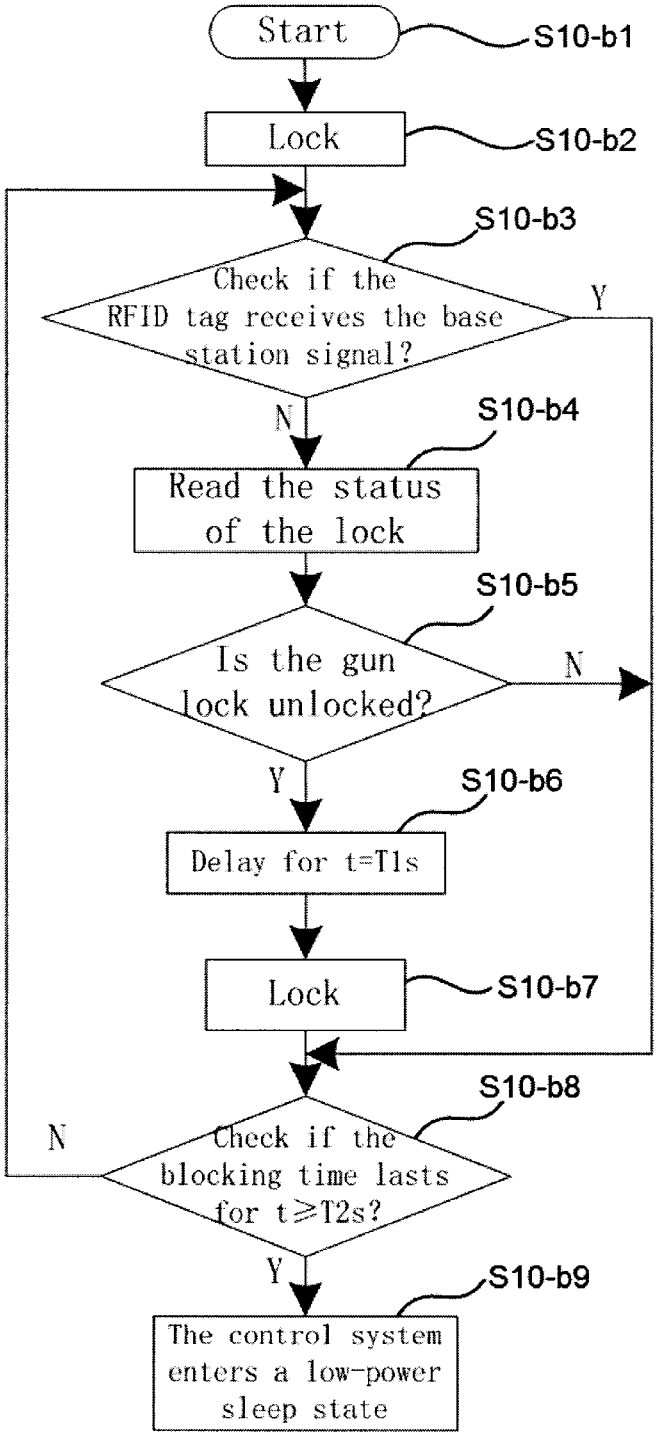
FIG 2.32

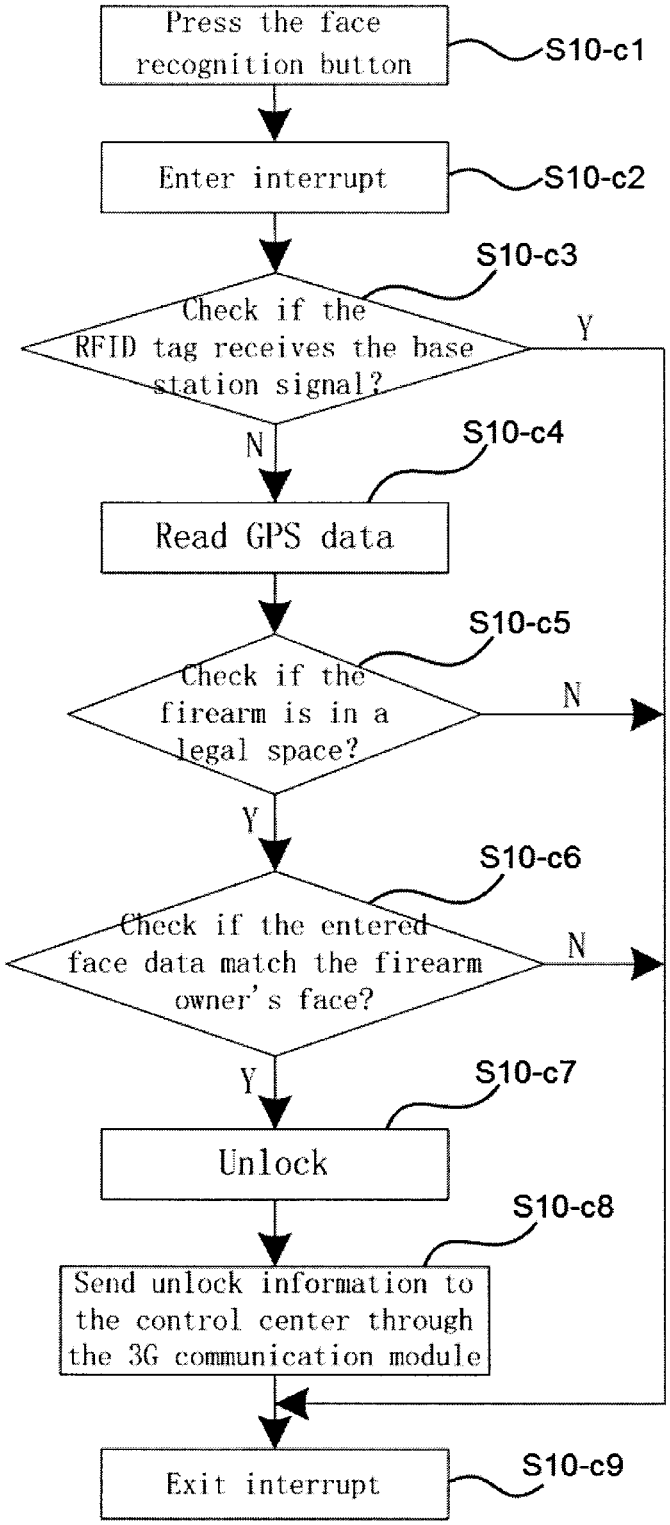
FIG 2.33

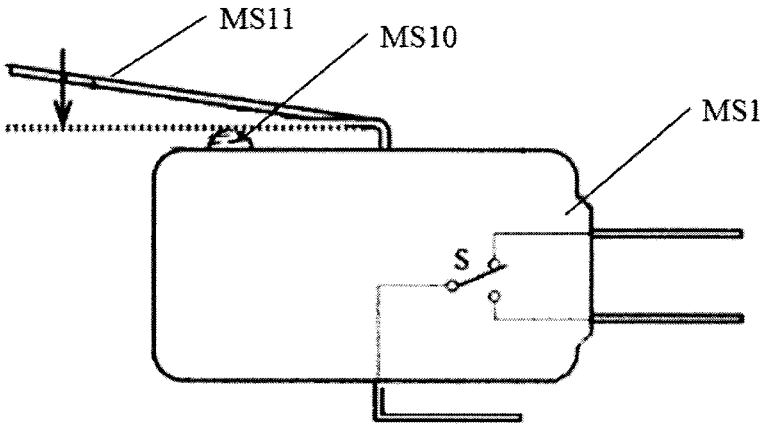
FIG 3.1
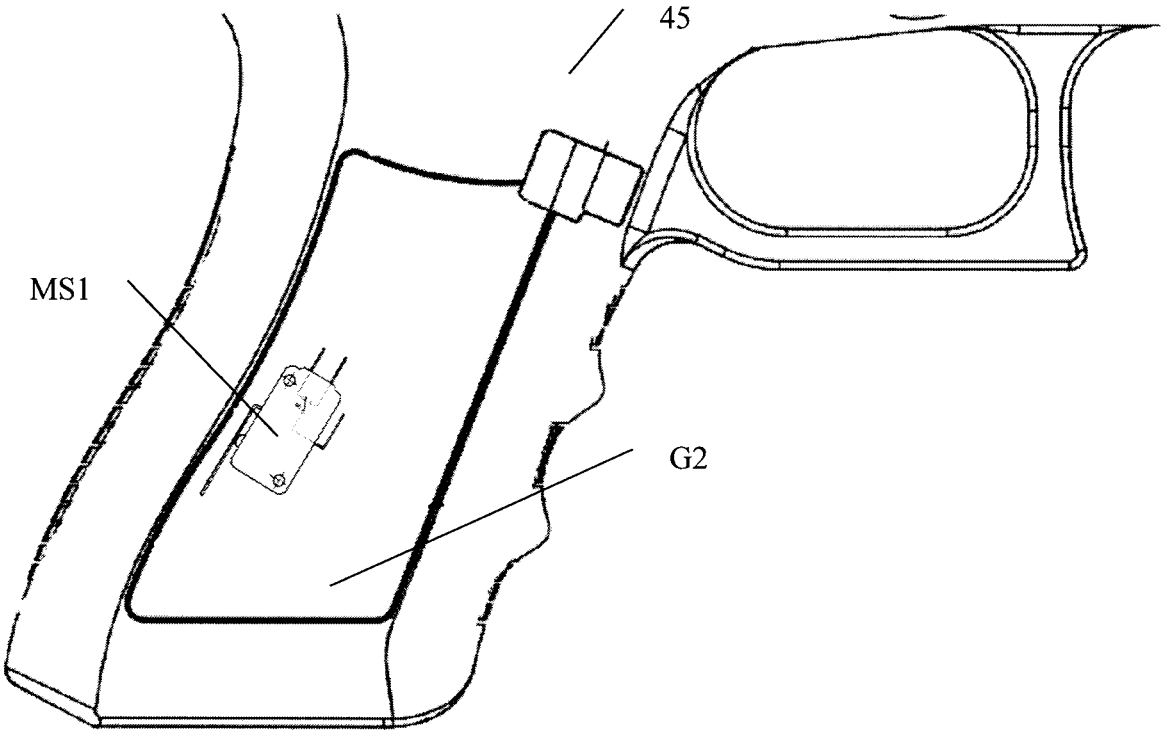
FIG 3.2

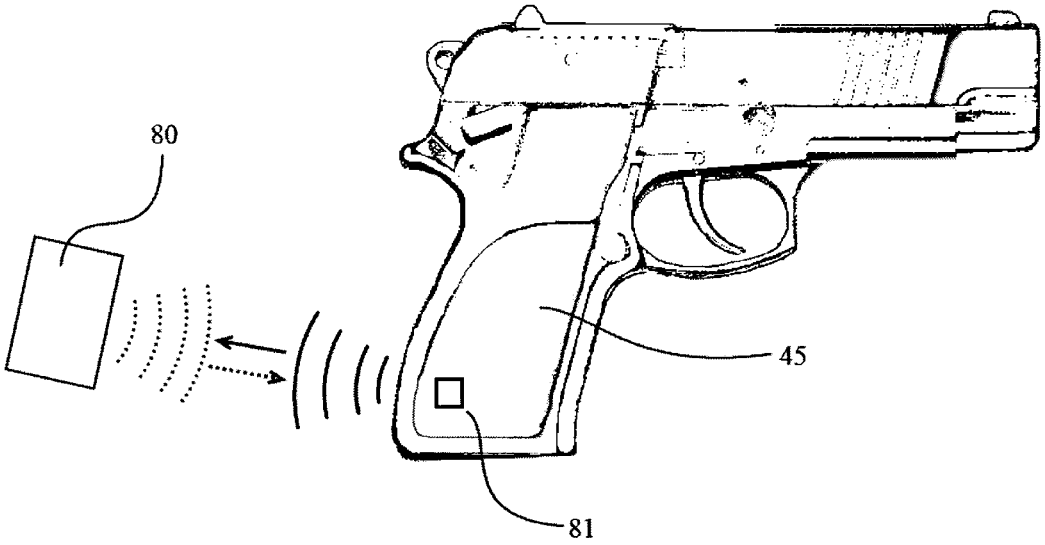
FIG 3.31
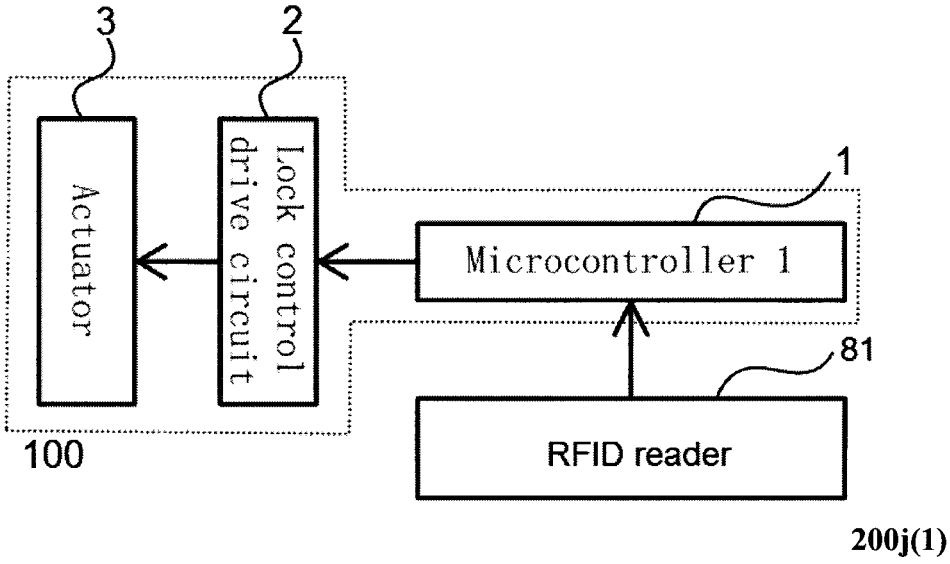
FIG 3.32

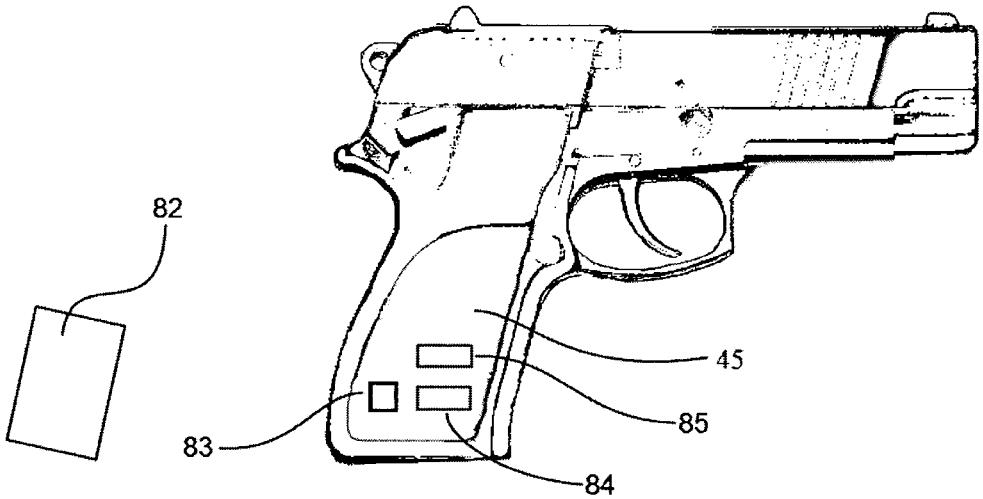
FIG 3.41
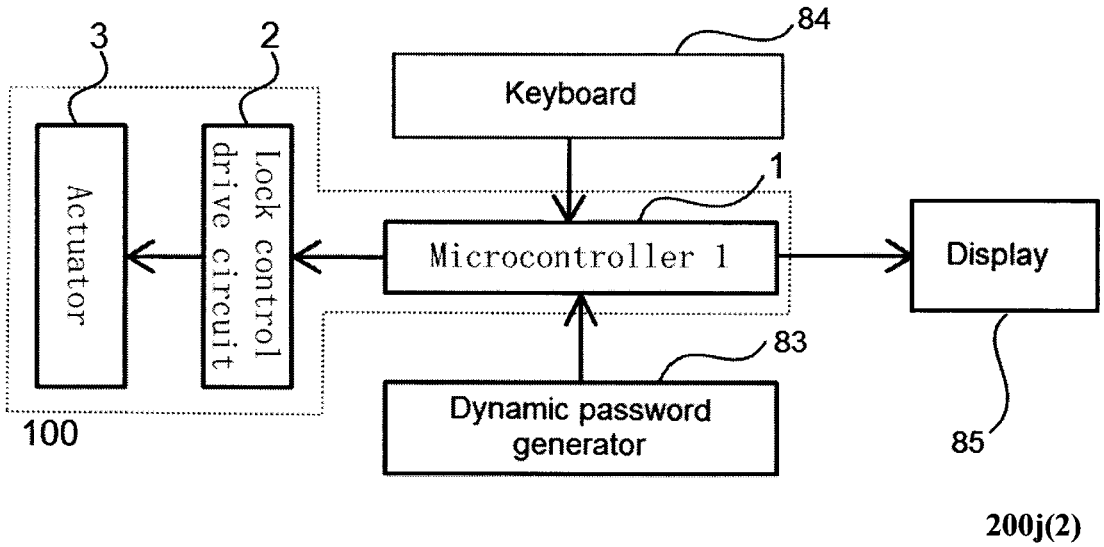
FIG 3.42

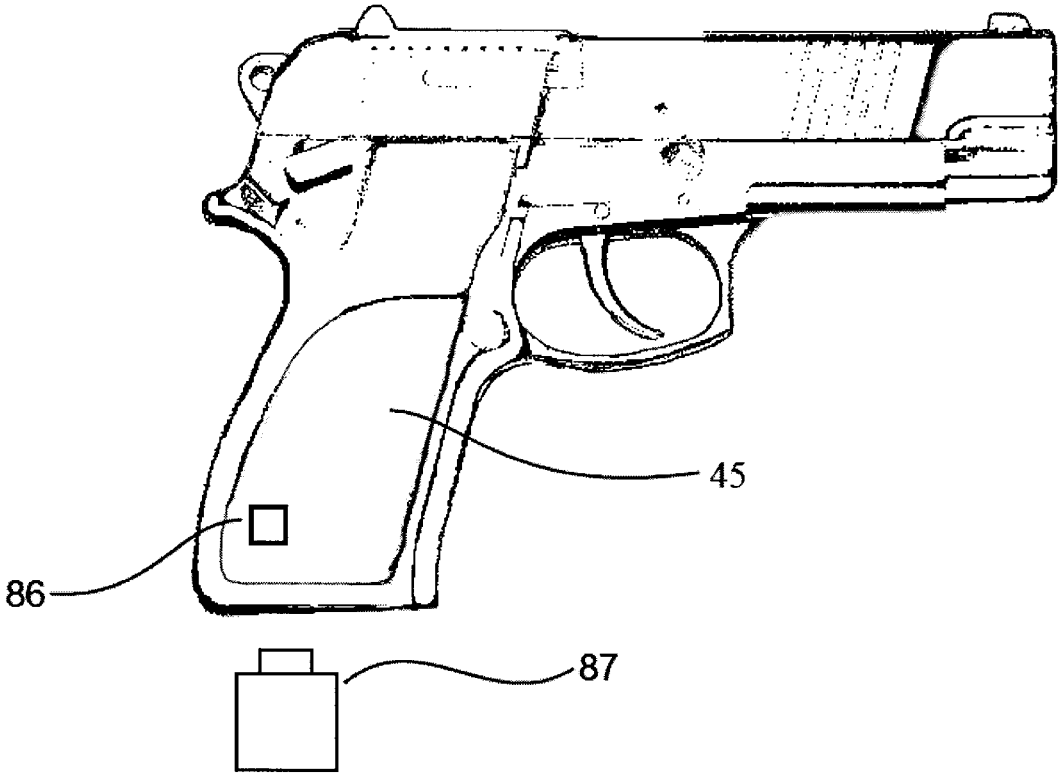
FIG 3.51
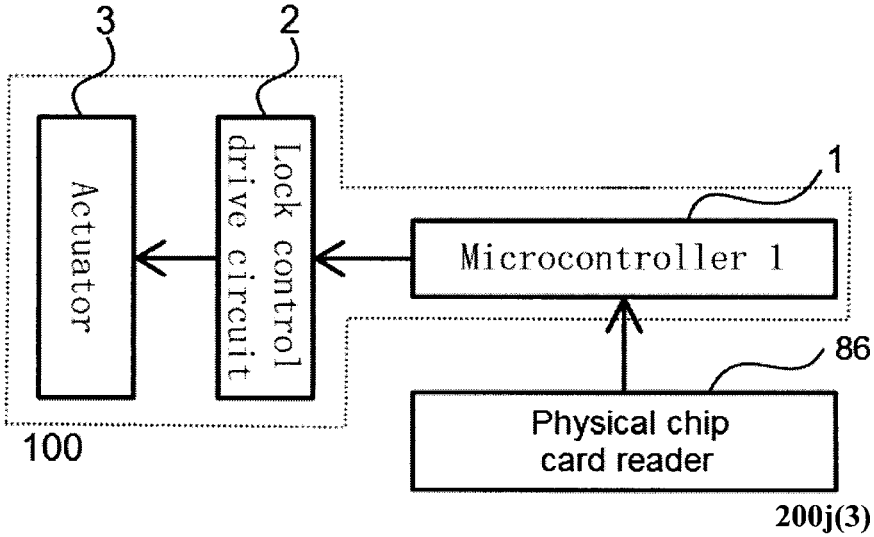
FIG 3.52

SAFETY CONTROL SYSTEM FOR PORTABLE WEAPONS, INCLUDING CROSSBOW AND FIREARMS, SUCH AS HANDGUNS, RIFLES AND ALIKE

CROSS-REFERENCE TO RELATED APPLICATIONS

N/A

STATEMENT REGARDING FEDERALLY SPONSORED RESEARCH OR DEVELOPMENT

N/A

NAMES OF THE PARTIES TO A JOINT RESEARCH AGREEMENT

N/A

REFERENCE TO A "SEQUENCE LISTING"

N/A

BACKGROUND OF THE INVENTION

Field of the Invention

The present invention directs to safety control system for portable weapons, including, but not limited to, crossbows and firearms, such as guns, rifles and alike, using various sensors to ensure safe target, environment, location, and situation for operating portable weapons.

Description of Related Art

Portable weapons, such as crossbows and firearms, for example, guns, rifles and alike, are often used for recreational and/or sporting purposes, self-defense where law allows, and/or carried by authorized personnel, such as police, military, etc. However, safety issues related thereto are always concerns for the public. Many of portable weapons used today shares substantially similar firing sequence from pulling of a trigger to a firing pin striking a bullet or alike to fire a bullet or alike therefrom. Many of these portable weapons are equipped with primary safety lock mechanisms; however, these primary safety lock mechanisms may be released manually by its operator(s) and, thus, there is no other means to ensure operational safety of the portable weapon after the primary safety lock mechanisms is released.

There have been a number of attempts that have been made to ensure operational safety of the portable weapon. For example, U.S. Pat. No. 4,488,370 to Lemelson (Lemelson) discloses a weapon control system and method to prevent it from being accidentally operated or operated by a person who is not the owner of the weapon or someone who is not authorized to use the weapon.

U.S. Pat. No. 6,550,175 to Parker (Parker) discloses a user friendly gunlock, which is attached to a trigger guard of a firearm, which releases the lock based on a number combination (or similar) is entered properly to the gunlock.

U.S. Pat. No. 6,563,940 to Recce (Recce) discloses unauthorized user prevention device and method, which prevents an unauthorized/unrecognizable operator from using a firearm based on a pressure signature profile/grip profile(s) of an authorized operator(s) for the firearm which are stored.

U.S. Pat. No. 9,857,133 to Kloepfer et al. (Kloepfer) and US Patent Application Publication No. 2018/0142977 to Kloepfer et al. (Kloepfer 2) disclose a system and method for authenticating an identity for a biometrically-enabled gun. The biometrically-enabled gun has a biometric sensor for reading the biometric information of an operator (such as finger print) to determine wither the operator is authorized to operate the firearm.

Many of prior attempts, as it can be seen in Lemelson, Parker, Recce, Kloepfer and Kloepfer 2, are merely concern whether the weapon/firearm is about to be operated/operated by an authorized operator.

Accordingly, in order to improve operational safety of the portable weapons, locking and unlocking conditions or environment including time, place, direction and operator/person would need to be considered; however, even such considerations were made, prior attempts would not allow/enable to provide means to lock and unlock the firing sequence, automatically or autonomously. Therefore, there has been a long-felt need(s) for a primary, complementary or secondary safety control system which is, either automatic or semi-automatic in nature, to lock or to lock and unlock a firing sequence of a portable weapon.

BRIEF SUMMARY OF THE INVENTION

Today, gun violence has become one of the biggest issues of public safety, and the question of how to solve this problem has become a public concern. In schools, churches, supermarkets, theatres, gymnasiums and other public locations, once a shooting happens among the crowd, the consequences can be horrific. Accordingly, there is a long felt need for a safety control system for the portable weapon, which unlocks a firing sequence of the portable weapon only when it is safe to operate.

Loaded portable weapons, such as loaded gun, loaded riffle, etc. is the most dangerous state as they are ready to shoot/operate. After the investigation carried out by the inventor, it appears that a normal person's response time is about 0.3 to 0.4 second to operate the loaded pistol; the professionally trained person may operate a loaded pistol over 0.1 s. In fact, the world sprint champion, Liu Xiang's fastest starting reaction time was measured at 0.131 s. Accordingly, if a portable weapon is controlled to be in a safe state (or locked) within these reaction time, safety of using loaded portable weapon may become manageable.

According to an object of the present invention, it provides a safety control system for portable weapons, including, but not limited to, crossbows and firearms, such as guns, rifles and alike, using various sensors to ensure safe target, environment, location, and situation for operating portable weapons. The safety control system unlocks a firing sequence of the portable weapons only when it is safe to operate.

According to one aspect of the present invention, it provides a safety control system for a portable weapon, comprising: a microcontroller; a driver; and an actuator; wherein the microcontroller controls the driver to drive the actuator to lock or unlock a firing sequence of the portable weapon.

The safety control system as recited above further comprises a vital sign detection sensor being in communication with the microcontroller, causing the microcontroller to control the driver based on detection of a vital sign from a human. The safety control system as recited above, wherein the vital sign detection sensor comprises: a pyroelectric infrared sensor; a lens; and a cylindrical housing member for housing the pyroelectric infrared sensor at one end, and the lens disposed at a focal distance of the lens away from the pyroelectric infrared sensor. The safety control system as recited above, wherein the lens is a Fresnel lens. The Fresnel lens has a first side with smooth surface and a second side with patterns, the second side faces with the pyroelectric infrared sensor. The safety control system as recited above further comprising an infrared anti-reflection film on the first side of the Fresnel lens. The infrared anti-reflection film reduces reflection and refraction loss of infrared rays having wavelength ranges from 8 to 12 μm.

The safety control system as recited above further comprising a direction detection sensor for detecting a direction of the portable weapon to cause the microcontroller to control the driver by comparing the direction of a target and the direction of the portable weapon. The direction detection sensor comprises a nine-axis motion sensor. The nine-axis motion sensor comprise an acceleration sensor, a gyro sensor and a magnetic field sensor.

The safety control system as recited above further comprising a biometric recognition module for sampling a biometric data for carrying out an authentication by the microcontroller to control the driver for unlocking the firing sequence. The biometric recognition module is a fingerprint recognition module.

The actuator locks the firing sequence at a trigger, a trigger lever, a firing pin, a hammer of the portable weapon, safety or safety catch, or a combination thereof.

According to another aspect of the present invention, it provides a safety control system for a portable weapon, comprising: a portable weapon safety controller, comprising: a first microcontroller; a driver; and an actuator; and a field controller comprising a second microcontroller, the second microcontroller is wirelessly in communication with the first microcontroller. The second controller causes the first microcontroller to control the driver to drive the actuator to lock or unlock a firing sequence of the portable weapon. The portable weapon safety controller comprising a signal transmitting module being in communication with the first microcontroller for transmitting a signal indicative of a direction of the portable weapon is pointing to, and the field controller comprises a signal receiving module, being in communication with the second microcontroller, being indicative of a direction of a target that receives the signal only when the signal transmitting module is facing to the signal transmitting module within a predetermined angle range. The signal may be an infrared ray, ultrasonic signal, millimeter wave radar signal, etc. The signal receiving module is disposed near the target. The field controller may further, optionally, comprise a gesture recognition system situated at a location where the gesture recognition system would be able to monitor/view the operator/shooter operating the portable weapon. The gesture recognition system is selected from the group consisting of a binocular camera gesture recognition system, a myoelectric sensor gesture recognition system, a structural optical gesture recognition system, a time of flight gesture recognition system, an ultrasonic gesture recognition system, a millimeter radio wave radar gesture recognition system, and an artificial intelligence image gesture recognition system.

According to another aspect of the present invention, it provides a safety control system for a portable weapon comprising: a portable weapon safety controller, comprising: a first microcontroller, a driver, and an actuator; and a field controller comprising: a second microcontroller, the second microcontroller is wirelessly in communication with the first controller. The field controller comprises a gesture recognition system being situated at a location where the gesture recognition system would be able to monitor/view the operator/shooter operating the portable weapon. The gesture recognition system is selected from the group consisting of a binocular camera gesture recognition system, a myoelectric sensor gesture recognition system, a structural optical gesture recognition system, a time of flight gesture recognition system, an ultrasonic gesture recognition system, a millimeter radio wave radar gesture recognition system, and an artificial intelligence image gesture recognition system.

According to yet another aspect of the present invention, it provides a safety control system for a portable weapon, comprising: a portable weapon safety controller, comprising: a microcontroller; a driver; and an actuator; and a server. The microcontroller is in communication with the server, the server causes the microcontroller to control the driver to drive the actuator to lock or unlock a firing sequence of the portable weapon. The portable weapon safety controller further comprises a global positioning system (GPS) module for determining a location of the portable weapon; however, not limited to GPS module for determining the location of the portable weapon. Such positioning system may include, but not limited to, BeiDou (BeiDou Navigation Satellite System (BDS)), Galileo (or global navigation satellite system (GNSS)), or other positioning system.

BRIEF DESCRIPTION OF THE SEVERAL VIEWS OF THE DRAWING

The present invention directs to a safety control system for portable weapons, including, but not limited to, crossbows and firearms, such as guns, rifles and alike.

FIG. 1.1 is a functional block diagram of a first preferred embodiment of a portable weapon safety control system;

FIG. 1.11 is a process flow diagram of the first preferred embodiment of the portable weapon safety control system;

FIG. 1.11*a* is a state diagram, which is equivalent to the flow diagram shown in FIG. 1.11;

FIG. 1.12 is a side cross-sectional view of a vital sign detection module;

FIG. 1.13 is a front plan view of the Fresnel lens;

FIG. 1.14 is a functional block diagram of a signal amplification circuit for the pyroelectric infrared sensor;

FIGS. 1.15*a*, 1.15*b* and 1.15*c* are diagrams showing exemplary patterns of detection zones for the pyroelectric infrared sensor;

FIG. 1.2 is a functional block diagram of a second preferred embodiment of a portable weapon safety control system;

FIG. 1.21 is a process flow diagram of the second preferred embodiment of the portable weapon safety control system;

FIG. 1.21*a* is a state diagram, which is equivalent to the flow diagram shown in FIG. 1.21;

FIG. 1.3 is a functional block diagram of a third preferred embodiment of a portable weapon safety control system;

FIG. 1.3*a* shows a side cross-sectional view of a cylindrical signal transmitting module;

FIG. 1.3*b* shows a side cross-sectional view of a conical signal transmitting module;

FIG. 1.31*a* shows a process flow diagram of the third preferred embodiment of the portable weapon safety control system;

FIG. 1.31*b* shows a process flow diagram of the field controller, in cooperation with the safety control system;

FIG. 1.32*a* is a state diagram, which is equivalent to the flow diagram shown in FIG. 1.31*a;*

FIG. 1.32*b* is a state diagram, which is equivalent to the flow diagram shown in FIG. 1.31*b;*

FIG. 1.4 shows a functional block diagram of a fourth preferred embodiment of a portable weapon safety control system;

FIG. 1.41 shows a process flow diagram of the fourth preferred embodiment of the portable weapon safety control system;

FIG. 1.41*a* is a state diagram, which is equivalent to the flow diagram shown in FIG. 1.41;

FIG. 1.5 shows a functional block diagram of a fifth preferred embodiment of a portable weapon safety control system and a field controller;

FIG. 1.5*a* shows a diagram of a first variation of the portable weapon safety control system and the field controller;

FIG. 1.5*b* shows a diagram of a second variation of the portable weapon safety control system and the field controller;

FIG. 1.5*c* shows a block diagram of myoelectric sensors and motion sensors;

FIG. 1.5*d* shows a diagram of a third variation of the portable weapon safety control system and the field controller;

FIG. 1.5*e* shows a diagram of a fourth variation of the portable weapon safety control system and the field controller;

FIG. 1.5*f* shows a diagram of a fifth variation of the portable weapon safety control system and the field controller;

FIG. 1.51 shows an exemplary process flow diagram for the microcontroller of the safety control system;

FIG. 1.51*a* is a state diagram, which is equivalent to the flow diagram shown in FIG. 1.51;

FIG. 1.52 shows an exemplary process flow diagram for the microcontroller of the field controller;

FIG. 1.6 shows a functional block diagram of a sixth preferred embodiment of a portable weapon safety control system;

FIG. 1.61 is an exemplary process flow diagram of the microcontroller of the safety control system;

FIG. 1.61*a* is a state diagram, which is equivalent to the flow diagram shown in FIG. 1.61;

FIG. 1.7 shows a functional block diagram of a seventh preferred embodiment of a portable weapon safety control system;

FIG. 1.71 shows an exemplary process flow diagram of the safety control system;

FIG. 2.1 shows a functional block diagram of a first integrated safety control system;

FIG. 2.11 shows an exemplary process flow diagram of the microcontroller of the safety control system;

FIG. 2.12 shows another exemplary process flow diagram of the microcontroller of the safety control system;

FIG. 2.2 shows a functional block diagram of a second integrated safety control system;

FIG. 2.21 shows an exemplary process flow diagram of the microcontroller of the safety control system;

FIG. 2.22 shows another exemplary process flow diagram of the microcontroller;

FIG. 2.23 shows a functional block diagram of a safety control system with a server configuration;

FIG. 2.3 shows a functional block diagram of a third integrated safety control system;

FIG. 2.31 shows an exemplary process flow diagram of interrupt that triggered by the RFID electronic tag module;

FIG. 2.32 shows an exemplary process flow diagram of the safety control system;

FIG. 2.33 shows an exemplary process flow diagram of the safety control system when interrupt was triggered by the face recognition unlocking module;

FIG. 3.1 is an exemplary top view of a detection device for detecting disassembly and deliberate destruction;

FIG. 3.2 is an exemplary side view of the detection device installed on a portable weapon;

FIG. 3.31 is an exemplary diagram of an alternative to the seventh preferred embodiment of the present invention;

FIG. 3.32 is an exemplary block diagram thereof;

FIG. 3.41 is an exemplary diagram of another alternative to the seventh preferred embodiment of the present invention;

FIG. 3.42 is an exemplary block diagram thereof;

FIG. 3.51 is an exemplary diagram of yet another alternative to the seventh preferred embodiment of the present invention; and FIG. 3.52 is an exemplary block diagram thereof.

DETAILED DESCRIPTION OF THE INVENTION

Referring to FIG. 1.1, according to a preferred embodiment of the present invention, it provides a portable weapon safety control system 200*a* that promotes a safety for an operator/user of a portable weapon, including, but not limited to crossbows and firearms, such as handguns, rifles, and alike, and promotes safety for its surroundings. The safety control system would prevent, for example, suicide and close-proximity shootings, and would limit the use of the portable weapon only within a legal and safer manner (based on designated/specific time, designated/specific place, designated/specific person, designated/specific direction, etc.). The safety control system 200*a*, that may be installed on the portable weapon, comprises a control system 100, including a microcontroller 1, a lock control drive circuit 2, and an actuator 3 for actuating a lock mechanism (not shown, where the lock mechanism is automatic or can be actuated by the actuator for both locking and unlocking) for blocking/unblocking a firing sequence of the portable weapon, or for actuating the lock mechanism (not shown) to block and permit the lock mechanism (not shown, where the lock mechanism is semi-automatic or can be actuated by the actuator for locking only, and the actuator actuate the lock mechanism to permit unlocking manually) to unlock the firing sequence of the portable weapon (i.e. manually). The microcontroller 1 may comprise a microprocessor along with memory (memories), such as RAM, ROM or other types of memory, and other peripherals. The control system 100 may be operated on a battery P5, which includes a converter P4 for converting an output voltage $V_{BAT}$ from the battery P5 to a power supply voltage $V_{DD}$ for the control system 100. A battery charger P6 (wireless or wired charger) may be used for charging the battery P5. The safety control system 200*a* may be connected with one or more sensory devices, such as a vital sign detection module 20 for detecting a vital sign at a direction to which the portable weapon is pointing, The actuator 3 may be a solenoid, a servo motor, a DC motor or alike to carry out the process of blocking a firing sequence (and, releasing thereof), for example, at a trigger, a trigger lever, a firing pin, and/or a hammer of the portable weapon and/or at a safety or safety catch thereof. Due to the requirement for the actuator 3, a current may reach up to 2 Ampere or so. In this regard, the battery P5 may be a rechargeable lithium ion battery. The converter P4 may be a step-up converter, such as Fitipower FP6717 current mode PWM boost DC/DC converter for converting the battery output voltage $V_{BAT}$ into power supply voltage $V_{DD}$ for the circuit.

The battery charger P6 may be a wireless battery charger. An exemplary battery charger (receiver) P6, may comprise, for example, T3168 with a receiver coil for receiving wirelessly transmitted power for storing it into the battery P5, and the transmitter (not shown) may comprise XKT-335 and XKT-412 with a transmission coil that matches with the receiver coil (not shown) for transmitting the power therefor.

The lock control drive circuit 2, in an exemplary embodiment, may comprise an IC module of H-bridge MOS field effect transistor, such as TB6612FNG.

Referring to FIG. 1.12, in a preferred embodiment of the present invention, the vital sign detection module 20 has a pyroelectric infrared sensor 42. The human body usually has a constant temperature, which is normally around 37° C. An infrared radiation wavelength of 10 μm is emitted at or around this temperature. This radiation can be detected by the pyroelectric infrared sensor 42. Firstly, the radiation is strengthened by Fresnel lens 43 and then concentrated at the infrared inductive source (the infrared induction sources usually use pyroelectric component). This pyroelectric infrared sensor 42 is configured to receive human infrared radiation while detecting the temperature variation.

The vital sign detection module 20 of this embodiment is explained below:

The vital sign detection module 20 comprises a cylindrical member 41 for housing the pyroelectric infrared sensor 42, a lens 43, an infrared anti-reflection film 44. The cylindrical member 41 has a radius r. The lens 43 is preferably a Fresnel lens, which intensify the incoming infrared ray. The distance f between the pyroelectric infrared sensor 42 and the Fresnel lens 43 is equal to the focal length of the Fresnel lens 43. The radius of the Fresnel lens 43 is r. The thickness of the infrared anti-reflection film 44 is h, and its radius is also equal to r. The infrared anti-reflection film 44 is coated on the smooth side of the Fresnel lens 43. The patterned side of the Fresnel lens 43 faces to the pyroelectric infrared sensor 42. There is a distance d between the opening of the cylindrical member 41 and the infrared anti-reflection film 44. The angle θ indicates the maximum angle of the incoming light (infrared emission), which could be detected by the pyroelectric infrared sensor 42. The opening of the cylindrical member 41 is in the same direction as to where the gun points. The infrared anti-reflection film 44 reduces the reflection and refraction loss of the incoming infrared rays, wavelength of which range from 8 to 12 mm in order for the pyroelectric infrared sensor 42 to improve sensitive and accuracy for sensing vital signs. As it can be understood from FIG. 1.12, the detection range or angle for detecting the light (infrared emission) by the vital sign detention module 20 forms a cone shape, angle of which is determined by the maximum angle of the incoming light θ. Vital signs will be detected by the vital sign detection module 20 when a person is within the range of defined by the maximum angle θ. The distance "d" may be adjustable to change the maximum angle θ in order to limit/adjust the detection range of the vital sign. The detection distance of the vital sign detection module 20 ranges from 7 meters to 30 meters.

FIG. 1.13 shows a front plan view of the Fresnel lens 43, which shows the side comprising a pattern thereon. The Fresnel lens 43 increases the bright and dark stripes of infrared light, making it easier to sense the variation of infrared lights, so as to improve the sensitivity of the pyroelectric infrared sensor 42. The pyroelectric infrared sensors 42 senses when someone is in the detection range defined by the maximum angle θ. The Fresnel lens 43 has a pattern on one side thereon, which comprises one or more concentric rings 47 with one or more single rings 46.

In order to further increase the sensitivity of vital signs detected by the pyroelectric infrared sensor 42, the pyroelectric infrared sensor 42 further comprises a signal amplification circuit 120 as shown in FIG. 1.14. The signal amplification circuit 120 comprises passive infrared sensors (or pyroelectric infrared sensors) PIR1, PIR2, and amplification stages using operational amplifiers (or op-amps), A1, A2, A3, A4 and A5, which amplify the detected vital signal by the passive infrared sensors PIR1, PIR2. In a preferred embodiment of the present invention, one or more of the concentric rings 47 and one or more single rings 46 correspond to each of the passive infrared sensors PIR1 and PIR2. The signal amplification circuit 120 would have very low DC offset, low drift, low noise, very high open-loop gain, very large common-mode rejection ratio, and high input impedance. Accordingly, the common-mode noise would be filtered out as much as possible, thus a weaker original signal(s) from the pyroelectric infrared sensors PIR1 and/or PIR2 could be amplified appropriately and sufficiently as shown in FIG. 1.14. When a person appears in front of the vital sign detection module 20, after signal(s) from the pyroelectric infrared sensors PIR1, PIR2 is(are) amplified, Vout from the signal amplification circuit 120 outputs quickly and accurately to indicate whether "a person is there within the detection range". The signal amplification circuit 120 includes various other components, C1, R1 to R7, Rd, RP1, RP2 and VD1, VD2, where C1 is a capacitor, R1 to R7 and Rd are resisters, RP1 and RP2 are adjustable resistors, and VD1 and VD2 are diodes.

The sources of the two pyroelectric infrared sensors PIR1 and PIR2 are respectively connected to the input pin of the op-amps A1 and A2, and the drains of the two sensors are connected to the system power supply $V_{DD}$ through the resistor Rd. The differential amplifier circuit formed by op-amps A1, A2, and A3 with resistors R1 to R7, and the voltage comparison shaping circuit is formed by resistors RP1 and RP2, op-amps A4 and A5, and diodes VD1 to VD2. In a preferred embodiment of the present invention, the pyroelectric infrared sensor 42 is arranged such that it has at least two detection zones which may be horizontally arranged as shown in FIG. 1.15*a*. Optionally, the vital signal detection module 20 may include more than two pyroelectric infrared sensors/passive infrared sensors so that the detection zones may be more than two (i.e. four or more). The pyroelectric infrared sensors/passive infrared sensors such that the detection zones therefrom may be arranged horizontally and vertically to improve the accuracy of the vital sign detection. For example, an additional pair of pyroelectric infrared sensors/passive infrared sensors may be arranged above/below (FIG. 1.15*b*), or may be arranged vertically to cross the horizontally arranged pair of the pyroelectric infrared sensors/passive infrared sensors to improve the detection ranges (FIG. 1.15*c*).

It is to be noted that the circuit 120 is only for illustrating an exemplary circuit for the pyroelectric infrared sensors 42 for vital sign detection.

FIG. 1.11 is a process flow diagram of the safety control system 200*a*, where FIG. 1.11*a* is a state diagram showing state transitions based on the status whether a life form is detected or not.

Referring to FIGS. 1.11 and 1.11*a*, at the initial step S1-1, the portable weapon may be locked. At step S1-2, the safety control system 200*a* starts to initialize and locks the portable weapon by blocking a firing sequence. Then, the safety control system 200*a* starts to detect if there are any vital sign signals via vital sign detection module 20 at F0 Hz frequency at S1-4. Once vital signs are detected, the safety control system 200*a* makes sure that the mechanical lock remains at the locked position for safety (at S1-3, via S1-4(Y)). If no vital sign signals are detected, the safety control system 200*a* actuates the mechanical lock to be in unlocked state at S1-5 (via S1-4(N)) and, thus, the portable weapon can be used safely. Alternatively, the microcontroller 1 may include an interrupt handler or capabilities for handling a number of interrupt services, and an output from the vital sign detection module 20 may be an input to the interrupt handler of the microcontroller 1, and thus the process step of locking S1-3 and unlocking S1-5 may be carried out as an interrupt service of the microcontroller 1.

According to an object of the present invention, a safety control system may comprise or may further comprise a direction sensor 21 or other sensor(s) as shown in FIG. 1.2.

A portable weapon safety control system 200*b* includes the control system 100 and a direction sensor 21 for sensing the direction of a portable weapon and providing the sensed direction to the microcontroller 1 in the control system 100. The target direction data and preset values are preprogramed/set and stored in the microcontroller 1 of the control system 100. The direction sensor 21 of the safety control system 200*b* corresponds to the direction of a firing of the portable weapon. The direction sensor 21 monitors and perceives the direction of the portable weapon held/operated by the operator. The direction sensor 21 also detects whether the portable weapon is pointed in the direction of the targets. The microcontroller 1 corrects direction information/indication from the direction sensor 21, and controls the lock control drive circuit 2 to drive the actuator 3 to unlock the firing sequence of the portable weapon. Once the microcontroller 1 through the direction sensor 21 detects that the portable weapon points at the direction other than the target, the microcontroller 1 controls the lock control drive circuit 2 to drive the actuator 3 to lock the firing sequence of the portable weapon to disable the portable weapon, such that the operator cannot fire the portable weapon.

The direction sensor 21 is a virtual sensor that is based on a nine (9) axis motion sensor, comprised of an acceleration sensor, a gyro sensor and a magnetic field sensor. The data from the direction sensor 21 is achieved by the acceleration sensor, gyro sensor and magnetic field sensor via nine axis fusion algorithm. Various commercially available sensors can be used for the present invention. For example, commonly used components/devices of nine-axis fusion sensors may be MPU9150, MPU9250, MPU9255 et cetera, which are made by InvenSense™. In a preferred embodiment of the present invention, the direct sensor 21 comprises MPU9250 for the nine-axis direction sensor. Other similar sensors that can be used to achieve the substantially the same effects shall be within the scope of the present invention.

FIG. 1.21 is a process flow diagram of the safety control system 200*b*, where FIG. 1.21*a* is a state diagram showing state transitions based on the status whether the portable weapon 45 is directed to a proper direction based on various measurements.

Referring to FIGS. 1.21 and 1.21*a*, the safety control system 200*b* powers up at S2-1 and goes through initialization steps S2-2. The safety control system 200*b* then actuates the actuator 3 to lock a firing sequence of the portable weapon S2-3. The direction sensor 21 generates data based on its nine-axis sensors, and the microcontroller 1 of the control system 100 collects the acceleration data at S2-4, magnetic field data at S2-5, gyro data at S2-6. The sequence or order in which the microcontroller 1 collects the acceleration data at S2-4, magnetic field data at S2-5, and gyro data at S2-6 may not be important, i.e. it can be done simultaneously, sequentially in any order, or may be done randomly. Then the microcontroller 1 computes the direction data of the portable weapon based on the collected data at S2-7. The microcontroller 1 compares the direction data of the portable weapon with the direction of the target and computes the included angle (S2-8). If the angle is bigger than the pre-set value θ (θ is preset at, say, 45°. θ value can be adjustable), the safety control system 200*b*, then, controls the actuator 3 to keep the lock at locked position (S2-3 via S2-8(N)). If the angle is less than the pre-set θ (i.e. the direction sensor 21 indicates that the portable weapon is directed to the general direction of the target), the safety control system 200*b* controls the actuator 3 to unlock the gun (step S2-9 via S2-8(Y)).

The sensed data from the direction sensor 21 may be carried out to the microcontroller 1 via an interrupt handler of the microcontroller 1, such that, the direction sensor 21 sends an interrupt to the microcontroller 1 when there is a state change or change in the direction of the portable weapon.

Accordingly, the safety control system 200*b* would improve the safety of operators of the portable weapon and its surroundings by preventing from carrying out/blocking of the firing sequence of the portable weapon when the portable weapon is directed to the place other than the target, i.e. improper aiming.

Referring to FIG. 1.3, according to another preferred embodiment of the present invention, it provides a portable weapon safety control system 200*c* and a corresponding field controller 300*c*. The portable weapon safety control system 200*c* is attached to the portable weapon for controlling the safety of the portable weapon by locking/unlocking the firing sequence thereof. The safety control system 200*c* comprises a portable weapon control system 100 with a signal transmitting module 11 for transmitting data therethrough from the microcontroller 1, and wireless signal receiving module 10 for receiving wireless signal. The microcontroller 1 of the control system 100 in the safety control system 200*c* actuates the actuator 3 via the lock control drive circuit 2 for locking/unlocking a firing sequence of the portable weapon. The field controller 300*c* includes a microcontroller 4, a signal receiving module 13 for receiving signal from the safety control system 200*c* via the signal transmitting module 11; and a wireless signal transmitting module 12 that is in communication with the microcontroller 4 for transmitting wireless signal to the safety control system 200*c*. The field controller 300*c* may be in communication with more than one signal receiving module 13.

The signal transmitting module 11 and the signal receiving module 13 communicate with each other wirelessly. For example, the signal transmitting module 11 and the signal receiving module 13 may use one or more of infrared, ultrasound, millimeter wave (or MMW) radar signal, etc., which is very directional and does not scatter or deflect, such that direction of the signal transmitted is indicative of the general direction that the portable weapon is pointing to. In a preferred embodiment of the present invention, the signal transmitting module 11 is installed on the portable weapon, such that the signal transmitting module 11 transmits signal to the direction to which the portable weapon is pointing to. It is to be understand that the signal transmitter module 11 and signal receiving module 13 may be designed such that detection of the signal may merely indicative that the portable weapon is pointing to a safe area (or safe to use), and does not have to be pointing to the target.

The wireless signal transmitting module 12 and wireless signal receiving module 10 communicate with each other wirelessly, for example, by using Bluetooth™, Wi-Fi™, and/or other wireless communication means. The wireless signal transmitting module 12 may comprise, for example, pt2272 (remote control decoder from Princeton Technology Corp), pt2262 (remote control decoder from Princeton Technology Corp), Bluetooth™, module, Wi-Fi™ module and other wireless communication modules. Other similar wireless modules that can be used to achieve substantially the same results/effect.

FIG. 1.31*a* shows a process flow diagram of the safety control system 200*c* in cooperation with the field controller 300*c*, and FIG. 1.31*b* shows a process flow diagram of the field controller 300*c*, in cooperation with the safety control system 200*c*, where FIG. 1.32*a* is a state diagram showing state transitions of the safety control system 200*c* based on the status whether signal from the field controller is detected or not; and FIG. 1.32*b* is a state diagram showing state transitions of the field controller 300*c* based on the status whether direction signal from the safety controller 200*c* is received or not.

First, the safety control system 200*c* and the field controller 300*c* are started at S3*a*-1 and S3*b*-1, respectively, both will go through initialization at S3*a*-2 and S3*b*-2, respectively. Through the initialization S3*a*-2, the safety control system controls the signal transmitting module 11 to transmit detection signal at F0 Hz frequency, and, then the microcontroller 1 initiates the actuator 3 via lock control drive circuit 2 to lock the firing sequence of the portable weapon at S3*a*-3. Once the firing sequence is locked, the microcontroller 1 waits for the wireless signal through the wireless signal receiving module 10 from the field controller 300*c* (S3*a*-4). The field controller 300*c*, once started at S3*b*-1, initiates initialization process S3*b*-2. The field controller 300*c* may, via the wireless signal transmitting module 12, transmit wireless signal to the safety control system 200*c* to lock the firing sequence at S3*b*-3. This step may be optional, but this may be done so as to ensure that the safety control system 200*c* is in locked state. If the safety control system 200*c* detect signal from the field controller 300*c* (S3*a*-4), then the microcontroller 1 of the safety control system 200*c* controls the actuator 3 via lock control drive circuit 2 to unlock the firing sequence of the portable weapon at S3*a*-5 (via S3*a*-4(Y)); otherwise, the microcontroller 1 of the safety control system 200*c* controls the actuator 3 via lock control drive circuit 2 to lock the firing sequence of the portable weapon at S3*a*-3 (via S3*a*-4(N)). Alternatively, at state S3*b*-3, the field controller 300*c* may not transmit any wireless signal to the safety control system 200*c*, thus the safety control system 200*c* would unlock the firing sequence of the portable weapon only when the safety control system 200*c* receives "unlock" signal.

In a preferred embodiment of the present invention, the signal receiving module 13 may be an infrared sensing module similar to that is shown in FIG. 1.12, and the signal transmitting module 11 may be an infrared emitter which is mounted on the portable weapon. The signal receiving module 13 has a specific set of values for r, d and f for the pyroelectric infrared sensor to define the detectable sensing angle/range θ as shown in FIG. 1.12. If an angle between the signal transmission direction $\theta_T$ and the signal receiving direction $\theta_R$ is less than the pre-set value θ (θ is preset as 45°, it is adjustable), the signal receiving module 13 of the field controller 300*c* could receive the detection signal from the transmitting module 11. The microcontroller 4 examines whether the signal receiving module 13 receives the signal from the signal transmitting module 11. The field microcontroller 4 controls the wireless signal transmitting module 12 to send the wireless signal to the safety control system 200*c* to unlock the firing sequence at S3*b*-5 via S3*b*-4(Y) if the signal is detected, or to lock the filing sequence if the signal is not detected at S3*b*-3 via S3*b*-4(N).

As it can be seen from FIG. 1.32*a*, the safety control system 200*c* has only two states: locked S3*a*-3 or unlocked S3*a*-5. In this regard, the safety control system 200*s* should go into "unlocked" state S3*a*-5 only if and when the safety control system 200*c* receives/receiving the "unlock" signal from the field controller 300*c*; otherwise, the safety control system 200*c* should be in "locked" state S3*a*-3 (i.e. positive detection of "lock" signal or negative detection of "unlock" signal should cause the safety control system 200*c* to be in "locked" state S3*a*-3).

Similarly, as shown in FIG. 1.32*b*, the field controller 300*c* has only two states: send "lock" signal (or send nothing) S3*b*-3 or send "unlock" signal S3*b*-5. That decision would be made by the field controller 300*c* based on whether direction signal is received (S3*b*-4).

The signal transmitting module 11 may comprise an infrared emitter 51 in a housing 52, where the shape of the housing 52 is in a cylindrical shape as shown in FIG. 1.3*a* or conical shape as shown in FIG. 1.3*b*.

One or more signal receiving module 13 of the field controller 300*c* may be installed about a target or on a wall of bullet trap.

The signal transmitting module 11 and the signal receiving module 13 may comprise an ultrasonic transmitter and receiver, MMW radar transmitter and receiver, and other similar transmitting and receiving modules, any of which can be used to achieve substantially the same results to detect the direction to where the portable weapon points.

According to another aspect of the present invention, it provides a portable weapon safety control system 200*d*, which includes a control system 100 and signal receiving module 13*a*, and a signal transmitting module 11*a* for keeping the safety in a shooting range or equivalent. The operation principle of this embodiment is similar to that shown in FIG. 1.3. The safety system controller 200*d* is installed on a portable weapon, the control system 100 of the safety controller 200*d* comprises a microcontroller 1, a lock control drive circuit 2, and an actuator 3 for actuating locking/unlocking of a firing sequence of the portable weapon, and the signal receiving module 13*a* for receiving/detecting a detection signal transmitted by the signal transmitting module 11*a*, which is installed in the field. The signal receiving module 13*a* is connected to the microcontroller 1. The signal transmitting module 11*a* is for transmitting a detection signal. The control system 100 of the safety controller 200*d* unlocks the firing sequence of the portable weapon only when the signal receiving module 13*a* receives/detects the detection signal transmitted by the signal transmitting module 11*a*.

In a preferred embodiment of the present invention, the signal transmitting module 11*a* comprises an infrared laser transmitter, for example, HLM1235 or similar; and the signal receiving module 13*a* comprises an infrared laser receiving tube, for example, ISO203 or similar.

FIG. 1.41 shows a process flow diagram for the safety control system 200*d* in cooperation with signal transmitting module 11*a*; where FIG. 1.41*a* is a state diagram showing state transitions of the safety control system 200*d* based on the status whether the infrared receiver receives the infrared laser signal or not.

For example, the safety control system 200*d*, after started at S4-1 and initialized at S4-2, the microcontroller 1 of the safety control system 200*d* controls the lock control drive circuit 2 to drive the actuator 3 to lock the firing sequence of the portable weapon at S4-3. Then, the microcontroller 1 monitors whether the signal receiving module 13*a* receives the signal generated by the signal transmitting module 11*a* at step s4-4. If detected, the microcontroller 1 controls the lock control drive circuit 2 to drive the actuator 3 to unlock the firing sequence of the portable weapon, thus allowing the portable weapon to fire at S4-5 via S4-4(Y); otherwise, the microcontroller 1 maintains to lock the firing sequence of the portable weapon at S4-3 via S4-4(N).

Referring to FIG. 1.5, according to another aspect of the present invention, it provides a portable weapon safety control system 200*e* that would be installed on a portable weapon, and a field controller 300*e*, which is in communication with the safety control system 200*e*.

The safety control system 200*e* includes a control system 100, comprising a microcontroller 1 for controlling a lock control drive circuit 2 to drive an actuator 3 for locking/unlocking a firing sequence of the portable weapon. The microcontroller 1 of the control system 100 is in communication with a wireless signal receiving module 10. The field controller 300*e* includes a microcontroller 4, which is in communication with a gesture recognition system 22 and a wireless signal transmitting module 12. The gesture recognition system 22 may comprise one or a combination of a binocular camera gesture recognition system, a structural optical gesture recognition system, a TOF gesture recognition system, an ultrasonic gesture recognition system, an MMW radar gesture recognition system, and an AI image gesture recognition system. The field controller 300*e* is also in communication with the wireless signal transmitting module 12, which transmits wireless signal to the wireless signal receiving module 10 of the safety control system 200*e*.

1) AI Image Recognition System:

Referring to FIG. 1.5*a*, the AI image gesture recognition system 22*a* may comprise an artificial intelligence image recognition system. The device/feature for capturing image(s) for the AI image gesture recognition system 22*a* may be installed at where an operator 60 of the portable weapon 45 can be monitored and captured. In the case of applying the invention in a shooting range or equivalent, the image capturing device/feature may be installed in front of a shooting bench.

The AI image recognition system is configured to recognize a human's gesture and direction to which the portable weapon 45 is pointing. Such data related to the human's gesture and direction may be sent to and be processed by the microcontroller 4 in the field controller 300*e*, or by the microcontroller 1 in the safety control system 200*e* in order to determine whether it is safe to operate the portable weapon 45. If the AI image recognition system detects that a person is in front of the portable weapon 45, the field controller 300*e* processes such information to send signal to lock the firing sequence of the portable weapon 45, or the field controller 300*e* may send the detected/calculated direction data of the portable weapon 45 to the safety control system 200*e* via wireless signal transmitting module 12, such that the microcontroller 1 of the safety control system 200*e* may process the data to determine the safety and to lock the firing sequence of the portable weapon 45.

The AI image recognition system of the field controller 300*e* detects the direction of the portable weapon 45, and the data may be used to determine whether the portable weapon 45 is not pointed towards a target 40 in a shooting range or if there is human in front of the portable weapon 45. The microcontroller 4 of the field controller 300*e* may process the detected data of direction to determine the safety of carrying out the firing sequence of the portable weapon 45 and send a command to the safety control system 200*e* via the wireless signal transmitting module 12 and the wireless signal receiving module 10 whether to lock or unlock the firing sequence of the portable weapon 45; or may relay the detected data via the wireless signal transmitting module 12, the wireless signal receiving module 10 of the safety control system 200*e* receives the wireless data for the microcontroller 1, and the microcontroller 1 may process the detected data to determine the safety of carrying out the firing sequence of the portable weapon 45, and whether to control the lock control drive circuit 2 to drive the actuator 3 to lock or unlock the firing sequence of the portable weapon 45.

2) Myoelectric Sensor Gesture Recognition System:

Referring to FIG. 1.5*b*, the gesture recognition system 22 may comprise a myoelectric sensor gesture recognition system 22*b*.

The myoelectric sensor gesture recognition system 22*b* of the field controller 300*e* may be worn on an arm(s) 61 of an operator 60 of the portable weapon 45 (i.e. one or more myoelectric sensor(s) may be placed on the arm 61) for collecting the myoelectric signal and gesture data of the arm(s) 61 and calculates the arm movement for a gesture recognition.

The myoelectric sensor gesture recognition system 22*b* includes: a myoelectric sensor(s) 220 and a motion sensor(s) 225. There are a number of mature products and modules which are already in the market. A direction to which the portable weapon 45 is pointing is calculated based on data collected by the myoelectric sensor(s) 220 and motion sensor(s) 225, and the data are used for making a determination on whether to lock or unlock the firing sequence of the portable weapon 45 may be made. The myoelectric sensor(s) 220 on the arm(s) 61 monitors the movement of the arm(s). The microcontroller 4 of the field controller 300*e* calculates the direction in which the portable weapon 45 is pointing to via the collected data from the myoelectric sensor recognition system 22*b*. The data will be processed by the microcontroller 4 of the field controller 300*e* or may be transferred to the safety control system 200*e* via the wireless signal transmitting module 12/wireless signal receiving module 10, such that the microcontroller 1 may process the collected data. The microcontroller 4 of the field controller or the microcontroller 1 of the safety control system 200*e* uses the collected data to compare with the position data of a target 40. If the direction in which the portable weapon 45 is pointing to is not within a certain range of the target 40, the first microcontroller 1 controls the lock control drive circuit 2 to drive the actuator 3 to lock the firing sequence of the portable weapon 45 for safety. Only when the direction to which the portable weapon 45 is pointing is in a safe direction/region and the operator holds the portable weapon 45 with a predetermined appropriate gesture with the portable weapon 45 (for example, the detected data from the myoelectric sensor(s) 220 and motion sensor(s) 225 may be analyzed to confirm whether the operator is holding the portable weapon 45 with both hands and aiming at the target 40). The signal indicating the inherent feature of holding the portable weapon 45 with both hands are collected through the myoelectric sensor(s) 220, then the portable weapon 45 is permitted to fire. Otherwise, the microcontroller 1 controls the lock control drive circuit 2 to drive the actuator 3 to lock the firing sequence of the portable weapon 45 for safety.

In a preferred embodiment of the present invention, the myoelectric sensor gesture recognition system 22*b* may be an OYMotion™ gesture recognition arm band, such as gForce Armband™, which may include eight (8) myoelectric sensors and one (1) motion senor. The myoelectric sensor gesture recognition system 22*b* is configured to recognize the common gestures like holding the portable weapon 45 with both hands, holding the portable weapon 45 with one hand, pulling the trigger with the index finger, and holding the portable weapon 45 and aiming at the target 40, etc. The gesture recognition armband captures the biological current on the operator's arm(s) as well as the acceleration/movement data of the operator's arm(s). Accordingly, based on the collected data, the microcontroller 4 or the microcontroller 1 or both microcontroller 4 and the microcontroller 1 may calculate the holding gesture(s) of the operator of the portable weapon 45.

The myoelectric sensor gesture recognition system 22*b* may be calibrated/tuned under the following conditions. Ten (10) healthy subjects, whose ages are 30 years older, were selected. Four (4) different movements/actions of each person were collected as sample. Then, each subject performed each action for fifty (50) times; four (4) actions were, thereafter, performed by each subject for two thousand (2000) times. All of these actions/performances were recorded as test samples for improving the accuracy of the myoelectric sensor gesture recognition system 22*b*. The number of the subject and/or number of the repetition of the action movements may be increased to improve the recognition accuracy of the myoelectric sensor gesture recognition system 22*b*. In a preferred embodiment of the present invention, the sampling frequency of myoelectric sensor is configured to be at 200 Hz, and the sampling frequency of the acceleration/motion sensor is configured to be at 50 Hz. The eigenvalues of each action in the test sample are extracted and used as the eigenvalues for detecting appropriate/non-appropriate gestures for controlling to lock/to unlock the firing sequence of the portable weapon 45. Once predetermined eigenvalues were predetermined and pre-set, detected gestures of an operator of the portable weapon 45 can be compared to determine whether the portable weapon 45 is safe to carry out the firing sequence. When the error range between the movement of holding the portable weapon 45 towards the target 40 by the operator and the eigenvalue is within, say, for example, 10%, it is considered that the shooter has pointed the portable weapon 45 at the target 40 correctly. At this point, the microcontroller 1 controls the lock control drive circuit 2 to drive the actuator 3 to unlock the firing sequence of the portable weapon 45. If the error range between the movement of holding the portable weapon 45 towards the target 40 by the operator 60 and the eigenvalue is beyond 10%, the microcontroller 1 controls the lock control drive circuit 2 to drive the actuator 3 to lock the firing sequence of the portable weapon 45.

The myoelectric sensor gesture recognition system 22*b* can also be used to build a three-dimensional model of the portable weapon 45 and calculate the space coordinates of the portable weapon 45. The microcontroller 4 may be configured to send the space coordinate of the portable weapon 45 to the wireless signal receiving module 10. The safety control system 200*e* receives the spatial coordinate data and calculates the angle between the direction of the portable weapon 45 and the target 40, when the direction of the portable weapon 45 is not within a certain range of the direction of the target 40 like above 45°, the microcontroller 1 is configured to control the lock control drive circuit 2 to drive the actuator 3 to lock the firing sequence of the portable weapon 45, thus ensuring the safety of the portable weapon 45.

The myoelectric sensor gesture recognition system 22*b* may be DTing™ wristband/myoelectric technical system or other similar device, which would provide substantially the same performance.

3) Time of Flight (ToF) Gesture Recognition System:

Referring to FIG. 1.5*d*, according to another preferred embodiment of the present invention, the gesture recognition system 22 comprise a time of flight (ToF) gesture recognition system 22*d*, where a ToF camera(s) may be disposed in front of a shooting bench in the case for a shooting range, or place where the ToF camera(s) is able to capture images of movements of an operator 60 of a portable weapon 45.

The ToF gesture recognition system 22*d* may be Geefish™ Tech ToF gesture recognition system, which comprises an emitter 22*d*(*a*) that emits modulated near-infrared light pulses and uses a sensor(s) 22*d*(*b*) to monitor an arm(s)/hand(s) 61 of an operator 60 that are holding a portable weapon 45. The ToF gesture recognition system 22*d* is configured to measure the distance to the arm 61 holding the portable weapon, and to build a three-dimensional outline of the arm 61. The microcontroller 4 may be configured to carry out a machine learning, including, for example, a deep learning algorithm, to extract the profile of the portable weapon that the operator 60 holds. Once the characteristics are normalized, the microcontroller 4 is configured to recognize various common gestures of holding the portable weapon, including, but not limited to, a gesture of holding the portable weapon with both hands 61; or one hand 61; a gesture of pulling trigger with the index finger; and holding the portable weapon 45 and aiming it at target 40. When a machine learning is used, similar to the aforementioned myoelectric gesture detection devices, the ToF gesture recognition system 22*d* may be calibrated/tuned under the following conditions. For example, five (5) healthy people at age 30 were selected, and each person performed four (4) different movements for collecting data. Each movement is performed by each person 40 times by each person, and data were collected. In a preferred embodiment of the present invention, the TOF gesture recognition system 22*d* is configured to have the frame rate of 45 frames per second (fps) to sample/monitor the movement of the arm(s) 61 of the operator 60. The eigenvalues of each movement in the test samples are gathered and analyzed to determine eigenvalues for evaluating holding gestures by an operator 60. In this regard, gestures by the operator 60 are monitored and compared with the characteristics of the test samples to determine which movement one of the four different movements/gestures that the operator 60 is making. If the range of errors between the movement of holding the portable weapon towards the target 40 and the eigenvalue is within, say, for example, 10%, the operator is appeared to have correctly pointed the portable weapon at or to the target 40. At this point, the microcontroller 1 controls the lock control drive circuit 2 to drive the actuator 3 to unlock the firing sequence of the portable weapon. If the error range between the movement of holding the portable weapon aiming the target 40 by the operator 60 and the eigenvalue is beyond the 10% error range, the microcontroller 1 controls the lock control drive circuit 2 to drive the actuator 3 to lock the firing sequence of the portable weapon. The ToF gesture recognition system 22*d* can also be configured to build a three-dimensional model of the portable weapon and calculate the space coordinates of the two ends of the portable weapon. The field controller 300*e* is configured to transmit the spatial coordinate to the wireless signal receiving module 10, and the safety controller 200*e* is configured to receive the spatial coordinate data. By calculating the angle between the direction of the portable weapon and the target 40, the microcontroller 1 determines whether to control the lock control drive circuit 2 to drive the actuator 3 to lock or unlock the firing sequence of the portable weapon.

4) Milli-Meter Wave (or MMW) Radar Gesture Recognition System:

According to another preferred embodiment of the present invention, the gesture recognition system 22 comprise a millimeter wave (MMW) gesture recognition system 22*d*, comprising a millimeter wave emitter 22*d*(*a*) and a sensor 22*d*(*b*). The structure and principle of this embodiment is similar to ToF gesture recognition system 22*d* as shown in FIG. 1.5*d*.

5) Binocular Camera Gesture Recognition System:

Referring to FIG. 1.5*e*, according to another preferred embodiment of the present invention, the gesture recognition system 22 comprise a binocular camera gesture recognition system 22*e*.

An exemplary embodiment of the binocular camera gesture recognition system 22*e* may be Leap Motion™ Rev.6 gesture recognition system. The binocular camera gesture recognition system 22*e* may be placed in front of an operator 60 of a portable weapon 45, preferably facing to the operator 60, so that movements of the portable weapon 45 while handled by the operator 60 is within the detection range of the two cameras 22*e*(*a*), 22*e*(*b*) of the binocular camera gesture recognition system 22*e*. Based on the principle of binocular stereoscopic vision, the gesture information including 3D position is calculated, and the stereo model of gun-holding gesture is built. Then the binocular camera gesture recognition system 22*e* is configured to track gestures of the operator 60 during the handling of the portable weapon 45. The binocular camera gesture recognition system 22*e* can be used to identify common gestures such as holding the portable weapon 45 with both hands; holding the portable weapon 45 with a single hand; pulling the trigger with the index finger; and holding the portable weapon 45 with single hand and aiming the target 40; etc. The binocular camera gesture recognition system 22*e* may be calibrated/tuned under the following conditions. Twenty (20) healthy people at a certain age were selected, and four (4) different movements of each person was collected. Each action is performed 50 times, and the data therefor were collected. In a preferred embodiment of the present invention, the binocular camera gesture recognition system 22*e* monitors movements of the hand gestures at a frequency of 120 frames per second (fps). The eigenvalues of each movement in the test sample are extracted and used as the eigenvalues for the control. Accordingly, the movements are compared with the characteristics of the movements by the samples to determine a type of movement/gesture that the operator 60 is making. When the range of error between the captured movement and the eigenvalue is less than 10%, the operator 60 is considered to have pointed the portable weapon 45 at the target 40 correctly. At this point, the microcontroller 1 controls the lock control drive circuit 2 to drive the actuator 3 to unlock the firing sequence of the portable weapon 45. If the error range between the captured movement and the eigenvalue is beyond 10%, the microcontroller 1 controls the lock control drive circuit 2 to drive the actuator 3 to lock the firing sequence of the portable weapon 45.

The binocular camera gesture recognition system 22*e* can also be configured to build a three-dimensional model of the portable weapon 45 and calculate the space coordinates of the portable weapon 45. The field controller 300*e* sends the space coordinate of the portable weapon 45 to the wireless signal receiving module 10. The safety control system 200*e* receives the spatial coordinate data and calculates the angle between the direction of the portable weapon 45 and the target 40. When the direction of the portable weapon 45 and the direction to the target 40 is not within a certain range, for example, above 45°, the first microcontroller 1 controls the lock control drive circuit 2 to drive the actuator 3 to lock the firing sequence of the portable weapon 45.

Currently, upon the binocular camera gesture recognition system 22*e* may be Leap Motion™, and uSens™, Gee Fish™ Tech, Untouch™, Vivid™ Tech.

6) Structured Light Gesture Recognition System:

Referring to FIG. 1.5*f*, according to another preferred embodiment of the present invention, the gesture recognition system 22 comprise a structured light gesture recognition system 22*f*, which uses a process of projecting a known pattern to an operator 60 with a portable weapon 45 and monitors the images with the known pattern projected onto the operator 60 and the portable weapon 45. The structured light gesture recognition system 22*f* is installed at a location where the cameras may be able to capture movement of an operator of the portable weapon.

The structured light gesture recognition system 22*f* may be an Orbbec™ 3D sensor camera, which may be placed in front of a shooting bench in case of a shooting range, facing the operator 60 of the portable weapon 45. The structured light gesture recognition system 22*f* may use an invisible light emitter, such as an infrared projector 22*f*(*a*) where a coded infrared laser/a known pattern is projected onto an arm(s)/hand(s) 61 of the operator 60 that hold the portable weapon 45, and the receiver 22*f*(*b*) (a standard CMOS sensor) receives a reflected infrared laser pattern(s) from the arm/hand 61 that holds the portable weapon 45 and data for further processing. The position and in-depth information of the arm(s)/hand(s) 61 that holds the portable weapon 45 can be calculated based on collected data, and calculates/determines the displacement change of the movement pattern of the arm 61 that holds the portable weapon 45, and then the whole three-dimensional space can be generated/stored. For example, the nearest neighbor algorithm may be used to extract the movements or gestures of the hand(s) 61 of the operator 60 that holds the portable weapon 45. By using the support vector machine (SVM), the structured light gesture recognition system 22*f* can be trained to recognize the characteristics of the movements related to the handling of the portable weapon 45 by using a collection of training data samples. Finally, common gestures such as holding the portable weapon 45 with both hands 61; holding the portable weapon 45 with one hand 61; pulling the trigger with the index finger and aiming at the target 40 with the single hand 61; and aiming the target may be identified.

The structured light gesture recognition system 22*f* may be calibrated/tuned under the following conditions. For example, fifteen (15) healthy people from a specific age group were selected, and each of the people performed four (4) different movements. Each movement was performed 50 times by each of the people for correcting sample data. The 3000 groups of gun-holding gestures were extracted. The sampled data were provided to the SVM to be analyzed. In this preferred embodiment of the present invention, the gesture recognition system 22 samples the gestures/movements at a frequency of 30 frames per second (fps). Eigenvalues of each movement in the sample are calculated and used as the eigenvalues for the control. When a gesture by an operator is captured, the captured gestures are compared with the characteristics of the samples to determine what type of movement that the operator of the portable weapon is making. When the error range between the captured movement of holding the portable weapon by an operator towards the target and the eigenvalue is within 10%, it is considered that the portable weapon is pointing at the target correctly. At this point, the microcontroller 1 controls the lock control drive circuit 2 to drive the actuator 3 to unlock the firing sequence of the portable weapon. If the error range between the captured movement and the eigenvalue is beyond the 10% range, the microcontroller 1 controls the lock control drive circuit 2 to drive the actuator 3 to lock the firing sequence of the portable weapon.

The structured light gesture recognition system 22*f* can also be configured to build a three-dimensional model of the portable weapon 45 and calculate the space coordinates of the portable weapon 45. The field controller 300*e* may send the space coordinate of the portable weapon to the wireless signal receiving module 10. The safety control system 200*e* receives the spatial coordinate data and calculates the angle between the direction of the portable weapon 45 and the target 40. When the direction of the portable weapon 45 and the direction of the target 40 is not within a certain error range, for example, above 45°, the microcontroller 1 controls the lock control drive circuit 2 to drive the actuator 3 to lock the firing sequence of the portable weapon.

For example, the structure light gesture recognition system of the gesture recognition system 22 may be selected from the group consists of: Mantis Vision™, Prime Sense™, Pmek™, RealSense™, and Orbbec™.

FIGS. 1.51 and 1.52 show exemplary process flow diagrams in accordance with the present invention. FIG. 1.51*a* shows a state diagram showing state transitions based on the status whether the portable weapon 45 is directed to a proper direction based on various measurements.

FIG. 1.51 shows an exemplary process flow diagram and FIG. 1.51*a* shows an exemplary state diagram for the microcontroller 1 of the safety control system 200*e*. The safety control system 200*e* starts (S5-*a*1) and initializes by loading the direction data of the target 40 which is one of the crucial parameters for controlling the lock control driver 2 to drive the actuator 3 to lock/unlock the portable weapon 45 (S5-*a*2). The safety control system 200*e* controls the lock control driver 2 to drive the actuator 3 to lock the portable weapon 45 (S5-*a*3). Then, the safety control system 200*e* receives and monitors the direction data of the portable weapon 45 from the wireless signal receiving module 10 (S5-*a*4). Based on the direction data of the portable weapon 45 and the direction of the target 40, the safety control system 200*e* calculates the difference in the angle between the direction of the portable weapon 45 and the target 40. If the error angle is bigger than the pre-set value θ (θ is pre-set as 45°, it is adjustable), then the microcontroller 1 controls the lock control drive circuit 2 to drive the actuator 3 to lock the firing sequence (S5-*a*3 via S5-5*a*(N)). If the error angle is less than preset value θ, then the microcontroller 1 controls the lock control drive circuit 2 to drive the actuator 3 to unlock the firing sequence (S5-*a*6 via S5-5*a*(Y)).

FIG. 1.52 shows an exemplary process flow diagram of the microcontroller 4 of the field controller 300*e*.

The field controller 300*e* starts to initialize (S5-*b*1) and then initializes by uploading the gesture data based on sample data (S5-*b*2). Once the gesture recognition system 22 starts to produce the data, the microcontroller 4 receives the data therefrom for processing (S5-*b*3). The microcontroller 4 transforms such received data to direction data of the portable weapon 45 (S5-*b*4). Finally, the data will be transmitted via wireless signal transmitting module 12 (S5-*b*5).

Referring to FIG. 1.6, according to another preferred embodiment of the present invention, it provides a portable weapon safety control system 200*f*, which comprises a control system 100 and a gun positioning module 23, which is in communication with a microcontroller 1 of the control system 100. The safety control system 200*f* would be mounted on a portable weapon 45.

This safety control system 200*f* is suitable for shooting or similar occasions, as well as the control of the portable weapon 45. When used in a shooting range, the safety control system 200*f* is configured such that the portable weapon 45 can only be used only within the allowed area inside the shooting range. If, for example, the portable weapon 45 is taken outside of the shooting range, the safety control system 200*f* locks the firing sequence of the portable weapon 45, thus the portable weapon 45 cannot be fired. Based on our experiments and testing, the safety control system 200*f* was able to lock the portable weapon 45 within about 0.1 s.

In order to improve the safety level of portable weapons such as firearms, this safety control system 200*f* is configured to allow an operator 60 of the portable weapon 45 to operate it only in a predetermined permitted area(s). The gun positioning module 23 comprises a wireless sensor network location technology and Global Positioning System (GPS)/Augmented Global Positioning System (A-GPS) position technology to determine the location of the portable weapon 45. Other than GPS may be used for the present invention and for the same purpose, including, but not limited to BeiDou (BeiDou Navigation Satellite System (BDS)), Galileo (or global navigation satellite system (GNSS)), or other positioning system. Wireless sensor network location technology may be configured to use ultrasonic wave, blue tooth, Wi-Fi, ZigBee, RFID, ultra-bandwidth, or other similar technique to locate portable weapons.

FIG. 1.61 shows an exemplary process flow diagram of the microcontroller 1 of the safety control system 200*f*. After the safety control system 200*f* starts up (S6-1), it goes through initialization process S6-2 and uploads pre-determined coordinate/location information regarding allowed/permitted area(s) where an operator 60 may operate the portable weapon 45. Then, the safety control system 200*f* locks the firing sequence of the portable weapon 45. While the safety control system 200*f* is operating, if the data collected by gun position module 23 indicates that the portable weapon 45 is within the permitted position, the microcontroller 1 in the safety control system 200*f* controls the lock control drive circuit 2 to drive the actuator 3 to unlock the firing sequence of the portable weapon 45 (S6-5 via S6-4(Y)). If the data collected by the gun position module 23 indicates that the portable weapon 45 is outside the predetermined permitted area, the microcontroller 1 in the safety control system 200*f* controls the lock control drive circuit 2 to drive the actuator 3 to lock the firing sequence of the portable weapon (S6-3 via S6-4(N)).

Referring to FIG. 1.7, according to yet another aspect of the present invention, it provides a portable weapon safety control system 200*g*, comprising a control system 100 and a biometric sensor/recognition module 24 (i.e. fingerprint recognition). The safety control system 200*g* further comprises a wireless remote control receiver module 14, which is wirelessly and remotely in communication with a remote controller 300*g*.

The biometric sensor/fingerprint recognition module 24 enables an operator 60 to use his or her unique biometrics (i.e. fingerprint) to lock or unlock the portable weapon 45. The safety control system 200*g* may store data for more than one fingerprints for more than one person. For example, in the case of shooting range, the safety control system 200*g* may store data of the fingerprints for an administrator, supervisor and other authorized staffs in the shooting range for locking/unlocking the portable weapon 45.

During an operation of the portable weapon 45, when an administrator finds some abnormal or unsafe condition(s)/situation(s) in the behavior or environment of the operator 60, the administrator may use the remote controller 300*g* to control the lock control drive circuit 2 to drive the actuator 3 to lock the firing sequence of the portable weapon 45 (this would override unlocking that was initiated by the biometric sensor/fingerprint recognition module 24). In other words, unlocking of the firing sequence of the portable weapon 45 only occurs when both the remote controller 300*g* and the biometric sensor/fingerprint recognition module 24 allows unlocking of the firing sequence of the portable weapon 45. In order to further increase the safety of the operation of the portable weapon 45, the safety control system 200*g* requires biometric information (fingerprints) from more than one person, i.e. a supervisor and an administrator of the shooting range, for example.

Other than use of biometric information, various other types of authentication technologies/technique may be used to replace or to supplement therewith as shown below.

Referring to FIGS. 3.31 and 3.32, the safety control system 200*j*(1) comprises the control system 100 and a RFID card reader 81, which is in communication with the microcontroller 1 of the control system 100, for reading an RFID card 80. The safety control system 200*j*(1) unlocks the portable weapon only when the RFID card reader 81 successfully read the RFID card 80 and authenticate that the RFID card 80 is for authorized person/personnel. Once it is authenticated, the microcontroller 1 controls the lock control drive circuit 2 to drive the actuator 3 to unlock the firing sequence of the portable weapon. Accordingly, unsuccessful reading of RFID card 80 by the RFID card reader 81, or unsuccessful confirmation/authentication would cause the microcontroller 1 controls the lock control drive circuit 2 to drive the actuator 3 to lock the firing sequence of the portable weapon, such that the portable weapon cannot be used/fired.

Referring to FIGS. 3.41 and 3.42, the safety control system 200*j*(2) comprises the control system 100, a dynamic password generator 83, an input device or keyboard 84, and a display 85, which are in communication with the microcontroller 1 of the control system 100. The dynamic password generator 83 generates same random dynamic passwords at the same rate as a dynamic password card 82. Accordingly, authorized person/personnel may enter a randomly generated password by the dynamic password card 82 through the input device 84. Only when the password entered through the input device 84 matches with the generated password by the dynamic password generator 83, the microcontroller 1 controls the lock control drive circuit 2 to drive the actuator 3 to unlock the firing sequence of the portable weapon; otherwise, the microcontroller 1 controls the lock control drive circuit 2 to drive the actuator 3 to lock the firing sequence of the portable weapon, such that the portable weapon cannot be used/fired.

Referring to FIGS. 3.51 and 3.52, the safety control system 200*j*(3) comprises the control system 100 and a physical chip card reader 86, which is in communication with the microcontroller 1 of the control system 100. When a physical chip card 87 is inserted into the physical chip card reader 86, the control system 100 carries out the authentication. Only after the successful authentication, the microcontroller 1 controls the lock control drive circuit 2 to drive the actuator 3 to unlock the firing sequence of the portable weapon; otherwise, the microcontroller 1 controls the lock control drive circuit 2 to drive the actuator 3 to lock the firing sequence of the portable weapon, such that the portable weapon cannot be used/fired.

FIG. 1.71 shows an exemplary process flow diagram of the safety control system 200*g*. For example, after the safety control system 200*g* started (S7-1), it goes through initialization (S7-2) by, for example, uploading biometric data of more than one authorized personnel, i.e. the supervisor and administrator. The safety control system 200*g* locks the firing sequence of the portable weapon 45 only when the safety control system 200*g* receives an emergency blocking signal (S7-3), and unless more than one authorized personnel enter correct biometric data (or password, for example, at S7-5, S7-6), the safety control system 200*g* remains the portable weapon 45 to be locked.

First, the safety control system 200*g* check whether any remote emergency control signal from the remote controller 300*g* to lock the portable weapon is received or not (S7-3). If the remote emergency control signal to lock the portable weapon 45 is received, the microcontroller 1 of the safety control system 200*g* controls the lock control drive circuit 2 to drive the actuator 3 to lock the firing sequence of the portable weapon 45 (s7-4); otherwise, the microcontroller 1 of the safety control system 200*g* continues to monitor for any remote emergency control signal. Once locked (S7-4), the safety control system 200*g* further checks whether the first authorized personnel's (supervisor's) fingerprint is entered correctly (S7-5). If not, the microcontroller 1 of the safety control system 200*g* controls the lock control drive circuit 2 to drive the actuator 3 to lock the firing sequence of the portable weapon 45 (s7-4); otherwise, it will check whether the second authorized personnel's (supervisor's) fingerprint is entered correctly (S7-6). If not, the microcontroller 1 of the safety control system 200*g* controls the lock control drive circuit 2 to drive the actuator 3 to lock the firing sequence of the portable weapon 45 (s7-4). Otherwise, the microcontroller 1 of the safety control system 200*g* controls the lock control drive circuit 2 to drive the actuator 3 to unlock the firing sequence of the portable weapon 45 (S7-7).

Integrated Embodiment 1

In order to improve its safety of operating a portable weapon, a combination of two or more of the aforementioned safety sensors/modules may be used. For example, as shown in FIG. 2.1, a portable weapon safety control system 200*h* may include a vital sign detection module 20, a gun positioning module 23, and a direction sensor 21. The vital sign detection module 20 comprises a pyroelectric infrared sensor 42. The gun positioning module 23 comprises an GPS module 25 and indoor positioning system using a wireless sensor network as described above. Other than GPS technology may be used for the present invention and for the same purpose, including, but not limited to BeiDou (BeiDou Navigation Satellite System (BDS)), Galileo (or global navigation satellite system (GNSS)), or other positioning system. The direction sensor 21 uses a nine (9) axis motion sensor. Authorized personnel (i.e. the shooting range's administration offices) can decide which areas are considered restricted or non-restricted by using the gun positioning module 23. When this gun positioning module 23 is installed on the portable weapon 45, the safety control system 200*h* monitors its current location. The operator 60 of the portable weapon 45 would only be able to use the portable weapon 45 in the predetermined permitted areas. The nine-axis motion sensor in the direction sensor 21 collects acceleration data, gyroscope data, and the magnetic field data in real time. Data from the nine-axis motion sensor of the direction sensor 21 may be processed by the microcontroller 1 using a nine-axis fusion algorithm, thus the direction of the portable weapon 45 is calculated accordingly. Thus, the error range between the detected direction of the portable weapon 45 and the direction of the target 40 are monitored by the microcontroller 1. When the error range is outside the permitted range, then the safety control system 200*h* locks the firing sequence of the portable weapon 45, thus the portable weapon 45 is not permitted to fire. The vital sign detection module 20 is used to detect whether or not there is/are vital sign(s) present in the direction to which the portable weapon 45 points. If it detects that there are vital signs in front of the portable weapon 45, the microcontroller 1 controls the lock control drive 2 to drive the actuator 3 to lock the firing sequence of the portable weapon 45.

For further safety, a wireless remote control receiver module 14 for receiving remote control signal from a remote controller 300H, and/or a biometric/fingerprint detection module 24 may further be added.

FIGS. 2.11 and 2.12 shows an exemplary process flow diagrams of the safety control system 200H as shown in FIG. 2.1. For example, FIG. 2.11 is the process flow diagram of the microcontroller 1 in the polling state, and FIG. 2.12 is the process flow diagram of the microcontroller 1, taking advantage of its interrupt handlers and services.

Referring to FIG. 2.11, the safety control system 200*h* starts (S8-*a*1) to initialize (S8-*a*2), by loading the target directional data, the microcontroller 1 controls the lock control drive circuit 2 to drive the actuator 3 to lock the firing sequence of the portable weapon 45 (S8-*a*3), thus the portable weapon 45 is in locked state. Subsequently, the system begins to detect whether the vital sign detection module 20 detects vital signs (S8-*a*4). If a vital sign(s) is detected in front of the portable weapon 45, the microcontroller 1 controls the lock control drive circuit 2 to drive the actuator 3 to lock the firing sequence of the portable weapon 45 (S8-*a*4 to S8-*a*3). If no vital sign(s) is detected, then, the safety control system 200*h* check whether the portable weapon 45 is in the designated spatial location (S8-*a*5). If not, the microcontroller 1 controls the lock control drive circuit 2 to drive the actuator 3 to lock the firing sequence of the portable weapon 45 (S8-*a*3). If the portable weapon is in the designated spatial location, the safety control system 200*h* continues to collect acceleration data (S8-*a*6), to collect magnetic field data (S8-*a*7), to collect gyro data (S8-*a*8), and computes the direction to which the portable weapon 45 is pointing (S8-*a*9). The directional data of the direction to which the portable weapon 45 is pointing is calculated by the nine-axis motion sensor. Then, the directional data of the portable weapon 45 is compared with that of the target by the microcontroller 1, and an error angle/range between the directions of the portable weapon 45 and the target 40 is calculated. If the error range is within the predetermined permitted range θ (S8-*a*10) (setting θ to 45°, which can be adjusted according to the actual situation in the field), the microcontroller 1 controls the lock control drive circuit 2 to drive the actuator 3 to lock the firing sequence of the portable weapon 45 (S8*a*3). If the error range is less than or equal to the pre-set value θ, the microcontroller controls the lock control drive circuit 2 to drive the actuator 3 to unlock the firing sequence of the portable weapon 45 (S8-*a*11). After that, the safety control system 200*h* continues repeat the process from S8-*a*3 or S8*a*3 and onward.

While the portable weapon 45 is in use (either it is in locked or unlocked state), and if the wireless remote control receiver module 14 receives the emergency lock signal from the remote controller 300*h*, the microcontroller 1 of the safety control system 200*h* triggers an interrupt service to carry out the process steps as shown in FIG. 2.12. First, the microcontroller 1 saves the current state (either locked or unlocked state) when it enters to process the interrupt service (S8-*b*1 and S8-*b*2). The microcontroller 1 then enters into the interrupt service (S8-*b*3). The microcontroller 1 check the state whether it is in locked or unlocked state (S8-*b*4). If the state is locked, it continues to be in locked state and exits the interrupt stage (S8-*b*5). If the state is in unlocked state, then the microcontroller 1 checks whether a first authorized person (i.e. the supervisor) and a second authorized person (i.e. administrator) entered their fingerprints correctly. If the supervisor's fingerprint is not input correctly, the safety control system 200*h* controls the lock control drive circuit 2 to drive the actuator 3 to remain the firing sequence to be locked (S8-*b*7 and/or S8-*b*8 to S8-*b*5). If both the first and second authorized personnel's' fingerprints were entered correctly, the safety control system 200*h* controls the lock control drive circuit 2 to drive the actuator 3 to unlock (S8-*b*7, S8-*b*8 and S8-*b*9). Then, it exits the interruption state.

As it can be seen, some of the process steps in both or either FIG. 2.11 and/or FIG. 2.12 may be handled using interrupt handler/service of the microcontroller 1.

Integrated Embodiment 2

Referring to FIG. 2.2, according to yet another preferred embodiment of the present invention, it provides a portable weapon safety control system 200*i* for a portable weapon 45, comprising a biometric/fingerprint recognition module 24, a GPS module 25, and a GPRS module 26. As a person of ordinary skilled in the pertinent art would understand that, while GPRS is shown for this exemplary embodiment, other type of wireless technologies, such as 3G, 4G, 5G, or other wireless communication technology may be used for the same/similar purposes. Similarly, while GPS is shown for this exemplary embodiment, BeiDou (BeiDou Navigation Satellite System (BDS)), Galileo (or global navigation satellite system (GNSS)), or other positioning system may also be used. The GPS modules 25 monitors geographical position of the portable weapon 45, and the GPRS modules 26 send messages or SOS signals to a remote control center. Other technology(ies) than GPS technology may be used for the present invention and for the same purpose, including, but not limited to BeiDou (BeiDou Navigation Satellite System (BDS)), Galileo (or global navigation satellite system (GNSS)), or other positioning system. The fingerprint recognition module 24 recognizes unique biometrics/fingerprints to unlock the triggers for authorized and authenticated users.

When a portable weapon 45 is purchased, an owner of the portable weapon 45 may place his/her fingers on the biometric/fingerprint recognition module 24 to capture fingerprint information for activating the safety control system 200*i* which may be attached to the portable weapon 45. Then, the captured information may be sent to a server of a remote control center via the GPRS modules 26 as a part of registration for the portable weapon 45. In this way, the portable weapon 45 may be used only by its authenticated owner, and others are unable to unlock the portable weapon 45. The permitted areas where the portable weapon is allowed to use may be predefined by the remote control center, and communicated to the safety control system 200*i* via the GPRS modules 26.

For example, once the GPS modules 25 detects that the current geographical position of the portable weapon 45 is in a school, the safety control system 200*i* prevents the user of the portable weapon from unlocking it even if the operator is authenticated through the biometric/fingerprint recognition module 24. On the contrary, if the GPS module 25 detects that geographical position of the portable weapon 45 is inside the house of the owner of the portable weapon 45, the safety control system 200*i* is able to unlock the portable weapon 45 and the owner may use it to defend him/herself and/or to protect his/her properties. In the permitted areas, the portable weapon 45 is usually locked as its normal state and cannot be unlocked without the authentication of its authorized user via the biometric/fingerprint recognition module 24.

The safety control system 200*i* is installed on the portable weapon 45. FIG. 2.21 is an exemplary process flow diagram of the microcontroller 1 when the safety control system 200*i* goes into low-power mode. FIG. 2.22 is an exemplary process flow diagram of the microcontroller 1 when interrupt is triggered.

When the safety control system is powered on (S9-*a*1), the microcontroller 1 controls the lock control drive circuit 2 to drive the actuator 3 to lock the firing sequence of the portable weapon 45 (S9-*a*2). After that, the safety control system 200*i* check the state whether the portable weapon 45 is locked or unlocked (S9-*a*3). If it is in unlocked state, delay for T1*s* (S9-*a*5), and the microcontroller 1 controls the lock control drive circuit 2 to drive the actuator 3 to lock the firing sequence of the portable weapon 45 (S9-*a*6). If it is in locked state or just locked through the step S9-*a*6, then the microcontroller checks if the portable weapon 45 has been in locked state for more than $T_2$ seconds (where $T_2$ is a predetermined and pre-set value) (S9-*a*7). If so, the microcontroller 1 enters low-power mode or sleep mode (S9-*a*8), waiting to be awoken.

If a user would like to fire the portable weapon, he/she must provide authenticated fingerprints to the biometric/fingerprint recognition module 24 to unlock the portable weapon.

Referring to FIG. 2.22, once the biometric/fingerprint recognition module 24 detects a finger is placing on the module 24, the safety control system 200*i* wakes up and runs an interrupt routine (S9-*b*1/S9-*b*2). The GPS module 25 receives GPS signals and the safety control system 200*i* reads the geographical information to identify whether the current position is inside the permitted area to operate the portable weapon 45 (S9-*b*3/S9-*b*4). If the detected location of the portable weapon 45 is outside of the permitted area to use the portable weapon 45 (for example, in a school or a public area), the safety control system 200*i* exits the interrupt service and keeps the portable weapon 45 to be locked (S9-*b*4/S9-*b*8). If the detected location of the portable weapon is inside the permitted area to use the portable weapon 45 (i.e. in a shooting range, or in the owner's house), the safety control system 200*i* captures the fingerprints through the biometric/fingerprint recognition module 24 and identifies whether the user's fingerprint matches with any one of the fingerprints of the authenticated/authorized users. If the fingerprints do not match, the safety control system 200*i* exits the interrupt service and keeps the portable weapon in locked state (S9-*b*4/S9-*b*5/S9-*b*8). If the fingerprint matches with the authenticated/authorized one, the safety control system controls the lock control drive circuit 2 to drive the actuator 3 to unlock the firing sequence of the portable weapon 45. The GPRS module 26, then, sends this event to the remote control center for the records and for security checks of a government(S9-*b*4/S9-*b*5/S9-*b*6/S9-*b*7). After that, the safety control system 200*i* continuously detects the state of the portable weapon 45 (S9-*a*3/S9-*a*4 in FIG. 2.21). Once it detects the lock is opened, the safety control system 200*c* keeps it unlocked for a $T_{1s}$ seconds (S9-*a*5 in FIG. 2.21). During this $T_{1s}$ period, the authenticated user of the portable weapon 45 would have a sufficient time duration to shoot/operate the portable weapon 45. After $T_{1s}$ seconds, the safety control system 200*i* locks the trigger for safety or to prevent advertent mischarge (S9-*a*6).

An exemplary system configuration for the remote control center 600 is shown in FIG. 2.23, which is a remote controller, server or remote computer system that may include a processor 28 and its memory unit 33, a wireless communication module 27, a display 29, a buzzer 30, a warning light 31 and a router 32. The wireless communication module 27 receives signals from the GPRS module 26 of a safety control system 200(*a*) installed on a portable weapon 45. The memory unit 33 stores various date related to servers and databases in the remote control center 600. The display 29 shows detailed information of the portable weapon(s) 45 and the safety control systems 200(*a*) on the display 29. When unusual situations occur (illegal positions to use a portable weapon, signal losses, deliberate destruction), the detailed information is displayed on the display 29. Besides, the buzzer 30 and a warning light 31 may be activated to raise an alarm. The router 32 connects processor 28 of the control center 600 with the Internet/LAN (or any types of network) 15 and allows the network equipment 16 to access the servers and database.

The network equipment 16 may access the servers and database of the control center 600 via the Internet 15, and administrators with authority are able to check the state of the portable weapons 45 in real-time. The administrators log on to the safety control systems 200(*a*) and can access the database for detailed information of portable weapons connected to the control center 600, like type of portable weapons, date of purchase, serial number (and/or registration number, if applicable), address, owner's information, including one or more of owner's name, address, operator's license number, if applicable, etc., movement trajectories, areas where the portable weapon 45 appears and status whether the portable weapon is deliberately/maliciously damaged/destructed. But general users can only access their own guns' database to check records via the Internet 15 from desktops or mobile phones 17.

The control center 600 may be built based on Linux operation systems, and Boa embedded web servers; however, a person of ordinary skilled in the pertinent art would understand that other similar or different operating systems and web servers would also be utilized for the same/similar purposes. SQLite database may be installed on the ARM Linux OS; however, a person of ordinary skilled in the pertinent art would understand that other similar or different databases would also be utilized for the same/similar purposes. The SQLite database may be used for storing information of all activated safety control systems 200(*a*), such as the types of the portable weapons (i.e. handgun, rifle, etc.), dates purchased, names and IDs of owners, trajectories, deliberate destruction. Internet devices including mobile phones 17 can access the Boa web servers to check information of the portable weapons in real-time via the Internet 15 or wireless base stations 19. The SQLite database stores map data of the public areas (such as schools, churches, supermarkets, stadium, city halls, government buildings, etc.) This information is marked and stored in the map data.

The safety control systems 200(*a*) regularly samples GPS data, and send GPS information to the control center 600 via GPRS/3G module. After receiving the GPS information, the control center 600 stores the data in the database and compares the received GPS data with the targeted public areas. If the portable weapon 45 is detected in the public areas, the buzzer 30 and warning light 31 are activated to raise the alert and the display 29 shows that the portable weapon 45 is in danger. In the meantime, the control center 600 also sends signals to lock (or unlock) the portable weapon 45 via the 3G/4G module. Upon receiving the signals, the portable weapon 45 would be safely locked and cannot be fired. The control center 600 may be just a simple remote controller that would remotely broadcast/send signals to lock (or unlock) the portable weapon 45.

Preferably, a remote controller (not shown) similar to the remote controller 300H shown in FIG. 2.1 may be added to control the portable weapon safety control system 200(*a*). A manager/supervisor or authorized person may control the portable weapon 45 to be locked at any time through the remote controller. The management personnel or the security agency can also perform security control on the portable weapon 45 at any time through the control center 600. The administrator or security authority may have greater control rights through the control center 600 than the wireless remote controller (not shown), and, thus, if there is any conflict between the commands from the remote controller and the control center (600), the control center may have a higher priority (or the other way around, and such settings may be configurable). In this way, the portable weapons 45 may be controlled safely in real time according to policies, regulations and actual conditions to ensure the safety of the portable weapons. After experimental testing, the control center 600 may control within a minimum delay, such delay may be for 0.15~0.25 s (the time delay may be depending on, for example, the network delay), and the time delay for controlling the portable weapon 45 from the remote controller may be about/within 0.1~0.15 s.

If the control center 600 detects signals from the portable weapon 45 fading away (signal strength is less than a threshold), or the portable weapon 45 fails to send out signals to the control center 600, the portable weapon 45 is recognized to be in dangerous state. Accordingly, the control center 600 sends signals to lock the portable weapon 45 in order to maintain the safety.

An alarm system in the safety control system may detect disassembly and deliberate destruction of the portable weapon 45. FIGS. 3.1 and 3.2 shows an exemplary detection device MS1 for detecting such unauthorized disassembly/deliberate destruction of the portable weapon 45. The detection device MS1 comprises a lever MS11, which cooperates with a button or contact sensor MS10. The lever MS11 is operable, and biased such that without any forces, the lever MS11 does not depress the button MS10. When installed, the lever MS11 is arranged to be pressing against the button MS10, such that the lever MS11 pushes/depresses the button MS10 to indicate that the portable weapon 45, i.e. the grip guard cover G2, is in place/good condition for use; however, when the guard cover G2 is detached from the portable weapon 45, it causes the lever MS11 to move away from the button M10, thus the lever MS11 release the button MS10. This action would cause the safety control system 200(*a*) to detect destruction of the portable weapon 45. When the safety control system 200(*a*) is being destroyed with malice, the safety control system 200(*a*) is configured to send control signals to the control center 600. The control center 600 records the event and raises the alarm. To guarantee the reliability of the safety control system 200(*a*), two separate GPS modules 25 are installed in the safety control system 200(*a*). Therefore, the safety control system 200(*a*) is configured to work properly, even if one GPS module 25 is broken or out of order.

When the portable weapon 45 is purchased and activated, the owner's information is recorded and stored in the database of the control center 600. Different users with different profiles have different privileges. For example, general users (or unauthorized user) cannot use their portable weapons in public areas, while policemen are allowed to bear portable weapons and shoot when they are carrying out their duties in public areas. Therefore, the control center 600 determines the user's profile and privilege and sends proper signals to lock or unlock the portable weapons. The portable weapons of general users are locked in public areas, while the portable weapons of policemen are free to charge and shoot while carrying out their duties, because they have higher privilege.

When the owner of the portable weapon would require using the portable weapon for his or her self-defense, the safety control system 200(*a*) may immediately unlock the portable weapons, so that the owner can defend him/herself against the criminals.

Integrated Embodiment 3

According to another embodiment of the present invention, it provides a system includes a portable weapon safety control system 200*j* and a field controller 300*j*. The safety control system 200*j* mounts on a portable weapon 45, which include the first microcontroller 1 and an RFID electronic tag module 35 that communicate with the microcontroller 1, and/or a gun positioning module 23 with the wireless communication module 27. The microcontroller 1 is connected with the lock control drive circuit 2. The field controller 300*j* includes a beacon base station 150 and/or control center 600 installed in a public place. Wherein, the control center 600 is the same as described above in the integrated embodiment 2.

The RFID electronic tag module 35 corresponds with the beacon base stations 150 that are placed at the public locations. Wireless transmitting signals will be sent via free public radio spectrum at, for example, a 433 MHz frequency band. Currently, the signal coverage radius can reach up to 300 meters. The RFID electronic tag module 35 is installed on the safety control system 200*j* on the portable weapon 45. The RFID electronic tag module 35 corresponds with the beacon transmission module 155, which is used to receive the transmission signal from the station. When the RFID electronic tag module 35 receives the signal from the station, the microcontroller 1 will control the lock control drive 2 to drive the actuator 3 to remain locked in order to prevent any shooting occur at the public locations.

The safety control system 200*j* includes one or more unlocking module, which is a device to unlock the portable weapon 45 by entering and confirming the user information. The unlocking modules may include, but not limits to, a face recognition module 36, IC induction module, dynamic password module, heart rate blood oxygen module, finger-vein recognition module and inserting physical chip modules for the unlocking methods. The wireless communication module 27 includes but not limits to GPRS module 26, 3G communication module 34, 4G communication module, 5G communication module and other wireless communication modules. The gun positioning module 23 includes but not limits to GPS module 25. For example, other than GPS may be used for the present invention and for the same purpose, including, but not limited to BeiDou (BeiDou Navigation Satellite System (BDS)), Galileo (or global navigation satellite system (GNSS)), or other positioning system.

FIG. 2.3 is an exemplary block diagram, showing the RFID electronic tag module 35, GPS module 25, 3G communication module 34 and face recognition module 36.

FIG. 2.31 is an exemplary process flow diagram of interrupt that triggered by the RFID electronic tag module 35. FIG. 2.32 is an exemplary process flow diagram showing how the system is under the polling state. FIG. 2.33 is an exemplary process flow diagram that shows how the system interrupt which triggered by the face recognition unlocking module 36. Whereas, the interrupt that triggered by the RFID electronic tag module 35 has a higher priority than the one triggered by the face recognition unlocking module 36.

Referring to FIG. 2.32, when the safety control system 200*j* is power-on, the safety control system 200*j* starts to initialize (S10-*b*1), and the microcontroller 1 controls the lock control drive circuit 2 to drive the actuator 3 to keep the portable weapon 45 locked (S10-*b*2). The safety control system 200*j* monitors the RFID electronic tag module 35 to detect whether the transmission signal from a station is received (S10-*b*3). If the RFID electronic tag module 35 detects the signal, the safety control system 200*j* enter to handle an interrupt service that triggered by the RFID electronic tag module 35 (S10-*a*1/S10-*a*2, in FIG. 2.31). Please be aware that the interrupt has a higher priority than the one triggered by the face recognition unlocking module 36. Then, the safety control system 200*j* lock the firing sequence of the portable weapon 45, and then exit the interrupt that was triggered by the RFID module 35(S10-*a*3/S10-*a*4 in FIG. 2.31). At this moment, the portable weapon 45 remains locked. When the safety control system 200*j* detects that the portable weapon is at its locked stage and the locking period is larger than T2*s* (t≥T2*s*), then the microcontroller 1 controls the system to enter a low-power or sleep mode (S10-*b*8/S10-*b*9 in FIG. 2.32).

When the facial ID recognition button is pressed, the safety control system 200*j* enters the interrupt that triggered by the face recognition unlocking module 36 (S10-*c*1/S10-*c*2 in FIG. 2.33). Firstly, the safety control system 200*j* will check whether the RFID electronic tag module 35 has received the detection signal from the beacon signal station 150 (S10-*c*3 in FIG. 2.33). If the RFID electronic tag module 35 detects the beacon signal from the station, the safety control system 200*j* will exit the interrupt and continue to maintain the locking state (S10-*c*3/S10-*c*9 in FIG. 2.33). Therefore, it is impossible to unlock the portable weapon 45 through the face recognition unlocking module 36 in public. If an operator of the portable weapon is at home or at a shooting range, then the RFID electronic tag module 35 will be unable to receive the detection signal from the beacon signal station 150. At this point, when the face recognition unlocking module 36 is triggered, the safety control system 200*j* will read the GPS data (S10-*c*3/S10-*c*4 in FIG. 2.33). If the safety control system 200*j* detects that the portable weapon 45 is outside the permitted geographical area (such as various schools and public places), the safety control system 200*j* exits the interrupt stage and continue to remain the portable weapon to be locked (S10-*c*5/S10-*c*9 in FIG. 2.33). If the safety control system 200*j* detects that the portable weapon 45 is inside a permitted geographic location/area (such as the shooter's home or shooting range), the safety control system 200*j* continues to check whether the face recognition data entered matches the original data when the gun is activated by the operator (S10-*c*5/S10-*c*6 in FIG. 2.33). If facial data matches, the safety control system 200*j* controls the lock control drive circuit 2 to drive the actuator 3 to unlock the portable weapon 45. Then, the safety control system 200*j* sends the unlocked information to the control center 600 through the 3G communication module 34 and registers the unlocked shooting information for later verification by an authorized personnel/officer(s). The safety control system 200*j* then exits the interrupt stage and enters the polling state (S10-*c*6~S10-*c*9 in FIG. 2.33). The safety control system 200*j* continuously detects whether RFID electronic tag module 35 receives detection signals from the beacon signal station 150. If the detection signal of the beacon signal station 150 is not detected, the portable weapon remains in the locked stage (S10-*b*3 to S10-*b*4 in FIG. 2.32). When the status indicates "unlocked", the safety control system 200*j* makes the unlock time last for a period of time (t=T1*s*), within this time (t=T1*s*), the operator of the portable weapon would have sufficient time to fire the portable weapon, such as justifiable defense or hunting. After t=T1*s*, the safety control system 200*j* controls the lock control drive circuit 2 to drive the actuator 3 to lock the portable weapon and remains locked (S10-*b*5~S10-*b*7 in FIG. 2.32). If the locked state is detected, the safety control system 200*j* continues to detect whether the locking period lasts for t greater than or equal to $T_{2s}$(S10-*b*5/S10-*b*8 in FIG. 2.32), the safety control system 200*j* continues to detect and execute according to the above process.

Use of the face recognition unlocking module 36 is only for an illustration purpose(s) only. Accordingly, there are various other identification methods can also be used and implemented to meet various requirements to guarantee the safety.

For example, when the dynamic password unlocking module is used, if the provided dynamic password cannot match with the original password entered during the activation of the portable weapon, the portable weapon would remain to be in locked.

Another example, when the heart rate and blood oxygen unlocking module is used, if the safety control system of the present invention detects any abnormal heart rate or heart rate variability (HRV), which indicates a people is nervous, sympathovagal unbalance, or even under unconscious condition, then the portable weapon will be locked.

The method of the embodiment effectively solves the safety problem of the use of firearms in public places. These public places must have the beacon signals be installed in advance with our security control system to match the beacon signal station 150. In this way, shooting in public places can be effectively controlled and prevented.

All the safety control systems mentioned above can be used separately or jointly with all the trigger locks and electrical actuated firearm, to form the smart firearm trigger lock, which are all under the protection of this invention.

The invention claimed is:

1. A safety control system for a portable weapon, comprising:

a microcontroller for controlling a driver to drive an actuator for actuating a lock mechanism; and a vital sign detection sensor being in communication with said microcontroller and to detect a human in a direction to which said portable weapon is pointing; wherein said microcontroller determines to control said driver to drive said actuator to actuate said lock mechanism to lock a firing sequence of said portable weapon based on a detection signal from said vital sign detection sensor;

wherein said vital detection sensor is a body temperature sensor comprising:

a pyroelectric infrared sensor;

a Fresnel lens having a first side with a smooth surface and a second side with patterns, said second side facing with said pyroelectric infrared sensor; and a cylindrical housing member for housing said pyroelectric infrared sensor at one end, and said lens disposed at a focal distance of said lens away from said pyroelectric infrared sensor.

2. The safety control system as recited in claim 1, wherein said actuator permits said lock mechanism to unlock said fire sequence when no vital sign is detected by said vital sign detection sensor.

3. The safety control system as recited in claim 2, wherein said actuator further actuates said lock mechanism to unlock said fire sequence.

4. The safety control system as recited in claim 2, wherein said lock mechanism unlocks said firing sequence at a trigger, a trigger lever, a firing pin, a hammer of said portable weapon, safety, or a combination thereof.

5. The safety control system as recited in claim 3 further comprising a wireless remote control receiver that is in communication with said microcontroller for receiving a signal from a remote controller for remotely controlling said lock mechanism.

6. The safety control system as recited in claim 5, wherein said signal from said remote controller is for said microcontroller to control said actuator.

7. The safety control system as recited in claim 1 further comprising an infrared anti-reflection film on said first side of said Fresnel lens.

8. The safety control system as recited in claim 7, wherein said infrared anti-reflection film reduces reflection and refraction loss of infrared rays having wavelength ranges from 8 to 12 μm.

9. The safety control system as recited in claim 1 further comprising an authentication module for authenticating an operator, wherein the authentication module is a biometric recognition module or a fingerprint recognition module for recognizing said operator, or a RFID card reader being in communication with said microcontroller for reading an RFID card for recognizing said operator.

10. The safety control system as recited in claim 1, wherein said lock mechanism locks said firing sequence at a trigger, a trigger lever, a firing pin, a hammer of said portable weapon, safety, or a combination thereof.

11. The safety control system as recited in claim 1 further comprising a RFID tag receiving module that is in communication with said microcontroller for controlling said actuator by receiving a signal from a beacon station for allowing operation of said portable weapon.

* * * * *